US007938062B2

(12) United States Patent
Parker et al.

(10) Patent No.: US 7,938,062 B2
(45) Date of Patent: May 10, 2011

(54) APPARATUS AND METHOD FOR COMPRESSING A STACK

(75) Inventors: Kevin P. Parker, Berkeley, CA (US); Harold P. Hocking, Manhattan Beach, CA (US)

(73) Assignee: Powis Parker Inc., Berkeley, CA (US)

( * ) Notice: Subject to any disclaimer, the term of this patent is extended or adjusted under 35 U.S.C. 154(b) by 701 days.

(21) Appl. No.: 11/893,118

(22) Filed: Aug. 14, 2007

(65) Prior Publication Data

US 2008/0072774 A1 Mar. 27, 2008

Related U.S. Application Data

(63) Continuation-in-part of application No. 11/528,716, filed on Sep. 27, 2006.

(51) Int. Cl.
*B30B 15/06* (2006.01)
*B30B 15/14* (2006.01)

(52) U.S. Cl. ..... 100/295; 100/46; 100/219; 100/233; 100/258 R; 100/290; 412/22

(58) Field of Classification Search ..... 100/214, 100/219, 228, 233, 257, 258 R, 258 A, 264, 100/289, 290, 295, 915, 46; 412/10, 22, 23, 33, 37, 902

See application file for complete search history.

(56) References Cited

U.S. PATENT DOCUMENTS 354,953 A * 12/1886 Tracey ..... 412/10
3,460,173 A * 8/1969 Stuertz ..... 412/13
5,080,011 A * 1/1992 Paxton et al. ..... 100/229 A

* cited by examiner

*Primary Examiner* — Jimmy T Nguyen
(74) *Attorney, Agent, or Firm* — Girard & Equitz LLP

(57) ABSTRACT

A press specially adapted to compress a stack which includes one or more pressure sensitive based fastening layers which are actuated by application of substantial pressure. A lower press plate includes a receiving surface upon which the stack is positioned and first and second guide members, with the receiving surface being tilted with respect to a level plane such that the stack tends to move on the receiving surface towards the two guide members. An upper press plate is provided which includes a compressing surface which is substantially parallel with respect to the receiving surface when the press is in a first operating mode. A drive mechanism is provided for driving the lower and upper press plates towards one another so as to applying a compressing force to the stack.

28 Claims, 32 Drawing Sheets

APPARATUS AND METHOD FOR COMPRESSING A STACK

CROSS REFERENCE TO RELATED APPLICATIONS

The present application is a continuation-in-part of application Ser. No. 11/528,716 filed on Sep. 27, 2006.

BACKGROUND OF THE INVENTION

1. Field of the Invention

The present invention relates generally to equipment for binding books and the like and in particular to a press for applying a relatively large compression force to a stack of sheets so as activate a pressure sensitive adhesive so as to bind the stack.

2. Related Art

Photograph albums are becoming more popular, particularly with the advent of digital photography. One conventional approach is to secure the individual photographs in a pre-bound album having individual sheets to which the photographs are attached using adhesives and the like. The advantage of this approach is reduced costs at the expense of appearance. It is also possible to produce a photo album using commercial binding techniques to provide a more attractive product, but at a very substantial cost.

A typical commercially bound photo album, without the hardcover, is depicted in FIGS. 1A-1C of the drawings. An exemplary photograph 20 to be bound is shown in FIG. 1A for producing the bound album. The photograph 20 includes a central score line 22 to facilitate folding the photograph. Thus, for an album that is approximately 4×5 inches, the photograph 20 should be 8×5 inches. Multiple images can be placed on the photograph using photo editing techniques, taking into account that the photograph will be folded in the center. Images are printed only on one side of the photograph 20. The album shown in FIGS. 1B and 1C includes a total of three folded photographs 20A, 20B and 20C to provide a total of four album pages. One half of photograph 20A forms one page, with the other half of photograph 20A and half of photograph 20B forming a second page. The remaining third and fourth pages of the album are formed from the second half of photograph 20B and photograph 20C. The photographs 20A, 20B and 20C are each folded so that the images of each photograph face one another. The three photographs are secured to one another by way of two layers of adhesive 26 which attach the non-image side of the photographs together.

The three photographs are bound together, as represented by symbol 24, using conventional commercial binding techniques. Typically, the pages are bound together using an adhesive, with a reinforcing cloth present to add strength. These techniques are suitable for accommodating photographs which, as compared to sheets of paper, are relatively thick and rigid, particularly at the regions where the photographs are adhered together. The final album, with added hardcover, is attractive but very expensive and is thus usually reserved for wedding albums and albums for other special occasions.

Another conventional binding approach is illustrated schematically in FIG. 2 where four individual photographs 28A, 28B, 28C and 28D are bound together using a conventional binder strip applied using a conventional desk-top binding machine. As explained in detail in U.S. Pat. No. 5,052,873, a stack of sheets of paper can be bound using a binder strip that includes a layer of heat activated adhesive. The stack is inserted into the binding machine, with the machine functioning to apply the binder strip to the stack edge and to apply heat so as to activate the adhesive. Once the adhesive has cooled, a hardcover can then be applied to the bound stack. The same approach can be used to bind photographs, with numeral 30 representing the binder strip adhesive. This approach provides an attractive photo album at a very low price compared to the previously described commercial binding techniques. However, since each page includes only one photograph having an image on one side only, the back of each photograph can be observed by a viewer. This is a disadvantage in some applications, particularly when photo paper information or the like is printed on the backside of the photo. It would be possible to glue the back of two photographs together to provide one album page for each of the two photographs. However, because each page includes two photographs, the pages would be relatively thick and rigid. Such pages are not ideal for binding using the binder strip.

Epson American Inc. markets a product under the name "Story Teller Photo Book Creator" which is schematically depicted in FIG. 3. The product includes a bound stack of plain sheets which are bound together using conventional binding techniques represented by adhesive 30. Only a single complete bound plain sheet is depicted, with that bound sheet including a binding section 38A and a detachable section 40 separated from the binding section by perforations 42. The remaining bound sheets include bound sections 44B, 44C and 44D, with the associated detachable sections being previously removed by the end user. The plain sheet formed by binding section 38A and detachable sheet 40 has the same approximate dimensions as the photographs so that, among other things, the plain sheets 38/40 can be used to align the photographs with respect to the associated binding sections. Also depicted are fly leaves 34A and 34B which are also bound together with the sheets. The bound combination is provided with a hardcover which includes front and back cover sections 36A and 36B connected together by an intermediate spine section 36C. Each binding section 38A, 38B, 38C and 38D has an associated strip of pressure sensitive adhesive, including respective adhesive strips 44A, 44B, 44C and 44D. Each strip of pressure sensitive adhesive was originally covered by a release liner, with the liners having been previously removed during the assembly process.

The end user secures an individual photograph to each of the bound sheets by first positioning the photograph, photograph 46A for example, over one of the complete bound sheets which would include, for example, binding section 38A and attached detachable section 40. Once the photograph is aligned, the associated release liner is removed, with the user maintaining the photograph in proper alignment, thereby exposing the underlying pressure sensitive adhesive, such as adhesive 44A. The user then presses the photograph, such as photograph 46A, against the adhesive thereby securing the photograph to the binding section 38A. The user can then, if desired, remove the associated detachable sections, such as section 40. A significant disadvantage of this approach is that, as is the case of the FIG. 2 prior art embodiment, the back sides of the photographs are exposed to the viewer.

A still further prior art approach is shown in FIGS. 4A, 4B, 4C and 4D. This approach is marketed by ZoomAlbum, LLC under the name ZoomAlbum. As described at www.ZoomAlbum.com the user purchases photographic album paper which includes several individual sheets arranged in a single larger sheet. The larger sheet of photographic paper also includes various layers of pressure sensitive adhesive (not depicted in FIGS. 4A and 4B) which are presumably covered by separate release liners. Using software provided by the manufacturer, the user inserts the larger sheet of photographic paper in an ink jet printer, with the software allowing the user to locate individual images on the individual sheets of the larger sheet. Once the images are printed, the user reconfigures the large sheet, presumably using suitably located perforations and/or score lines, to arrive at a final assembly 48 as depicted in FIGS. 4A and 4B. The exemplary assembly 48 includes individual images 54A-54L applied by the printer. The images are separated by what appears to be folding cuts 50A-50E which permit the assembly to be folded at the cuts so as to provide a clean outer edge for each page of the album. The images are also separated by scribe lines or the like 52A-52F which also permit the assembly to be folded, with the scribe lines 52A-52F functioning as hinges when a user views the individual pages.

As previously noted, the assembly 48 includes various layers of pressure sensitive adhesive presumably covered with some form of release liner so that the adhesive can be exposed when required. As can be seen in FIG. 4C, pressure sensitive adhesive layers 56A-56L function to secure the back side of the image sheets together, with FIG. 4C illustrating the adhesive layers before they are forced together. By way of example, layers 56B and 56C secure the rear of the sheets carrying images 54B and 54C together so that the two image sheets form a single album page, with an image on both sides. When the ten image sheets are secured together in this manner, a total of five album pages 54B/C, 54D/E, 54F/G, 54H/I and 54J/K are produced as indicated schematically in FIG. 4D for the depicted exemplary embodiment in an open position. As also shown schematically in FIG. 4D, the folded edges 52A-52F come together to form a relatively continuous spine edge 58 which extends between front and rear cover sections 36A and 36B.

One shortcoming of the prior art approach of FIGS. 4A-4D is that specialized photographic paper having precut sections and pressure sensitive adhesives must be used. Further, it appears that size of the individual photographic images is limited since all of the images for a single book have to be printed on a single sheet.

There is a need for a relatively low cost approach for binding photographs and the like using desk-top equipment that produces an attractive bound volume having an appearance that approaches that of a commercially bound album. Such an approach would preferably not require the use of special photo-paper. As will become apparent from one skilled in the art upon a reading of the following Detailed Description of the Invention together with the drawings, the disclosed invention addresses the above-noted shortcomings of the prior art in addition to providing further advantages.

DETAILED DESCRIPTION OF THE INVENTION

Figure 1A:
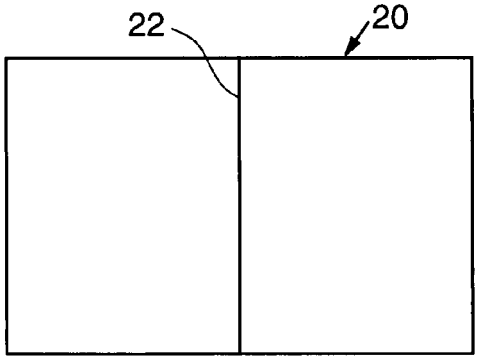
FIG. 1A (PRIOR ART)
FIG. 1A is a prior art photograph adapted to be bound in an album.
Figure 1B:
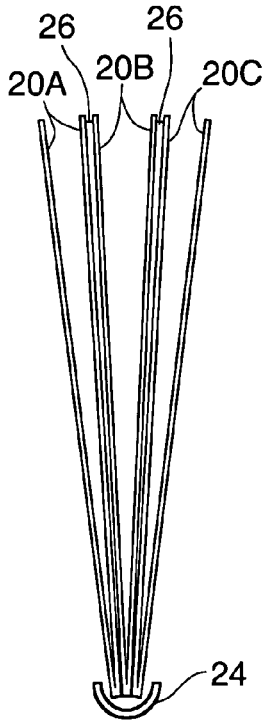
FIG. 1B (PRIOR ART)
FIGS. 1B is an end view of a prior art album using the photographs of FIG. 1A.
Figure 1C:
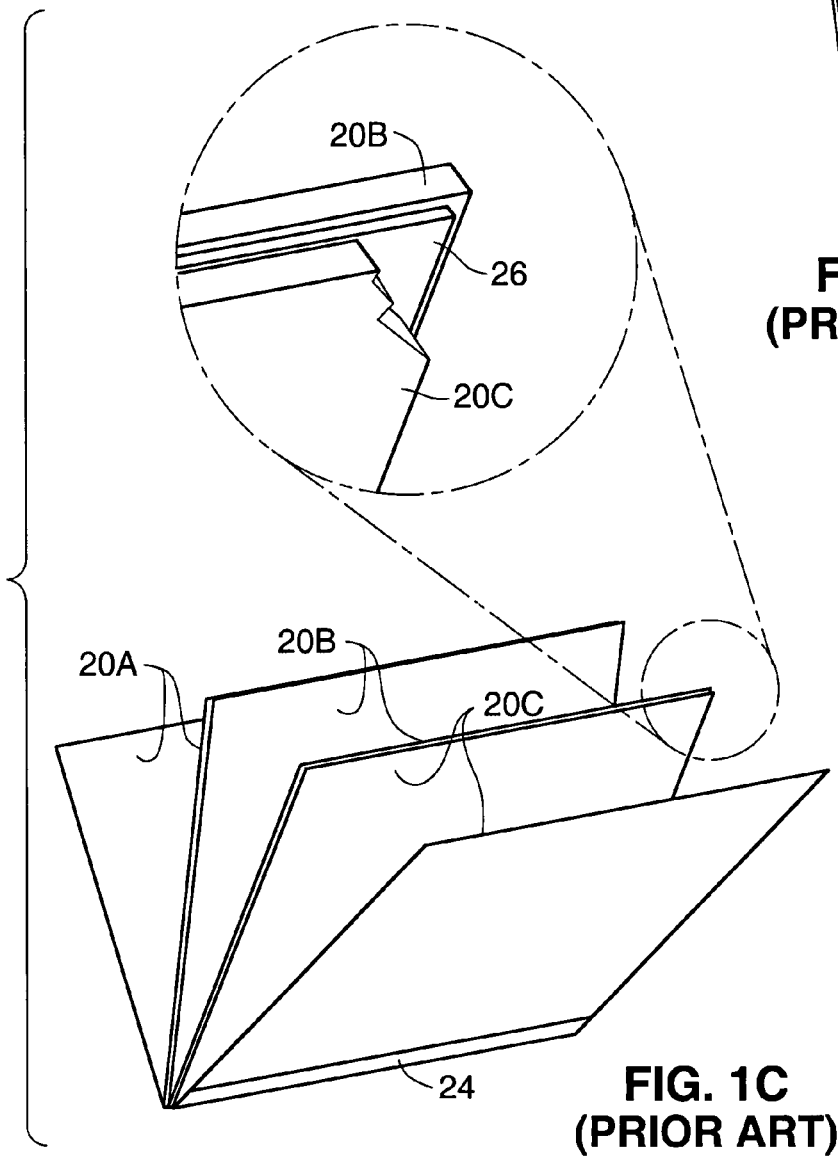
FIG. 1C (PRIOR ART)
FIG. 1C is a perspective view of the prior art album of FIG. 1B.
Figure 2:
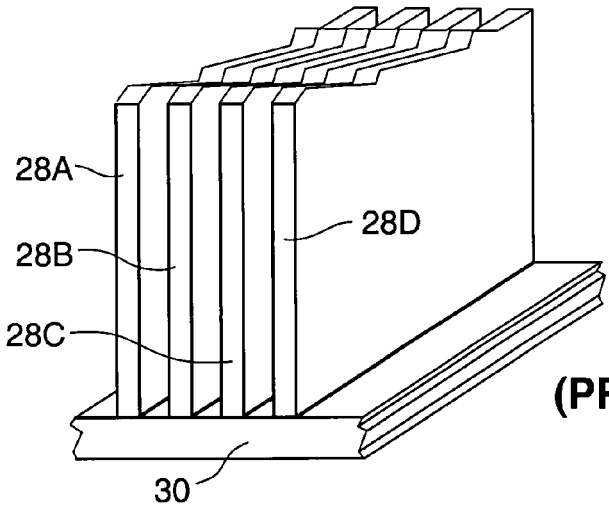
FIG. 2 (PRIOR ART)
FIG. 2 is a perspective view of another prior art approach to binding photographs, showing only the bound spine region.
Figure 3:
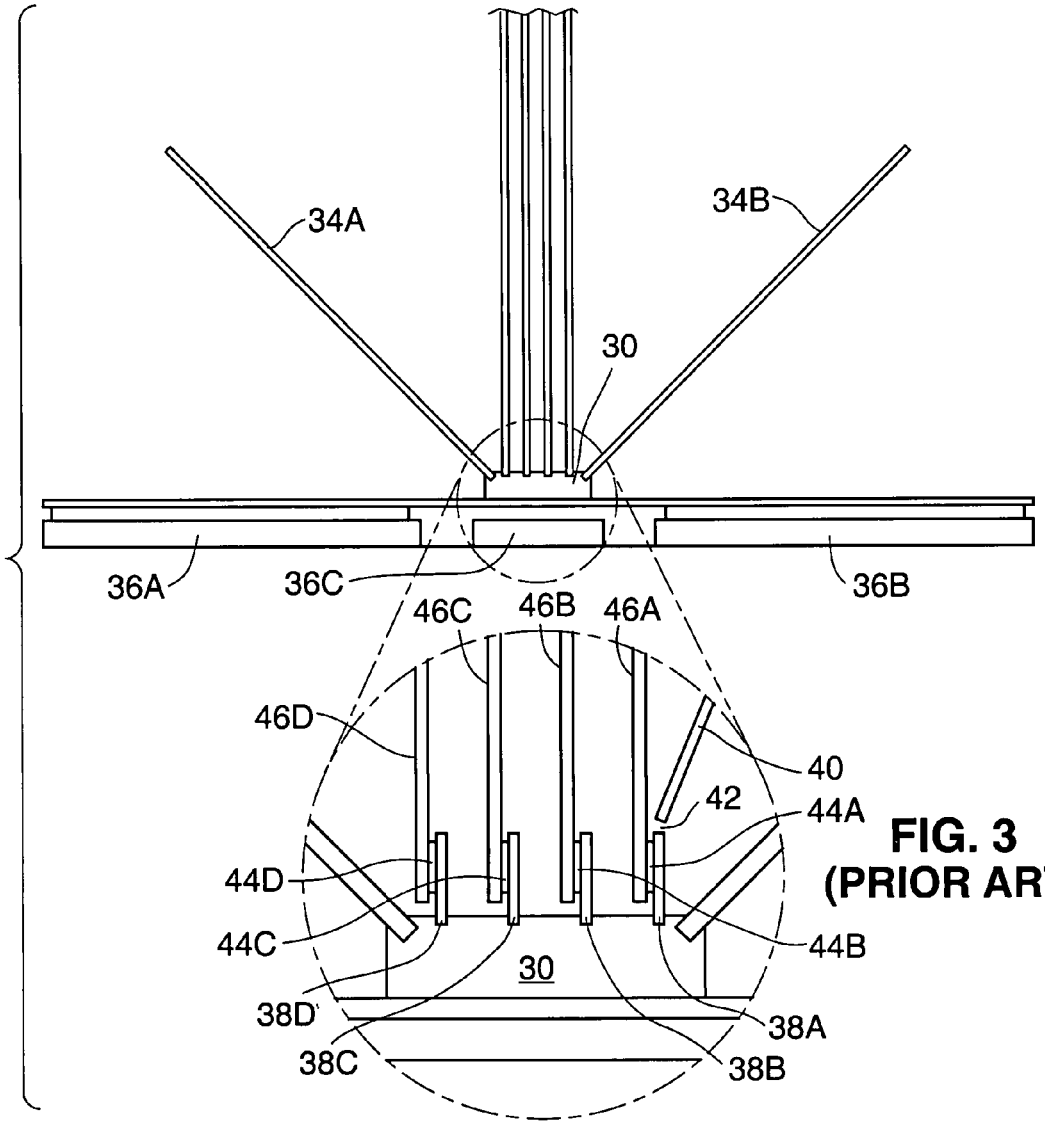
FIG. 3 (PRIOR ART)
FIG. 3 is a still further prior art approach to binding photographs where a pre-bound book is provided to which photographs are added.
Figure 4A:
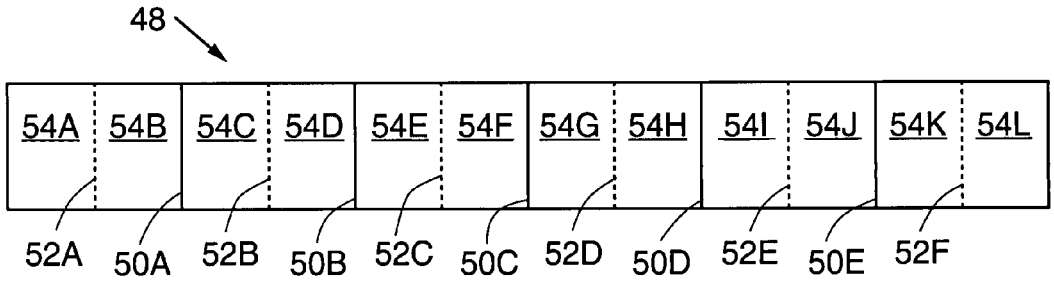
FIG. 4A (PRIOR ART)
FIGS. 4A and 4B show a prior art assembly of photograph paper in a fanfold arrangement.
Figure 4B:
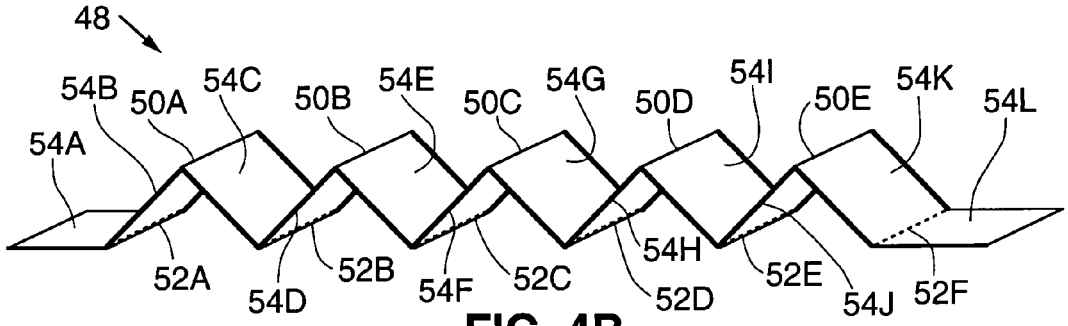
FIG. 4B (PRIOR ART)
Figure 4C:
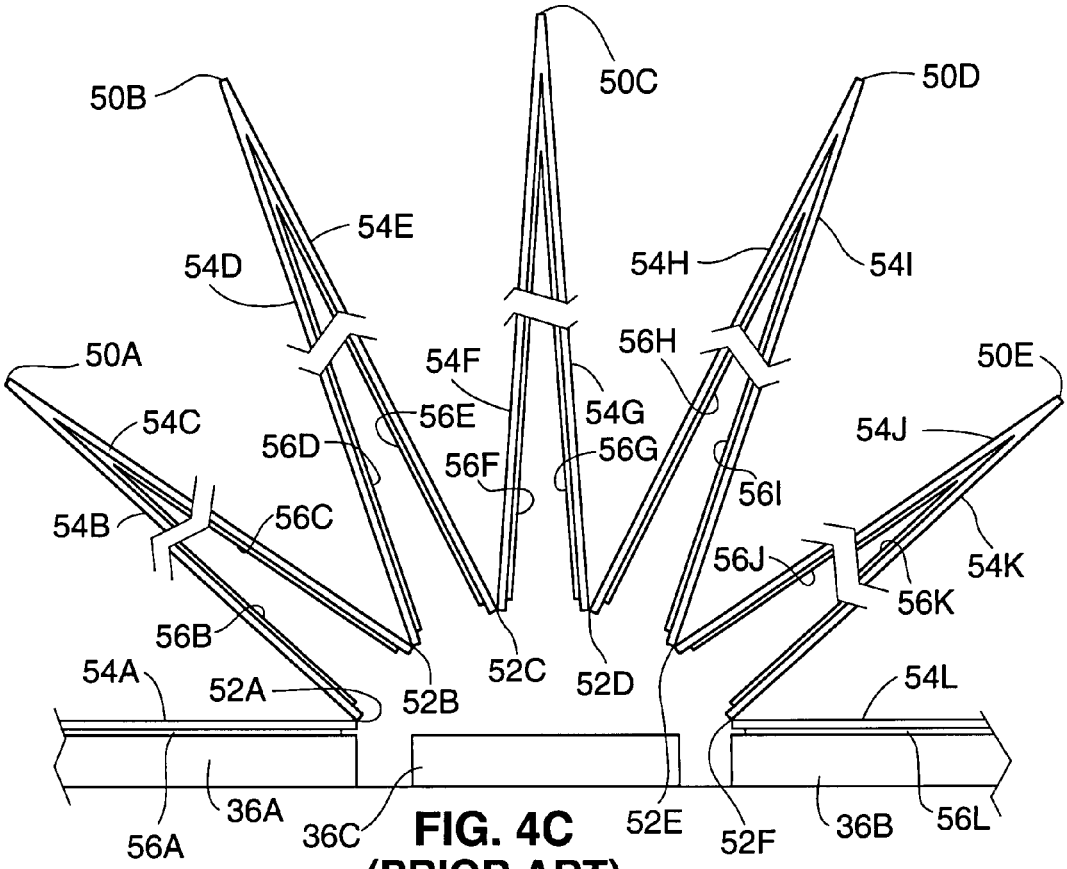
FIG. 4C (PRIOR ART)
FIG. 4C shows a prior art bound photograph album utilizing the fanfold arrangement of FIGS. 4A and 4B.
Figure 4D:
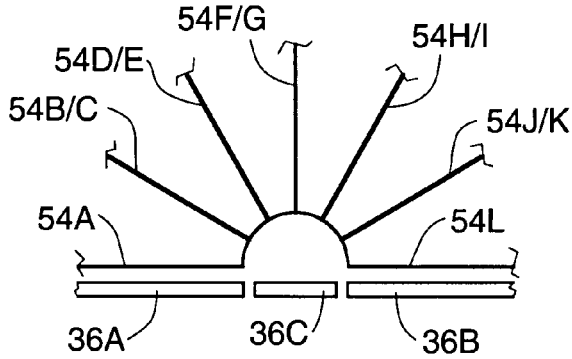
FIG. 4D is a schematic view of showing the bound spine edge of the prior art album of FIG. 4C.
Figure 5A:
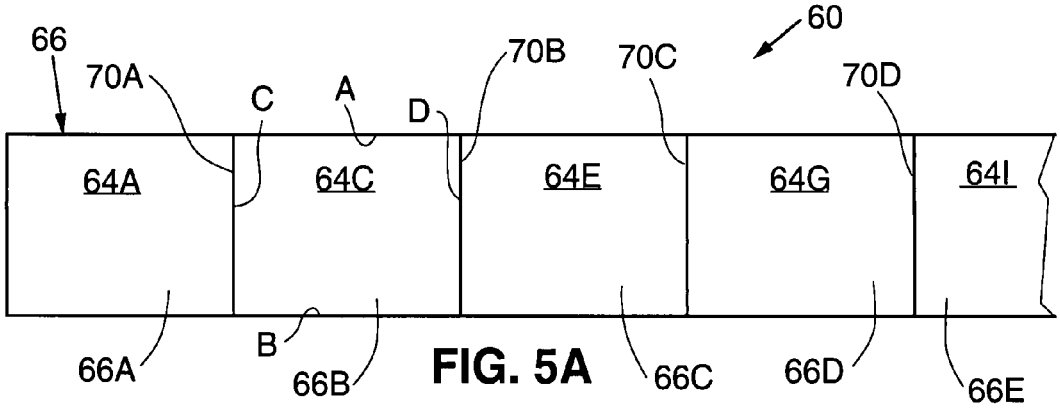
FIGS. 5A is a top view of a carrier assembly in accordance with one embodiment of the present invention showing the assembly prior to folding.
Figure 5B:
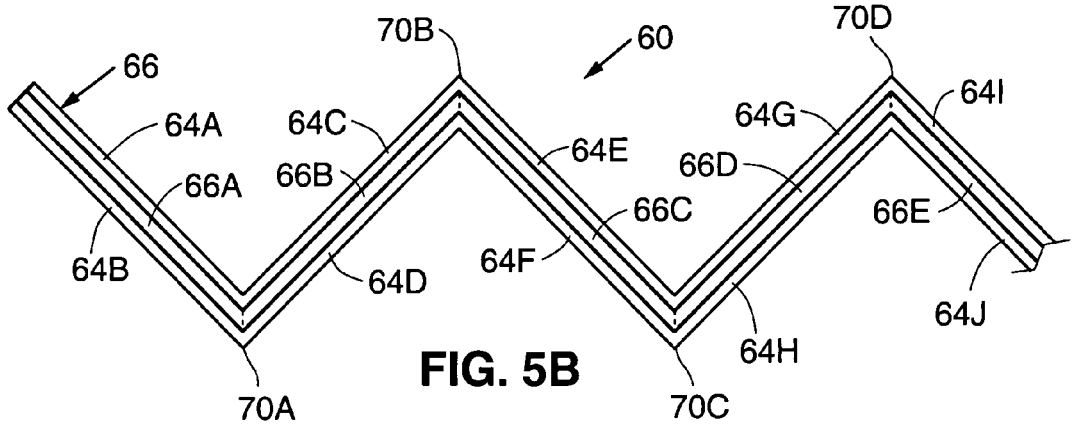
FIG. 5B is a side view of the carrier assembly of FIG. 5A after folding.

Referring again to the drawings, FIGS. 5A and 5B illustrates one embodiment of a carrier sheet arrangement 60, sometimes referred to as a carrier assembly, for forming a bound photo-album. It is to be understood that the present invention has applications other than binding photographs, including the binding of sheets that are relatively rigid and thick as compared to sheets of paper. The carrier sheet arrangement 60 is formed from a relatively heavy paper such as 80 pound weight Kraft paper which has strength and which can be readily folded to form and hold a sharp fold. The carrier sheet arrangement 60 includes generally one individual carrier sheet 66 (sheets 66A-66E) for each photograph to be bound. In some applications, the end carrier sheets 66A and 66E do not support a photograph but are used exclusively for securing the carrier sheet arrangement 60 or an end leave to a hardcover assembly. Both sides of each of the carrier sheets 66A-66E are covered by a fastening layer 64, some of which are used to secure the photographs to the carrier sheets and some of which are used to secure the carrier sheets together. In one embodiment, the fastening layers include heat activated adhesive and in another embodiment, the fastening layers include pressure activated adhesive. The pressure activated adhesive embodiment will be described first.

Each of the carrier sheets 66A-66E has dimensions close to that of the photographs to be bound. As can best be seen in FIG. 5B, the carrier sheets are preferably formed from a single piece of elongated material of Kraft paper, with the individual sheets being created by folding the elongated material at appropriate locations 70A, 70B, 70C and 70D so as to provide a fan-folded arrangement. The pressure-activated fastening layers 64 may then applied to the surfaces of the carrier sheets. As will be described in greater detail, the fastening layers 64 have a low tackiness when only small amounts of pressure are applied such as typically occur when handling the carrier sheet arrangement 60 during shipping and when initially positioning the photographs on the carrier sheets. When a relatively large amount of pressure is applied, the fastening layers become permanently highly aggressive so as to provide strong permanent adhesive bonds. Although the edges of the fastening layers 64 are shown in FIGS. 5A and 5B extending all of the way to the edges of the carrier sheets 66 on which the fastening layers are mounted, it is preferred that the fastening layers not extend all of the way to the carrier sheet edges. By way of example, the fastening layer 64C of FIG. 5A is shown having edges A, B, C and D, with those edges being depicted generally coincident with the edges of the carrier sheet 66B. However, edges C and D are each also preferably offset from the edges of the carrier 66B sheet defined by respective folds 70A and 70B by about 3/16 of an inch. Edges A and B are each preferably offset from the respective edges of the carrier sheet 66B by about 3/32 of an inch. It has been found that these offsets result in more attractive edges for the individual pages of the final product.

The carrier assembly 60 is preferably pre-manufactured and provided to an end user or assembler who assembles the photo-album for the ultimate customer. The customer typically provides the photographs for the album to the assembler. The carrier assembly 60 typically includes a large number of individual carrier sheets 66, with the assembly being cut along an appropriate one of the fold lines 70 so that the number of carrier sheets corresponds to the number of photographs to be bound. Alternatively, perforations could be added along the fold lines to that the carrier assembly sheets can be separated without cutting. As previously noted, the carrier sheets 66 are covered on both sides by a fastening layer 64. The fastening layer 64 can be implemented using either heat activated or pressure activated adhesive. The present embodiment utilizes fastening layers which incorporate pressure sensitive adhesive. As will be described in greater detail, the fastening layers are implemented to provide minimal adhesion during shipping and during the early stages of the assembly process without the use of release liners.

Figure 6A:
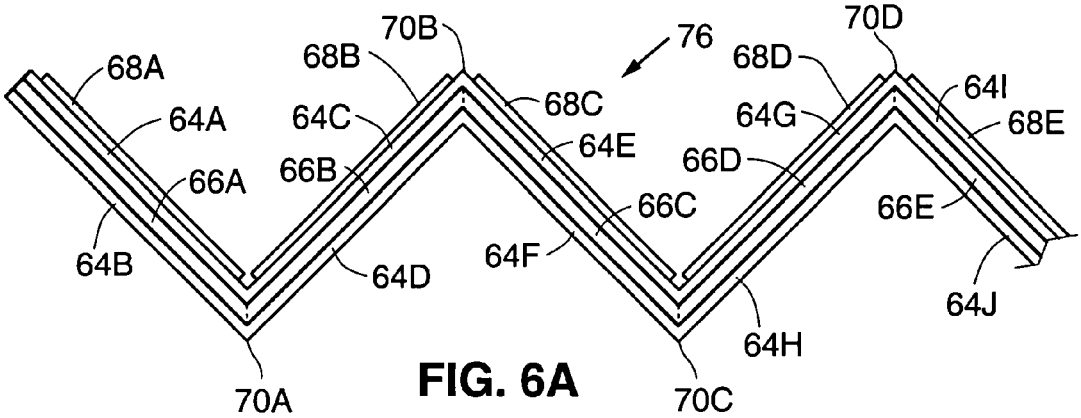
FIG. 6A is a side view of a carrier assembly in accordance with one embodiment of the present invention showing photographs positioned on a carrier assembly similar to that of FIGS. 5A and 5B prior to activation of the fastening layers that secure, among other things, the photographs to the carrier assembly.
Figure 7:
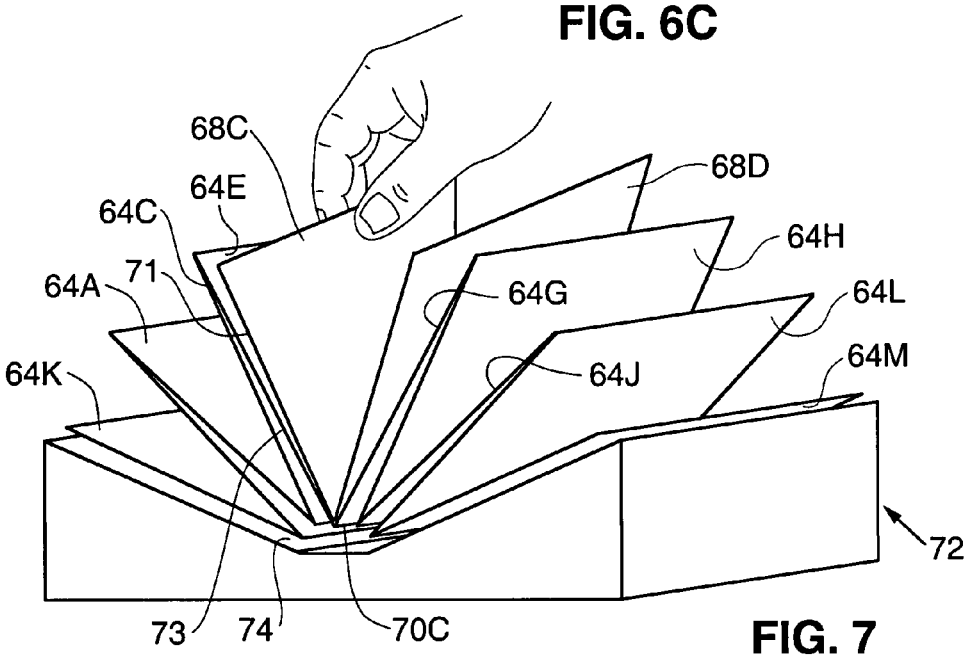
FIG. 7 is a perspective view of a user positioning photographs in a carrier assembly similar to that shown in FIGS. 5A and 5B.

Once the proper number of carrier sheets 66 for the carrier assembly 60 has been selected, the assembler positions the photographs 68 on the carrier assembly 60 as shown in FIGS. 6A and 7. In doing so, the photographs are positioned over the carrier sheets 66, with one of the fastening layers 64 being disposed between the photograph and the carrier sheet. The end sheets of the carrier assembly 60, such as sheet 66A, function to secure the carrier assembly to either a front or rear cover of a hardcover assembly as will be described. The end sheets may or may not also support a photograph depending on the customer's choice. One advantage of the subject carrier assembly 60 is that it is easy for the assembler to accurately position the photographs, an important requirement for an attractive final product. Ease of assembly is further greatly enhanced by the fact that the fastening layers, at this stage of the assembly, provide negligible adhesion and thus do not interfere with proper positioning of the photographs.

FIG. 7 shows a caddy 72 which is preferably used for loading the photographs 68 on the carrier assembly 60. The unloaded assembly 60 is first positioned on a receiving surface 74 of the caddy 72, with the surface being shaped to hold the assembly in an almost, but not complete, open position. This is sometimes called the expanded position for the carrier assembly 60. The receiving surface 74 is also angled so that the lower portion of the carrier assembly 60, which is located near the assembly person, is lower that the upper portion of the assembly. A lower stop, not depicted in FIG. 7 supports the lower edge of the carrier assembly 60 so that the assembly does not slide off the caddy. Thus, when photographs 68 are positioned over the carrier sheets as shown in FIG. 7, the photographs tend to drop down towards the intermediate folds in the carrier assembly and remain in that position. By way of example, photographs 68C and 68D, when placed over respective fastening layers 64E and 64G of respective sheets 66C and 66D, will drop down due to gravity, with the lower edges of photographs 68C and 68B both being positioned adjacent the corresponding fold 70C of the carrier assembly.

In addition, the photographs 68 will tend to slide down to the lower stop in the caddy 72 due to gravity so that the lower edges of the photographs are aligned with the lower edges of the associated carrier sheet. This will ensure that the upper edges of the photographs, edge 71 of FIG. 7 for example, will also be aligned with the upper edges of the associated carrier sheet, edge 73 for example, since the dimensions of the carrier sheets and the photographs are the same in this direction. The dimensions of the carrier sheets are also such that when the photograph edges are positioned adjacent the associated fold, such as photographs 68B and 68C of FIG. 6A, the outer edges of the photographs do not quite reach the common fold line, such as fold line 70B. After assembly is completed and compressed, as will be described, a small section of the outer edges of each photograph together with the underlying carrier sheets near the fold lines are trimmed to provide an attractive and even exposed edge for each page of the album. Once the initial photographs have been positioned in the carrier assembly 60, gravity tends to hold the photographs in place so that the remaining photographs can be easily positioned without disturbing these previously positioned photographs.

Figure 6B:
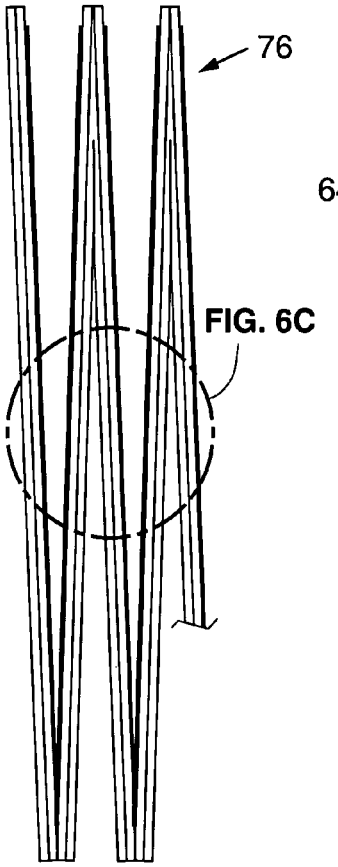
FIG. 6B is a schematic view of the loaded carrier assembly of FIG. 6A
Figure 6C:
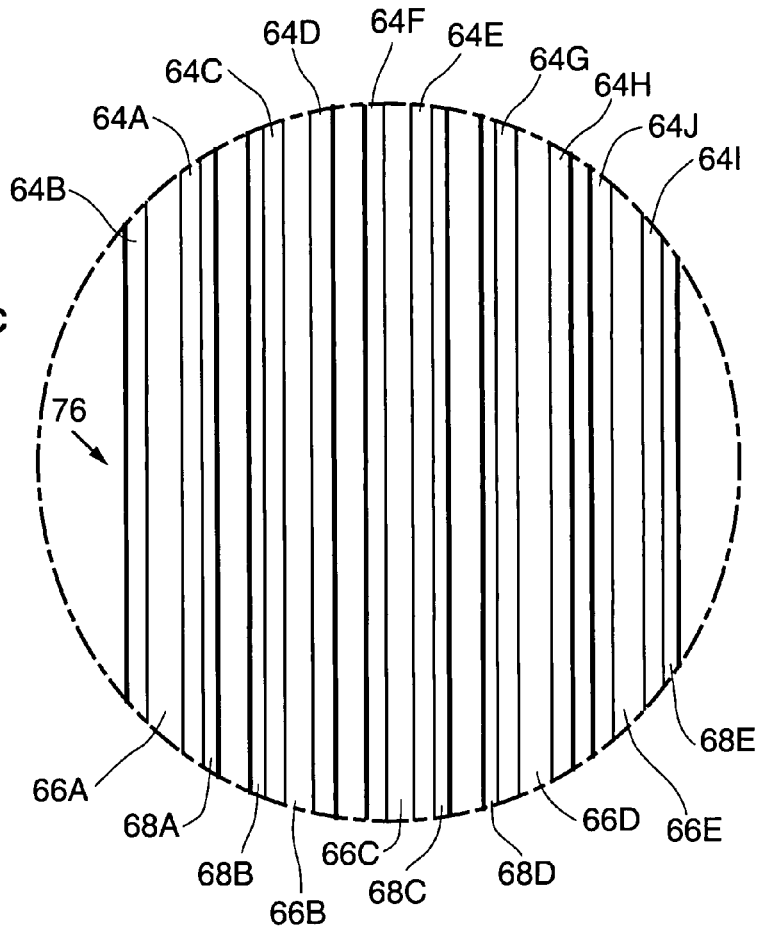
FIG. 6C is an enlarged partial view of FIG. 6B showing details of the loaded carrier assembly in a slightly compressed position showing the relative locations of the carrier sheets, fastening layers and photographs.
Figure 8A:
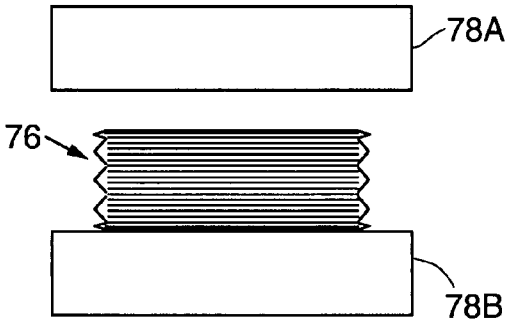
FIG. 8A shows a loaded carrier assembly of FIGS. 6A, 6B and 6C utilizing pressure sensitive adhesive based fastening layers positioned on the bottom plate of a press prior to compression.

Once all of the photographs 68 have been positioned in the carrier assembly 60, the loaded assembly 76 is carefully moved from an expanded state of FIG. 7 to a compressed state as shown schematically in FIGS. 6B and 6C by manually applying a slight compression force. This force maintains the correct position of the photographs on the carrier assembly. The loaded and compressed carrier assembly 76 is then positioned between the front and back covers of a hardcover assembly so that, for example, fastening layer 64B is positioned adjacent the inside of the front cover and so that another fastening layer is positioned adjacent the inside of the rear cover. The loaded carrier assembly 76 and hardcover assembly are then transferred to a desk-top press as depicted in FIG. 8A. The press includes upper and lower plates 78A and 78B which function to apply a compression force of typically 50 to 100 pounds per square inch of carrier assembly area, with the actual force depending upon the characteristics of the fastening layers 64. As will be explained, this force will activate each of the fastening layers 64 so that the pressure sensitive adhesive in the layers will permanently secure selected components of the loaded carrier assembly together. After compression, the press is opened so that the loaded carrier assembly and hardcover can be removed.

Figure 9:
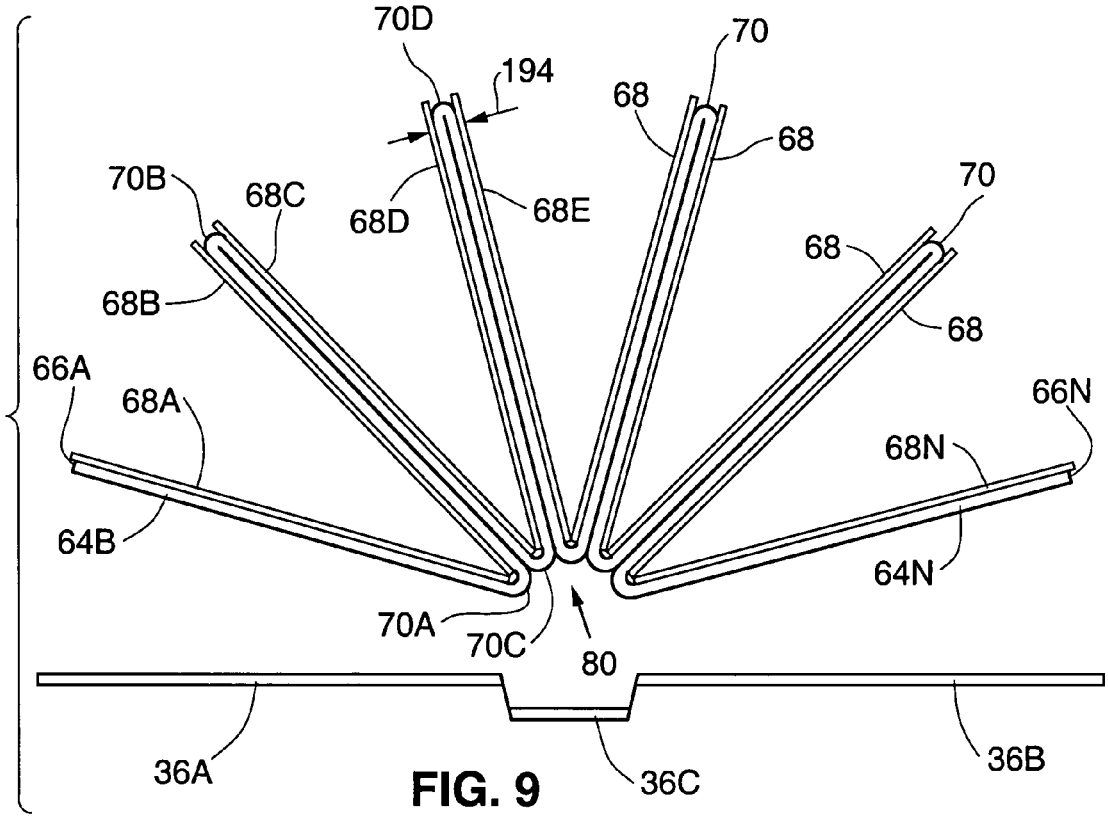
FIG. 9 is a schematic end view showing details of the spine region of an bound album, with the album being disposed in a hardcover assembly.

As can be seen schematically in FIG. 6C, compression causes the various fastening layers 64 to secure selected elements of the loaded carrier assembly 76 together, with FIG. 6C showing some of the selected elements in a compressed form, a form where the photo-album is closed. FIG. 9 shows the complete photo-album, including additional pages not depicted in FIGS. 6C, in an open form, including the hard cover assembly which includes respective front and back covers 36A and 36B and intermediate spine section 36C. As can best be seen in FIG. 6C, the activated fastening layer 64B functions to secure carrier sheet 66A to the front cover 36A of FIG. 9. Another fastening layer 64, not shown in FIG. 6C, is located on the opposite side of the carrier assembly and functions to secure a carrier sheet assembly to the back cover 36B. Thus, the hardcover assembly is secured to the carrier assembly at the front and back cover sections and not to the spine section 36C so that the album will tend to lay flat when fully opened as shown in FIG. 9.

Continuing, after compression fastening layer 64A will become activated and will function to secure photograph 68A to the carrier sheet 66A. Thus, the inner side of the front cover 36A will display photograph 68A. In addition, fastening layer 64C will secure photograph 68B to carrier sheet 66B and fastening layer 64E will secure photograph 68C to carrier sheet 66C. Continuing, fastening layers 64D and 64F will function together to secure the backsides of carrier sheets 66B and 66C together so that photographs 68B and 68C, together with intermediate carrier sheets 66B and 66C, form a single page of the album. That page includes photograph 68B on one side and photograph 68C on the opposite side. Similarly, photographs 68D and 68E, together with intermediate carrier sheets 66D and 66E, form a further page of the album. The album would typically include other carrier sheets of the carrier arrangement 60 along with associated photographs so that the album would include additional pages as shown in FIG. 9.

As can also be seen in FIG. 9 and as previously noted, the fastening layers 64 function to secure front and back carrier sheets to the inner surface of the respective front and back cover sections 36A and 36B. Further, the fastening layers 64 function to secure selected adjacent carrier sheets together to form a flexible spine 80. By way of example, fastening layers 64D and 64F secure the entire respective surfaces of carrier sheets 66B and 66C together so that the fold lines 70A and 70C are disposed adjacent one another to form a single page. The single pages are all secured together at the spine 80 by the carrier assembly itself. Note that it would be possible to pre-manufacture the carrier assembly 60 so that the carrier sections that become secured together along the full surface, such as carrier sections 66B and 66C, are glued together using conventional book binding adhesives or the like. In that event, certain fastening layers, such as layers 64D and 64F, can be deleted from the carrier assembly 60 provided to the assembler. As previously noted, it is preferably that the outer edges of the pages that make up the album be trimmed. As indicated by arrow 194 of FIG. 9, the page is trimmed so as to remove part of the photographs 68D and 68E and part of the underlying folded carrier sheets which form fold 70D so that the material forming the fold is removed. This cut is preferably not so deep as to expose the underlying pressure sensitive adhesive which, as previously described, terminates about 3⁄16 of an inch from the fold 70D. This presents an attractive even edge free of adhesive, so that the edge does not attract debris and the like which could possibly adhere to any exposed adhesive. As also previously noted, the adhesive of the fastening layer is displaced typically 3⁄32 of an inch from the edges that form the top and bottom of the album pages thereby further proving an attractive edge free of any collected debris.

Details regarding the construction of the fastening layers 64 will now be provided. As previously noted, an objective of the fastening layers 64 is to provide negligible adhesion when the layer is subjected to low forces such as are present when the carrier assembly 60 is shipped and when photographs 68 are being positioned on the carrier assembly. Any significant adhesion would, for example, greatly complicate accurate positioning of the photographs.

Figure 10A:
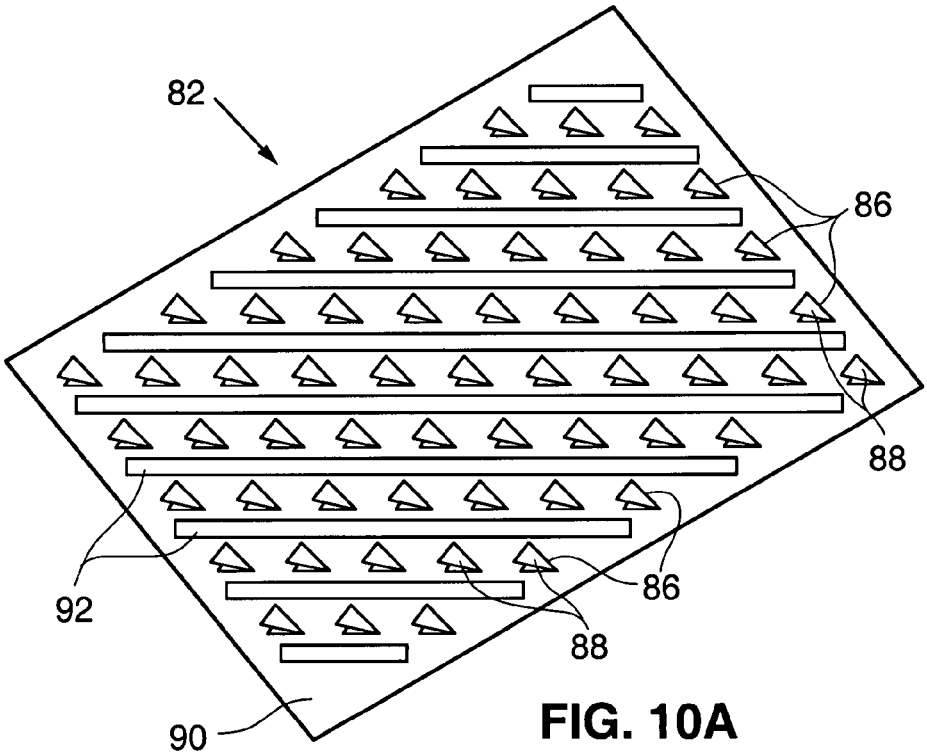
FIGS. 10A, 10B and 10C show one embodiment of a pressure sensitive adhesive based fastening layer.
Figure 10B:
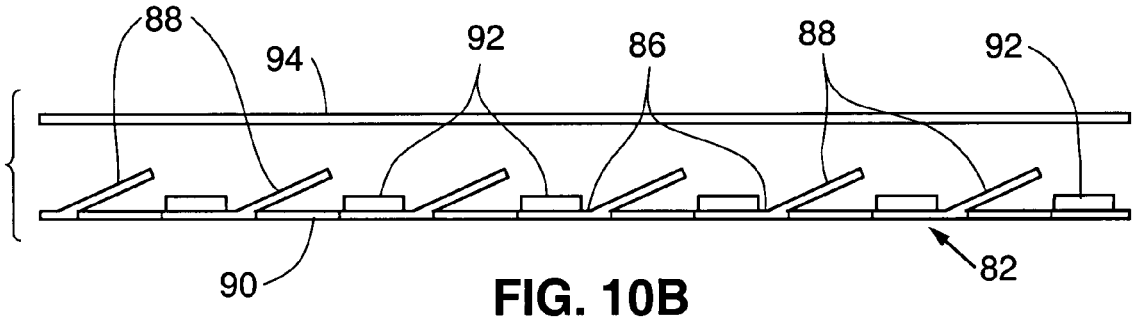
Figure 10C:
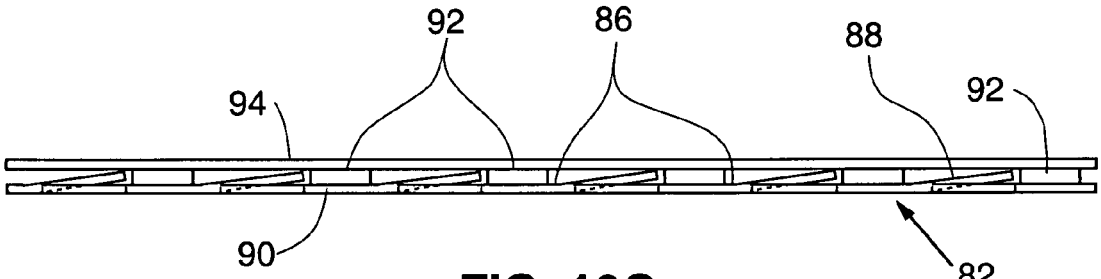

FIGS. 10A, 10B and 10C illustrate one embodiment of the subject fastening layers, sometimes referred to as the flap style fastening layer 82. As is the case for many of the fastening layer embodiments, fastening layer 82 utilizes part of the underlying carrier sheet designated sheet 90. As can best be seen in FIG. 10A, fastening layer 82 includes an array of generally triangular shaped flap members 88 (not all are designated) cut into the carrier sheet 90. The flap members 88 remain secured to the carrier sheet by way of hinge sections 86 (not all designated) so that the flap members can move between a folded upright position as shown in FIGS. 10A and 10B and a flattened position as shown in FIG. 10C. A small but finite force is required to displace each of the flap members 88 from the upright to a more flattened position. The flap members 88, which are sometimes referred to collectively as the support structure, are arranged in an array, with there typically being at least one flap member per square inch of fastening layer 82 area and preferably approximately 25 members per square inch.

Fastening layer 82 further includes a layer of pressure sensitive adhesive such as a hot melt pressure sensitive adhesive sold by HB Fuller under the designation HM-2713. Unless noted otherwise, a thickness of the pressure sensitive adhesive layer for the various embodiment fastening layers ranging from 1 to 1½ mils has been found to be satisfactory, with this thickness being adjustable to alter the characteristics of the fastening layer as needed. The adhesive layer includes several individual adhesive strips 92 disposed on the surface of the carrier sheet intermediate the array of flap members 88. When the carrier sheet is manufactured, the flap members 88 are positioned (folded) to extend away from the carrier sheet in an upright position and to extend through and past the upper surface of the adhesive layer comprised of adhesive segments 92. Thus, if some generic compressing sheet 94, such as a photograph or the like, is resting on the fastening layer 82, the support structure formed by the various upright flap members 88 will prevent the compressing sheet 94 from contacting the upper surface of the adhesive layer as defined by adhesive segments 92. Thus, the compressing sheet 94 does not adhere to the fastening layer or the underlying carrier sheet. However, if a large compression force were applied to the fastening layer 82 by way of a compressing sheet 94, the force would be sufficient to displace the support structure, that is, sufficient to force the flap members 88 down below the upper surface of the adhesive layer 92 thereby exposing the adhesive layer so that the layer can function to secure the compressing sheet 94 to the underlying carrier sheet 90 as shown in FIG. 10C. Although the adhesive layer of fastening layer is comprised of disconnected adhesive segments 92, it would be possible to use other configurations of adhesive intermediate flap members 88 including a single connected adhesive grid extending over substantially the entire surface of the carrier sheet 90 intermediate the flap members.

Figure 11A:
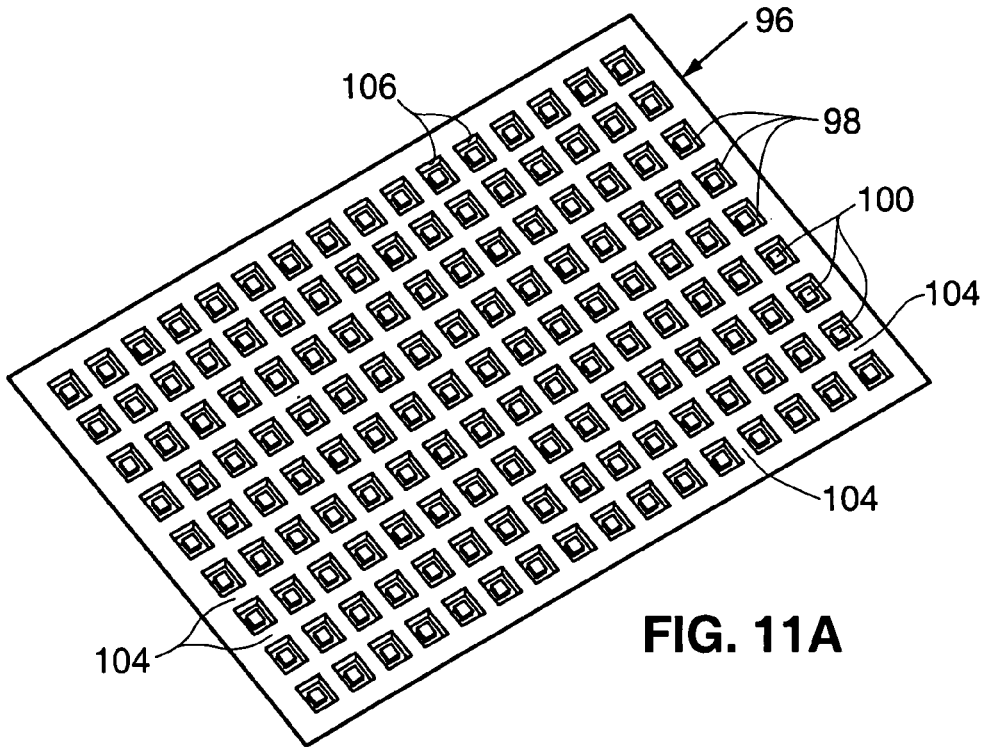
FIGS. 11A, 11B and 11C show another embodiment of a pressure sensitive adhesive based fastening layer.
Figure 11B:
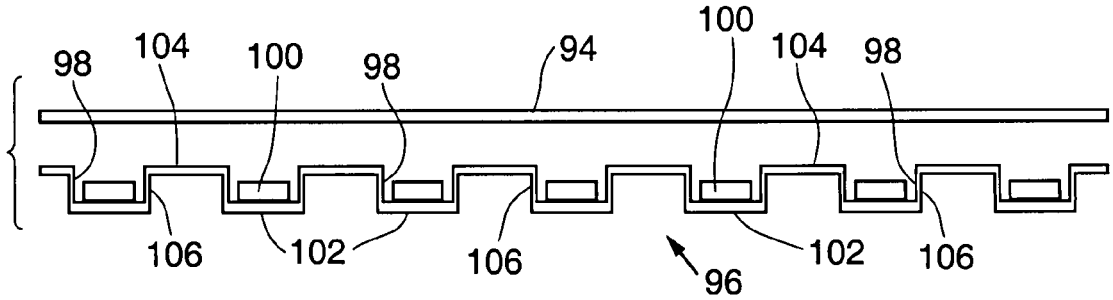
Figure 11C:
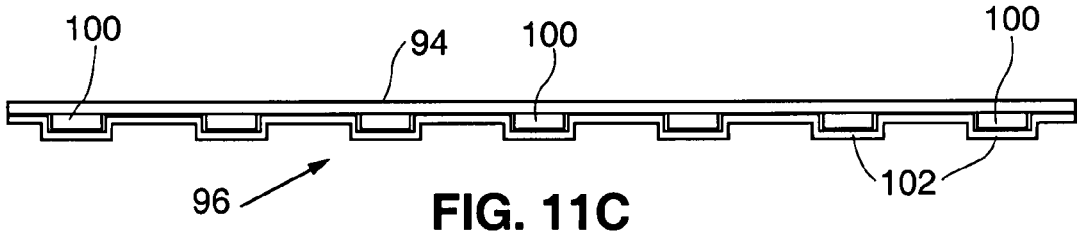

A further fastening layer embodiment is shown in FIGS. 11A, 11B and 11C. This embodiment, sometimes referred to as the well type fastening layer 96, also uses part of the underlying carrier sheet to form the support structure. The well fastening layer 96 includes an array of wells 98 (not all designated) typically created by deforming the carrier sheet. The wells 98 are arranged in an array, with the well density typically being at least one well for each square inch of fastening layer area and preferably approximately 25 wells for each square inch of area. A segment 100 of pressure sensitive adhesive is disposed in each well 98, with the adhesive segments together forming a layer of pressure sensitive adhesive. The bottom portions 102 of the wells together form the carrier sheet upon which the fastening layer 92 is disposed.

The fastening layer 96 includes a support structure which includes the raised region 104 intermediate the wells and the well wall members 106 (not all designated) which extend up from the surface supporting the adhesive segments 100 and past the upper surface of the adhesive segments. Thus, when a generic compressing sheet 94, such as a photograph, is resting on the fastening layer 96, the support structure, which includes raised region 104 and wall members 106, prevents the sheet from contacting the adhesive layer 100. Thus, the sheet 94 will not adhere to the underlying carrier sheet 102. However, should a substantial amount of pressure be applied to the compressing sheet 94, the support structure 104/106 will be displaced so that the upper surface of the adhesive layer formed by pressure sensitive adhesive segments 100 will contact sheet 94 as shown in FIG. 11C. Thus, the sheet 94 is secured to the underlying carrier sheet formed by well bottom portions 102.

Figure 12A:
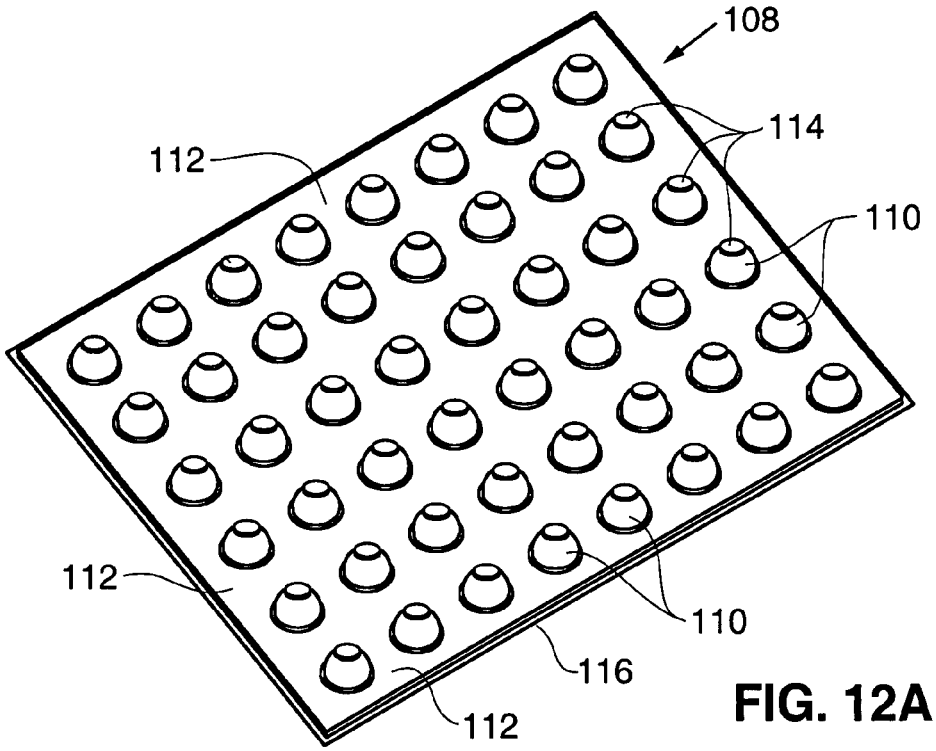
FIGS. 12A, 12B and 12C show a further embodiment of a pressure sensitive adhesive based fastening layer.
Figure 12B:
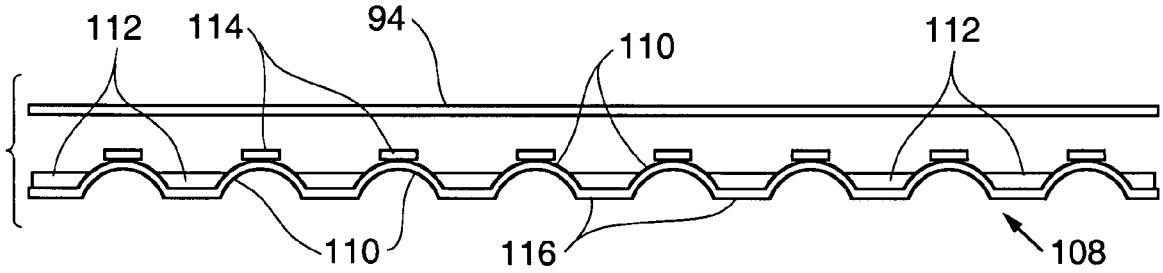
Figure 12C:
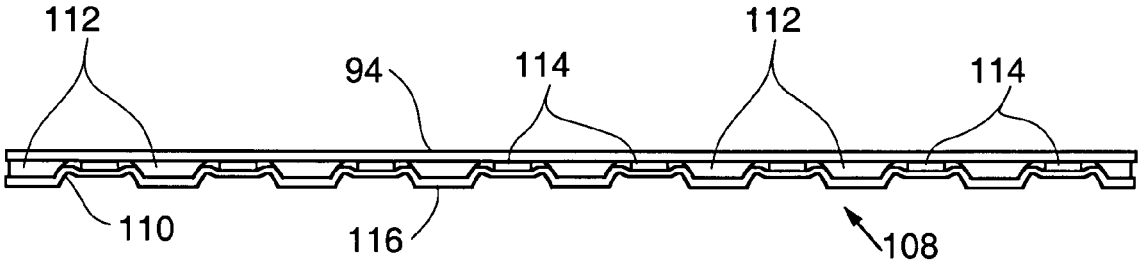
Figure 13A:
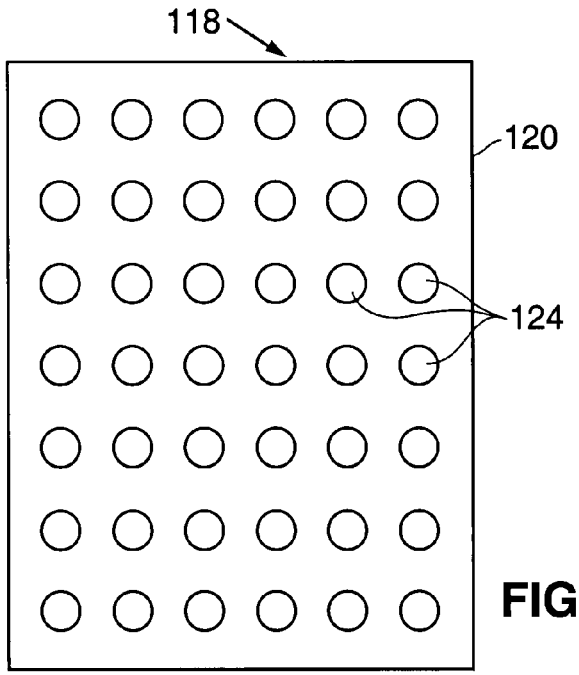
FIGS. 13A, 13B, 13C and 13D show a still further embodiment of a pressure sensitive adhesive based fastening layer.
Figure 13B:
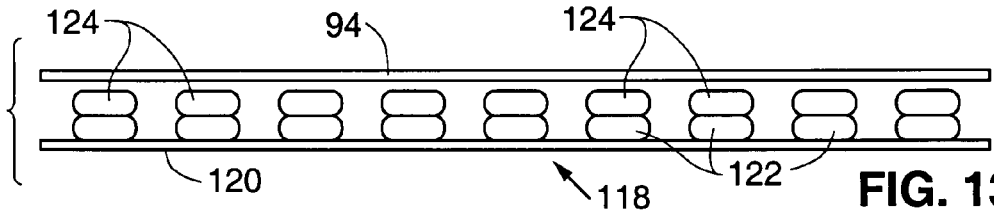
Figure 13C:
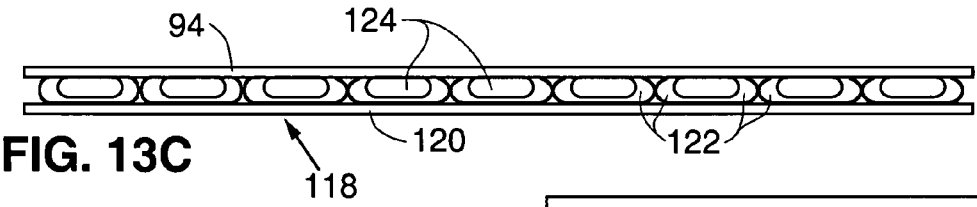
Figure 13D:
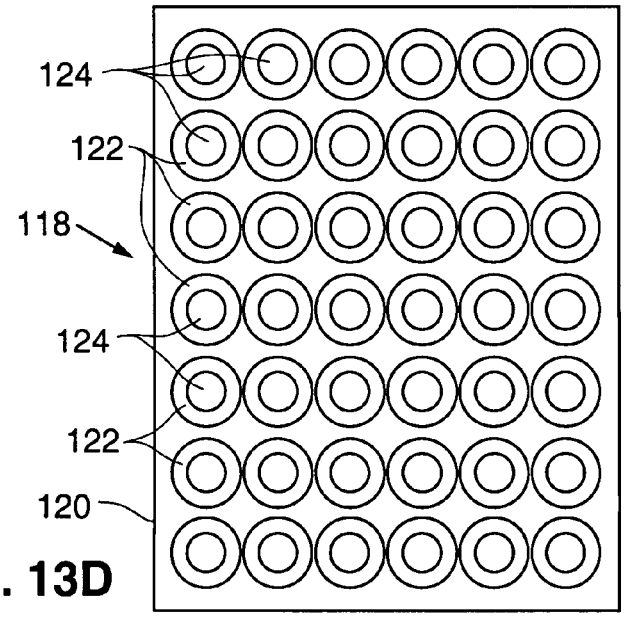

A still further fastening layer embodiment 108 is shown in FIGS. 12A, 12B and 12C. This embodiment, sometimes referred to as the raised area type fastening layer 102, also uses part of the underlying carrier sheet for part of the support structure. Fastening layer 108 includes an array of raised areas 110 (not all designated) typically created by deforming the carrier sheet. The raised areas 110 are arranged in an array, with the raised area density typically being at least one raised area for each square inch of fastening layer area and preferably approximately 25 raised areas for each square inch of area. The regions intermediate the raised areas 110 form the carrier sheet 116. A layer 112 of pressure sensitive adhesive is supported on the carrier sheet 116, extending around each of the raised areas 110.

The fastening layer 108 includes a support structure which includes the raised regions 110 in combination with a separate support member 114 supported on each raised member. The support members 114 are preferably made from material having a silicone treated surface and are solid so that they do not compress when typical forces are applied in the press. Each support member is held in place by a thin layer of pressure sensitive adhesive (not depicted) which can be an extension of adhesive layer 112. The upper surfaces of the support members 114 initially extend past the upper surface of the adhesive layer 112. Thus, when a generic compressing sheet 94, such as a photograph, is resting on the fastening layer 108, the support structure, raised regions 110 and support members 114, prevent the sheet from contacting the adhesive layer 112. Thus, the sheet 94 will not adhere to the underlying carrier sheet 116. However, should a substantial amount of pressure be applied to the compressing sheet 94, the support structure 114/110 will be displaced, with the support members 114 functioning to collapse the associated raised areas 110. This results in the upper surface of the adhesive layer 112 contacting sheet 94 as shown in FIG. 12C. Thus, the sheet 94 is secured to the underlying carrier sheet 116.

As still further embodiment fastening layer 118 is shown in FIGS. 13A, 13B, 13C and 13D. Unlike the previous embodiments, this embodiment utilizes a support structure that is separate from the underlying carrier sheet 120. As can best be seen in FIG. 13B, an array of spaced-apart pressure sensitive adhesive segments 122 is positioned over the surface of the carrier sheet 120, with the array having a density of at least one segment per square inch of carrier sheet 120 area and preferably approximately 25 segments per square inch. The array of segments 122 forms a layer of pressure sensitive adhesive. The support structure includes an array of support members 124, much like support members 114 of the FIG. 12A embodiment. A support member 124 is disposed over each of the adhesive segments 122. When a generic compressing sheet 94, such as a photograph, is resting on the fastening layer 118, the support members 124 initially prevent the sheet 94 from adhering to the adhesive layer. The thickness of the layer formed by adhesive segments 122 is preferably about 4 mils.

However, when a substantial compression force is applied through the compressing layer, the support members 124 are forced down into the associated adhesive segment 122. As can best be seen in FIGS. 13C and 13D, the downward displacement of the support members causes the adhesive segments 122 to expand laterally, with the gaps between the segments providing space for this expansion. The net result is that the upper surface of the support members 124 falls below the upper surface of the adhesive layer so that the compressing sheet 94 becomes secured to the adhesive layer and underlying carrier sheet 120.

Figure 14A:
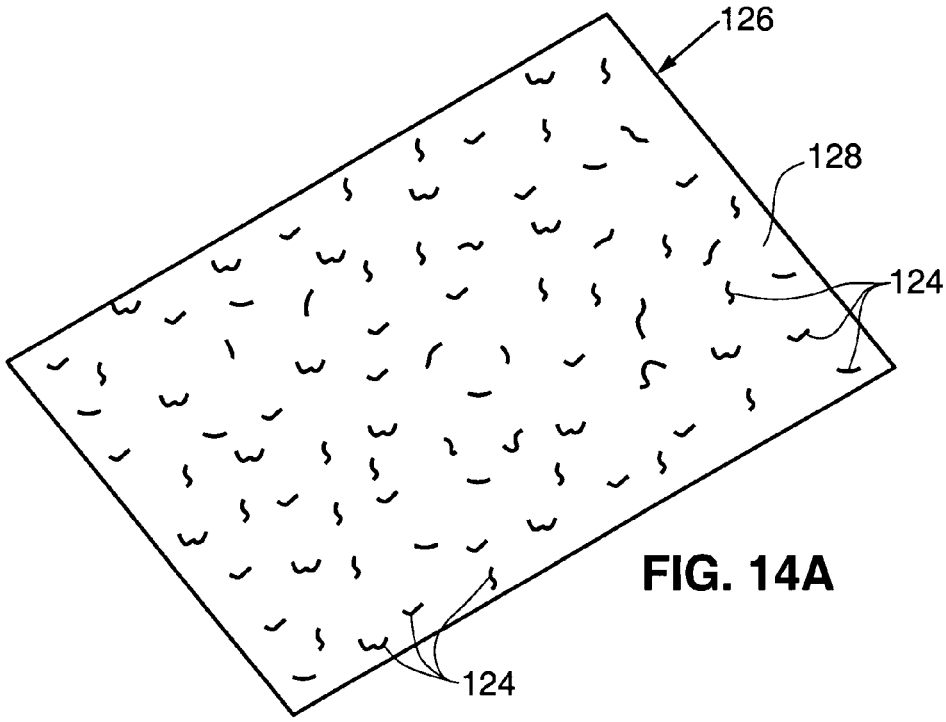
FIGS. 14A, 14B and 14C show another embodiment of a pressure sensitive adhesive based fastening layer.
Figure 14B:
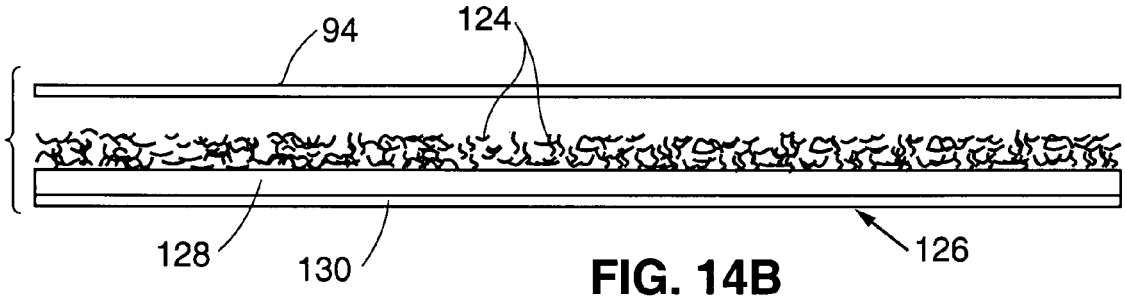
Figure 14C:
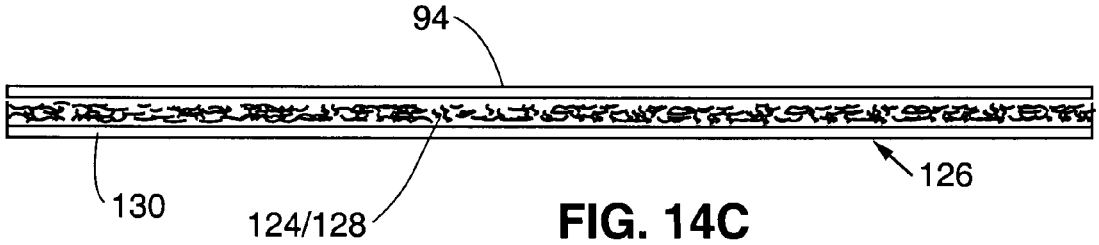

Continuing, a further alternative fastening layer 126 is shown in FIGS. 14A, 14B and 14C. As shown in FIG. 14B, the fastening layer 126 is supported on a carrier sheet 130 and a layer of pressure sensitive adhesive 128 extending over the carrier sheet. A layer of non-woven fabric 124, typically in the form of loosely coupled individual fibers, is disposed over the adhesive layer 128 to form the support structure. The fibers could also be separate fibers such as flock. Layer 124 could also comprise woven fabric that is highly porous such as cheesecloth. Depending upon the thickness of the woven fabric, it may be necessary to increase the thickness of the pressure sensitive adhesive layer 128 to about 4 mils. When a generic compressing sheet 94, such as a photograph, is resting on the support structure 124, the fibers of the structure that are present on the upper surface of adhesive layer 128 prevent the sheet from significantly adhering to the adhesive. Further details regarding the use of flock for the support structure will be provided in connection with the discussion relating to FIGS. 23A-23D.

When a substantial compression force is applied, the fibers in layer 124 are forced into the adhesive layer 128 as can be seen schematically in FIG. 14C so that a substantial portion of the adhesive is exposed so that it can contact compressing sheet 94. Thus, sheet 94 is secured to the underlying carrier sheet 130 by way of the adhesive.

Figure 15A:
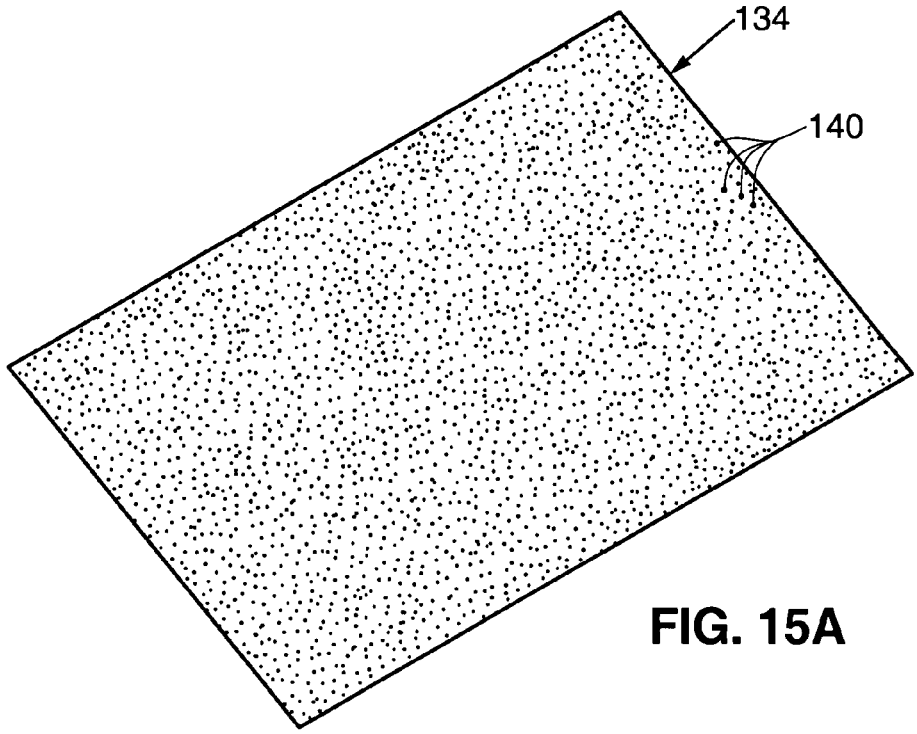
FIGS. 15A, 15B and 15C show an additional embodiment of a pressure sensitive adhesive based fastening layer.
Figure 15B:
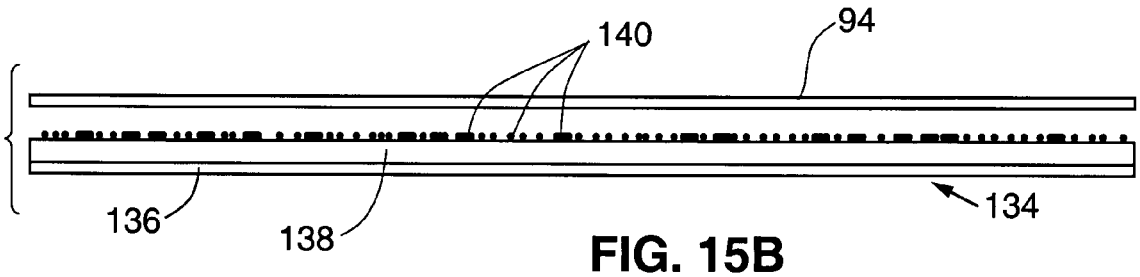
Figure 15C:
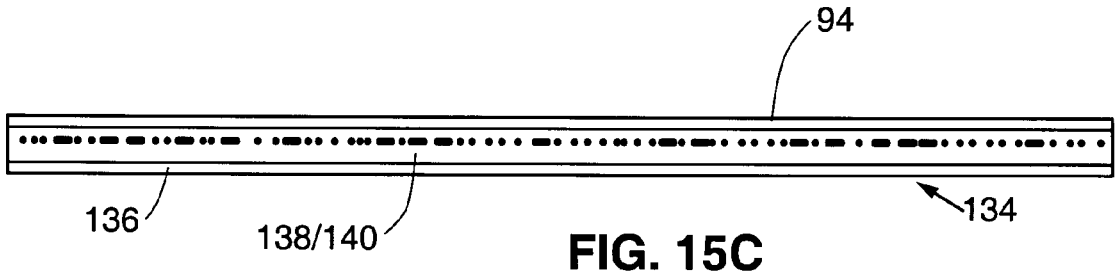

An additional fastening layer embodiment 134 is depicted in FIGS. 15A, 15B and 15C. As can best be seen in FIG. 15B, fastening layer 134 is supported on a carrier sheet 136 which supports a layer 138 of pressure sensitive adhesive. A layer 140 of granulated material such as sand, pumice, diatomaceous earth or talcum powder, functions as the support structure. The granules 140 are positioned at the upper surface of the adhesive layer 138 and prevent a generic compressing sheet 94 from contacting the adhesive layer when the compressing sheet is merely resting on the fastening layer 134. However, when a substantial compression force is applied through the compressing sheet, the granules are displaced from the upper surface and forced down into the adhesive layer as can be seen schematically in FIG. 15C. This results in a quantity of the pressure sensitive adhesive 138 being in a position to contact the compressing sheet 94 thereby securing the compressing sheet to the carrier sheet 136.

Figure 8B:
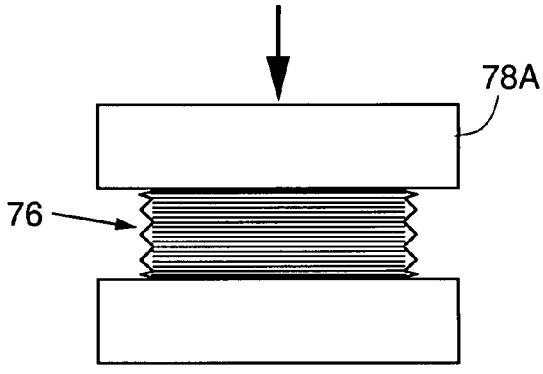
FIG. 8B shows the loaded carrier assembly of FIG. 8A during compression by the press, with such compression functioning to activate the fastening layers.

The various embodiments of pressure sensitive adhesive based fastening layers disclosed herein are particularly suitable for the present application of securing photographs to a carrier. First, it is important that the adhesion strength of the fastening layers be small at applied forces expected to be incurred during shipping of the carrier assembly 60 (FIG. 5B) and during assembly when photographs 68 are positioned on the carrier assembly and when the assembly is transferred to the press 78 (FIGS. 8A and 8B). Second, it is important that the adhesion strength be substantial after the fastening layer is activated by application of a relatively large force such as is provided by press 78.

Figure 16:
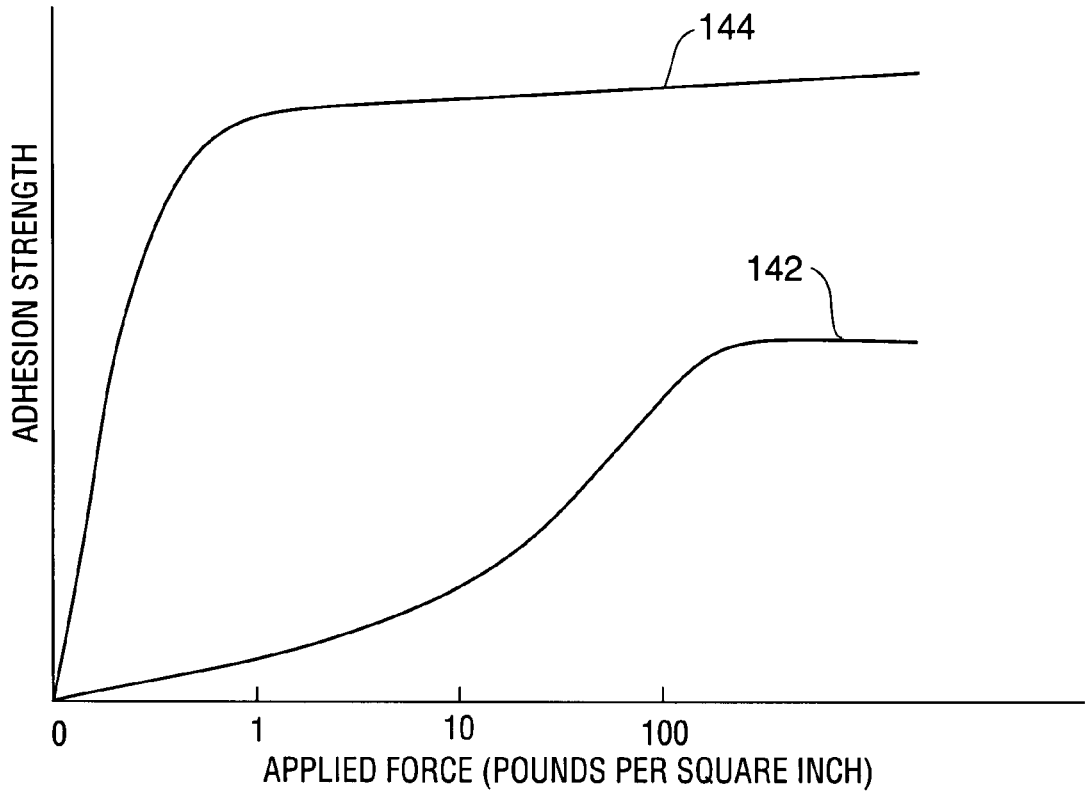
FIG. 16 is a graph depicted the relationship between adhesion strength and applied force for an exemplary pressure sensitive adhesive fastening layer and a corresponding relationship for a conventional pressure sensitive adhesive.

FIG. 16 is a graph having a curve 142 illustrating the adhesive qualities of an exemplary fastening layer 82 showing adhesion strength versus applied force per unit area. Also shown for purposes of comparison is a curve 144 for an exemplary conventional pressure sensitive adhesive. It can be seen from curve 144 that the conventional adhesive provides a relatively large amount of adhesion strength for small amounts of applied force, with the adhesion strength not increasing significantly for large amounts of applied force.

The subject fastening layer exemplary curve 142 provides an insignificant amount of adhesion strength at low applied force, with increases in force resulting in a corresponding increase in adhesion strength. It can be seen that a conventional pressure sensitive adhesive provides significantly greater adhesion strength than does the subject fastening layer after application of substantial compression forces. The final adhesion strength is sufficient for many applications, such as those described herein, so the smaller strength is not a significant shortcoming.

The shape of curve 142 can be readily adjusted depending upon the type of fastening layer and depending upon the manner in which the fastening layer is implemented. By way of example, for the embodiment of FIGS. 10A, 10B and 10C, the slope of the curve 142 will be somewhat steeper once the adhesive layer starts becoming activated as compared to the FIGS. 14A, 14B and 14C embodiment 126. That is, the rate of increase in adhesion strength is generally larger. Also, the maximum adhesion strength of fastening layer 82 can be increased by increasing the total area and number of the adhesive segments 92. The point at which fastening layer is activated, that is, the point at which the adhesion strength becomes significant can be reduced or increase by changing the number of flap members 88. The activation point can also be increased or decreased by selecting carrier sheet materials 90 of greater or lesser resiliency. Equivalent adjustments could also be made, for example, to the fastening layer 96 (FIGS. 11A, 11B and 11C) and fastening layer 108 (FIGS. 12A, 12B and 12C). As a further example, the point at which the fastening layer embodiment 126 (FIGS. 14A, 14B and 14C) and embodiment 134 (FIGS. 15A, 15B and 15C) are activated can be adjusted by altering the volume of fabric 124 or volume of granulated material 140 or the physical properties of these items along with the thickness of the respective adhesive layers 128 and 138.

The fastening layers, when used in applications for fabricating photo-albums and the like, preferably have adhesion properties such that the adhesion strength increases by at least a factor of 10 when applied compression force of 2.0 pounds per square inch is increased to 25.0 pounds per square inch. Of course, the actual compression force applied to the various embodiments of the fastening layer during use can vary depending upon various factors including the manner in which the layer is actually implemented. For example, a fastening layer having the above-noted adhesion properties may be secured using a force less than or greater than 25.0 pounds per square inch.

Figure 20:
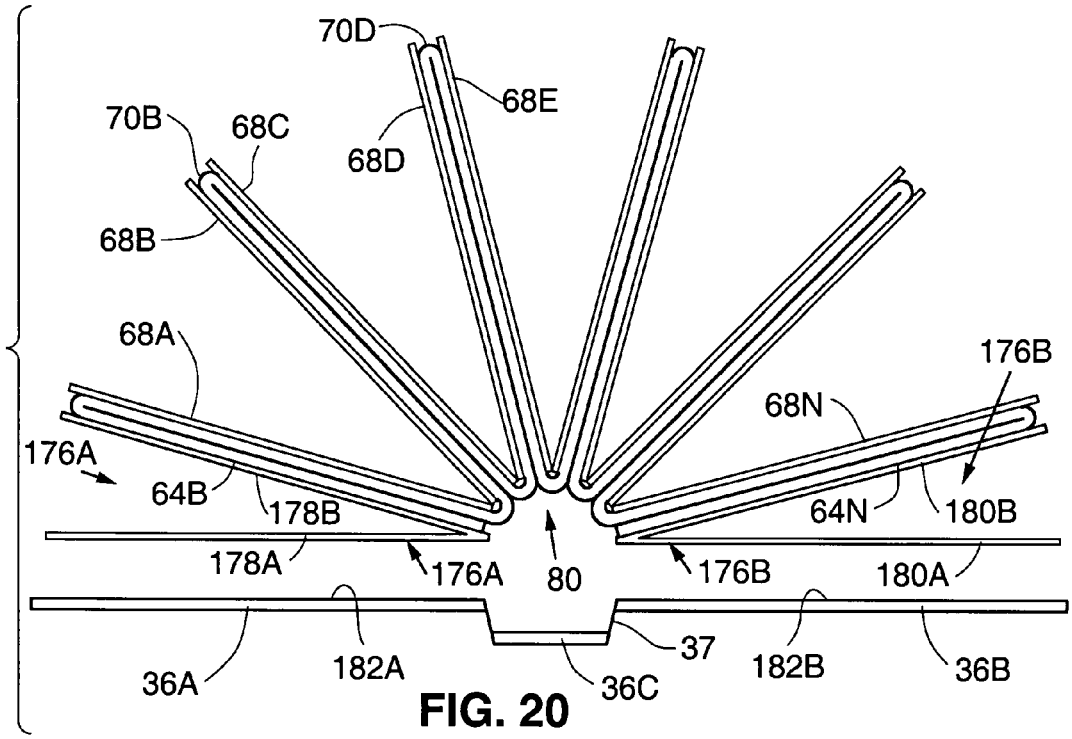
FIG. 20 is another embodiment photo-album showing the carrier assembly secured to a hardcover assembly using pressure sensitive adhesive located on the assembly.

As previously described, a hardcover assembly can be applied by way of the pressure sensitive adhesive based fastening layers, such as layer 64B of FIGS. 6A and 6B. In that event, the loaded carrier assembly 76 is installed between the front and rear hardcover sections 36A and 36B (FIG. 9) prior to placing the carrier assembly in the press 78. Alternatively, the hardcover assembly can be applied after the carrier assembly 76 has been compressed. Rather than using the fastening layers 64 for securing the hardcover assembly, the assembly is provided with layers 182A and 182B of conventional pressure sensitive adhesive being disposed on the interior sides of the front and rear covers 36A and 36B as shown in FIG. 20. Release liners (not depicted) cover the pressure sensitive adhesive prior to assembly. Such an arrangement is shown, for example, in Patent Application Publication US 2004/0067123 A1 published Apr. 8, 2004 based upon application Ser. No. 10/385,960 filed on Mar. 10, 2003, the contents of which are fully incorporated herein by reference. Preferably, a pair of end leaves 176A and 176B are provided as shown schematically in FIG. 20 which are positioned on opposite sides of the loaded carrier assembly prior to the compression step. End leave 176A is folded to provide two end sheets 178A and 178B, each of which is essentially the same size as the individual carrier sheets 66 of the assembly upon which the photographs are to be secured. Similarly, end leave 176B is folded to provide two end sheets 180A and 180B. The end leaves 176A and 176B are positioned on opposite sides of the carrier assembly with the outer carrier sheets each being provided with a fastening layer 64B which faces end sheet 178B and fastening layer 64N which faces end sheet 180B of the corresponding end leave.

With the loaded carrier assembly 76 and end leaves 176A and 176B held in position, the arrangement is placed in the plate 78B of the press so that a compressing force can be applied as previously described. The fastening layers are thus activated thereby securing the photographs and carrier sheets together and also securing leaves 178B and 180B to the assembly 76. A hardcover, including front and back cover sections 36A and 36B and spine section 36C is then applied to the bound combination as described in detail in the above referenced Patent Application Publication US 2004/0067123 A1. As previously noted, the interior surface of the front cover section 36A and the interior surface of the back cover section 36B are both covered with a layer of respective pressure sensitive adhesive 182A and 182B, with the layers of adhesive completely covered by respective release liners (not depicted). During this process of installing the assembly 76 and end leaves 176A/B in the hardcover assembly, end leave sheet 178A is attached to front cover section 36A by removing the release liner and carefully positioning assembly 76 and end leaves 176A/B, collectively the stack, over the front cover section so that sheet 178A will be completely adhered to cover section 36A by the pressure sensitive adhesive 182A. Sheet 180A is then applied to cover section 36B by removing the release liner from section 36B and folding the section over the bound assembly so that sheet 180A is contacted by the exposed pressure sensitive adhesive 182B on the inner surface of rear cover section 36B. Preferably a guide apparatus is used in this process as also disclosed in the above-noted Patent Application Publication US 2004/0067123 A1 since it is very difficult to reposition the stack to be bound once part of the stack has contacted the pressure sensitive adhesive. When completed, the bound stack is secured to the hardcover assembly only by way of the end leaves 176A and 176B.

Figure 21:
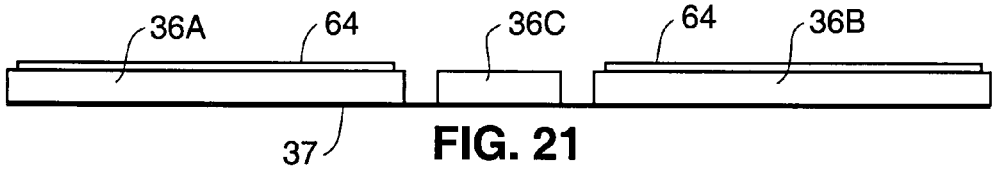
FIG. 21 is a hardcover assembly which utilizes a pair of pressure sensitive adhesive based fastening layers for securing the hardcover assembly to the carrier assembly at the same time the carrier assembly and photographs are bound.

FIG. 21 shows an alternative hardcover assembly that includes front and back relatively rigid cover sections 36A and 36B and an intermediate spine section 36C. Typically the front and back cover sections are secured together by a flexible membrane 37 such as fabric or the like. Rather than utilizing a pressure sensitive adhesive located on the interior surface of the hardcover assembly as previously described in connection with FIG. 20, the hardcover assembly is provided with two of the previously described pressure sensitive adhesive based fastening layers 64 as shown in FIG. 21. In that event, the loaded carrier assembly 76 is positioned intermediate end leaves 176A/B. That arrangement is then accurately positioned over the fastening layer 64 on the front cover section 36A so that sheet 178A contacts the fastening layer. This step is greatly simplified since the assembler does not have to contend with aggressive pressure sensitive adhesive during the positioning. Next, the rear cover section 36B is folded over onto the stack so that the fastening layer 64 on section 36B will contact sheet 180A. Again, accurate positioning is not difficult since the fastening layer is not tacky at this stage. Thus, the need for the previously described guide apparatus is reduced or even eliminated. The entire assembly is then positioned in the press so that all of the fastening layers will be activated thereby securing the various components together, including securing the end sheet 178A to cover section 36A and securing end sheet 180A to cover section 36B. The hardcover assembly of FIG. 21 could also be used for covering other bound stacks assembled using conventional binding methods rather than the disclosed pressure sensitive adhesive based fastening layers.

Figure 22:
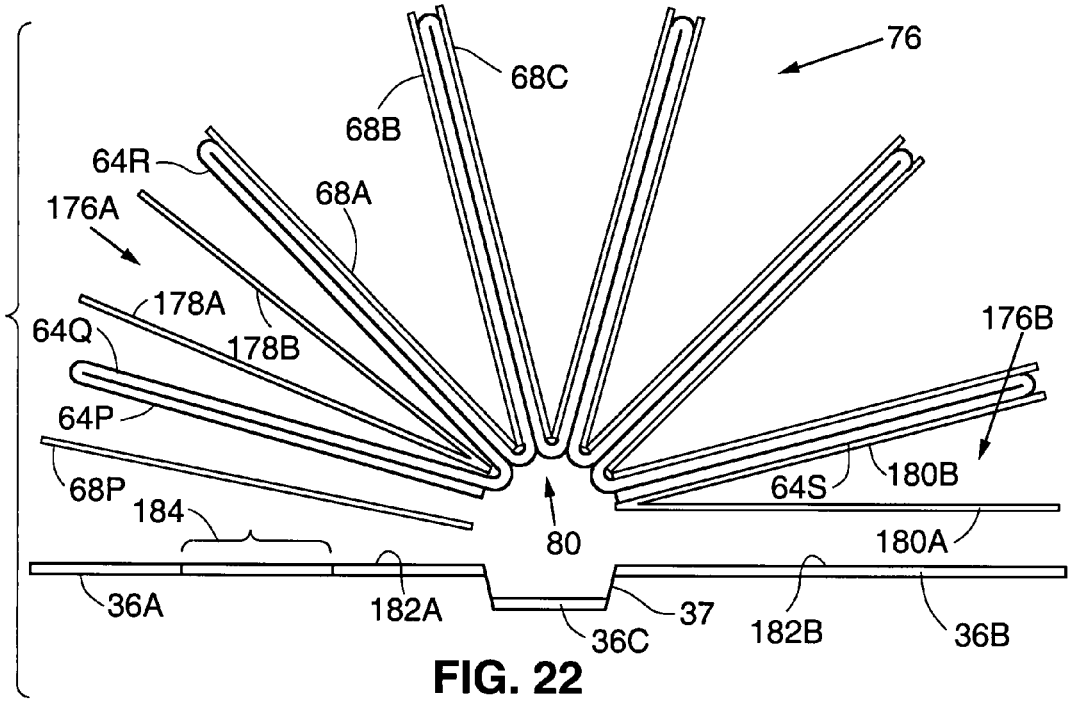
FIG. 22 is another embodiment photo-album showing the carrier assembly secured to a hardcover assembly using pressure sensitive adhesive located on the assembly, with the front cover section including a window for viewing a portion of a photograph mounted on the inner surface of the front cover section.

It is also possible to produce a photograph album or the like where a photograph can be viewed through an opening or window formed in the front cover section of the hardcover assembly. As can be seen in FIG. 22, a hardcover assembly is provided with a window 184 in the front cover section 36A. A photograph 68P is provided, with the photograph having an image sized and positioned so that it can be viewed through window 184 when the photograph is correctly positioned over the inner surface of the front cover section 36A. The carrier assembly includes one page formed by two folded carrier sheets, with each sheet having an associated fastening layer 64P and 64Q. As shown in FIG. 22, an end leave 176A is positioned intermediate to adjacent pages of the carrier assembly so that sheet 178A is facing fastening layer 64Q and so that sheet 178B is facing another fastening layer 64R of an adjacent carrier assembly page. A second end leave 176B is positioned intermediate the front cover section 36B and a page of the carrier assembly supporting a fastening layer 64S.

The loaded carrier assembly 76, end leaves 176A and 176B, together with photograph 68P, are arranged relative to one another as shown in FIG. 22 and manually forced together so that the arrangement can be placed in a press as shown in FIGS. 8A/B and compressed so that all of the fastening layers 64 are activated. Among other things, this action allows the photograph 68P to be displayed while being secured to end leave 178A by way of fastening layers 64P and 64Q. In addition, fastening layer 64S functions to secure end sheet 180B to the last page of the bound carrier assembly. The bound arrangement is then positioned in the hardcover assembly in the same manner as previously described in connection with FIG. 20. Thus, the image surface of photograph 68P is secured to the inner surface of front cover assembly 36A by the pressure sensitive adhesive layer 182A, except where the viewing window 184 is located. In addition, end leave sheet 178A is secured to the rear of photograph 68P by way of fastening layers 64P and 64Q. Similarly, end leave sheet 180A is secured to the inner surface of back cover section 36B by way of pressure sensitive adhesive 182B. It would also be possible to substitute the carrier assembly of FIG. 22 utilizing pressure sensitive adhesive layers 182A and 182B with fastening layers as previously described in connection with FIG. 21. In that event, the entire arrangement, including the hardcover assembly, is placed in the press for activating all of the fastening layers.

Figure 23A:
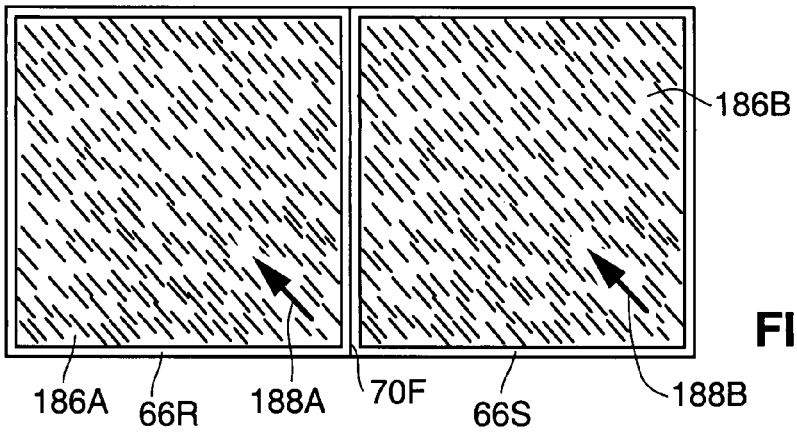
FIGS. 23A, 23B, 23C and 23D shows a pair of pressure activated based fastening layer incorporating fibers such as flock, with the fibers arranged on opposing fastening layers to reduce adhesion between the fastening layers.
Figure 23B:
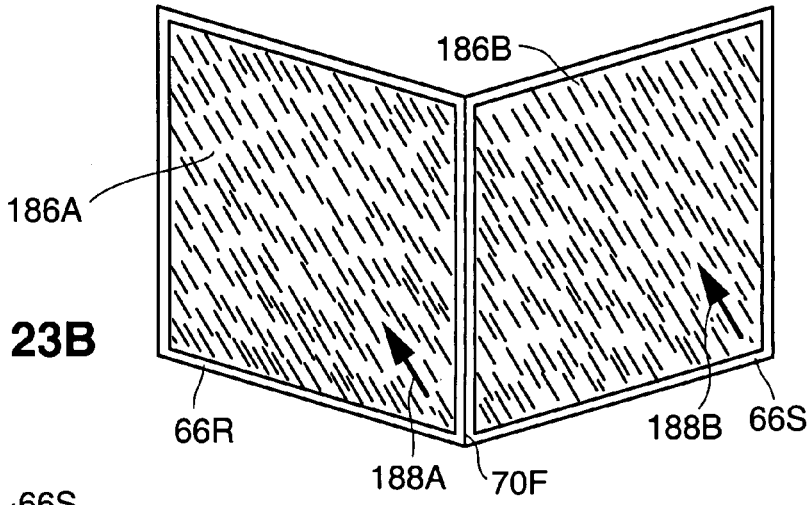
Figure 23C:
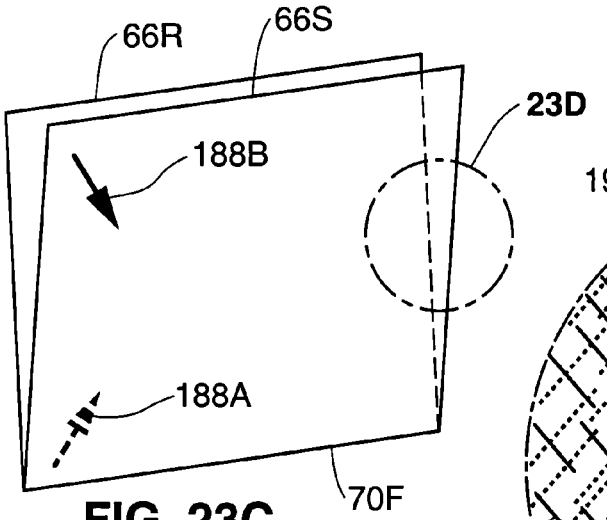
Figure 23D:
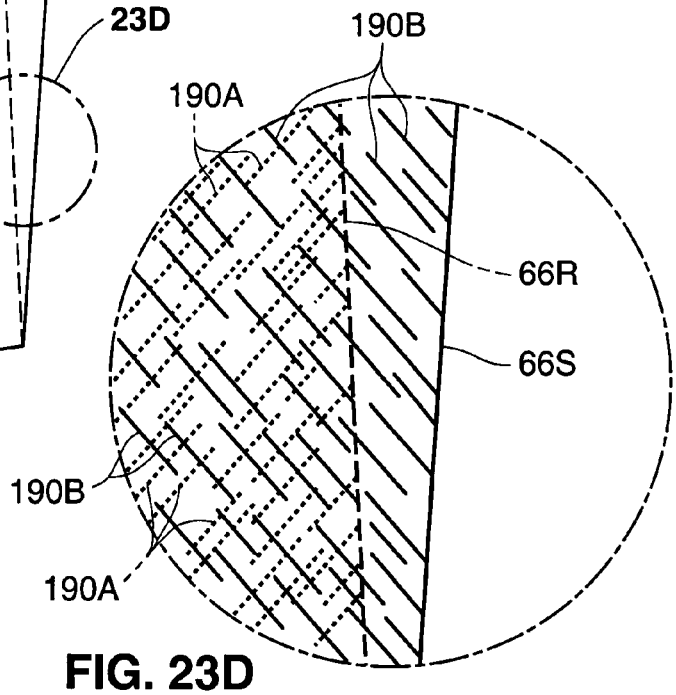

As previously described in connection with the fastening layer embodiment 126 of FIGS. 14A/B/C, fibers can be used to form the support structure of the fastening layer. Flock has been found to be particularly suitable for this application. Flock in the form of precision cut monofilament micro-fibers of cotton, rayon or acrylic can be used. The diameter of the individual flock strands is only a few thousandths of a centimeter, with the length typically ranging from 0.25 to 5 mm. A quantity of flock is evenly applied to the underlying layer of pressure sensitive adhesive so that part of the flock is attached to the layer. A soft brush can then be used to remove the excess flock. FIGS. 23A/B/C/D depict an exemplary pair of carrier sheets 66R and 66S connected by a fold 70F, with this arrangement forming all or part of a carrier assembly. Each carrier sheet 66R and 66S is provided with a respective fastening layer 186A and 186B which includes flock for the support structure, with the length of the fibers being greatly exaggerated for purposes of clarity. As previously explained, the fastening layers are implemented to provide little adhesion strength at low pressures so that, for example, a photograph can easily be positioned and repositioned. However, when the carrier arrangement is folded as shown in FIG. 23C for shipping and the like there may be some tendency for the layers 186A and 186B to adhere to one another. This tendency can be reduced by applying the flock to the adjacent carrier sheets such as sheets 66R and 66S so that fibers are ideally aligned at right angles to one another. The orientation of the flock fibers can be controlled by using fibers covered with a conductive coating and then depositing the fibers on the pressure sensitive adhesive layer using well known electrostatic application processes. As a result, the deposited fibers all tend to be positioned standing upright. Next, the upright fibers are then by brushing the fibers with a brush in a single direction. For reasons that will be explained, the directions should be other than parallel to fold 70F. By way of example, the fibers of fastening layer 186B are brushed in a direction indicated by arrow 188B, with the direction being about 45 degrees towards the fold 70F. This tends to orient the fibers in the direction of the arrow 188B. Similarly, the upright fibers of fastening layer 186A are brushed in the direction of arrow 188A which is a direction of about 45 degrees away from fold 70F. When the carrier sheets 66R and 66S are folded over one another as shown in FIG. 23C as they would be, by way of example, in shipping, the fibers tend to be normal to one another as represented in FIG. 23D. The fibers 190B from fastening layer 186B, which are represented by relatively thick lines, are generally at right angles to fibers 190A from fastening layer 186A, with the fibers 190A being represented by relatively thin lines. Any deviation of fiber orientation from random will provide some benefit, with the orientation preferably being between 70 and 90 degrees for a majority of the fibers on the opposing fastening layers. If the fibers are brushed in a direction parallel to the fold 70F, it can be seen that fibers of the two sheets will remain parallel, something not desired, when the sheets are folded.

Figure 24A:
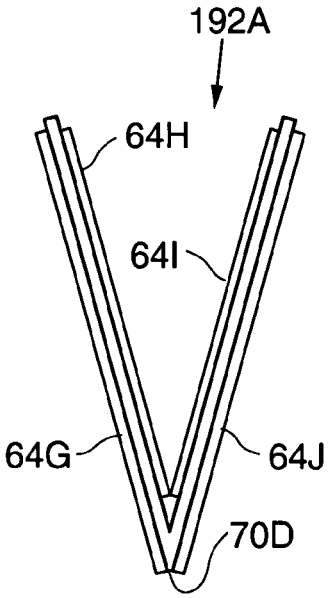
FIGS. 24A, 24B and 24C show on embodiment of a two carrier sheet carrier arrangement having four fastening layers.
Figure 24B:
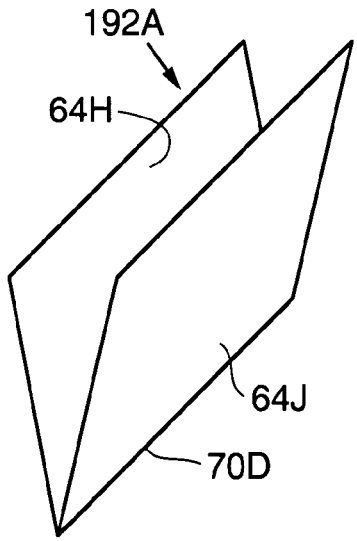
Figure 24C:
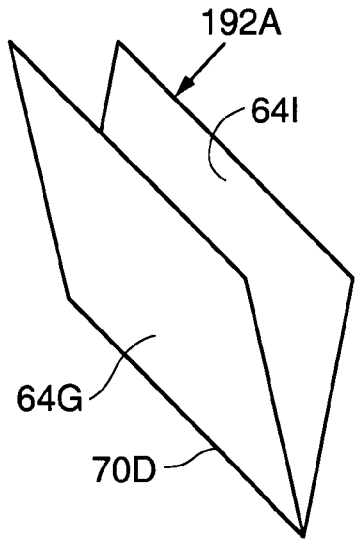
Figure 25A:
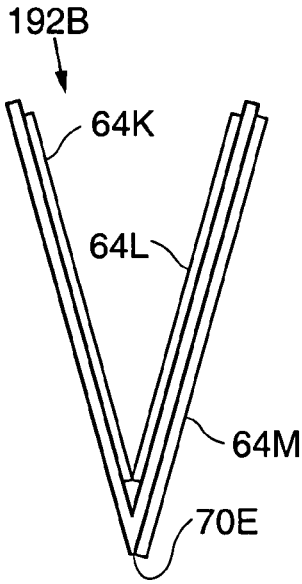
FIGS. 25A, 25B and 25C show on embodiment of a two carrier sheet carrier sheet arrangement having three fastening layers.
Figure 25B:
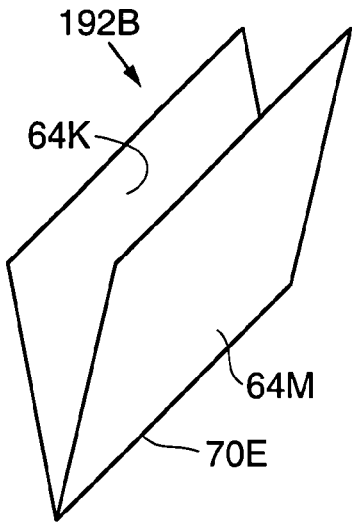
Figure 25C:
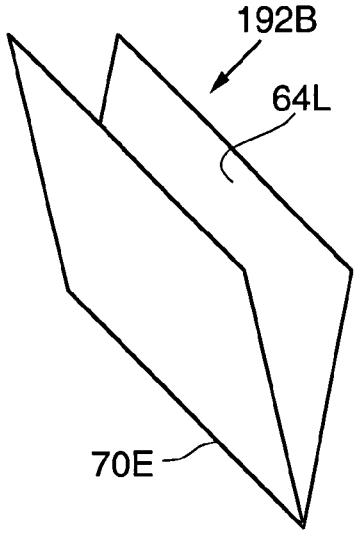
Figure 26A:
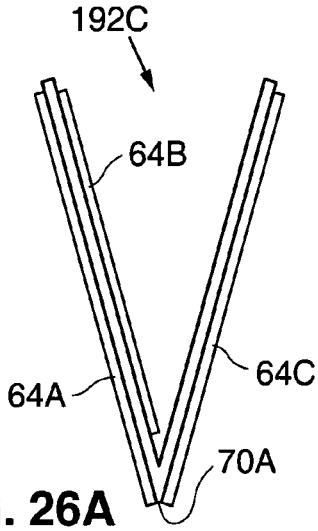
FIGS. 26A, 26B and 26C show on embodiment of a two carrier sheet carrier sheet arrangement also having three fastening layers, with one the layer location differing from that of FIGS. 25A, 25B and 25C.
Figure 26B:
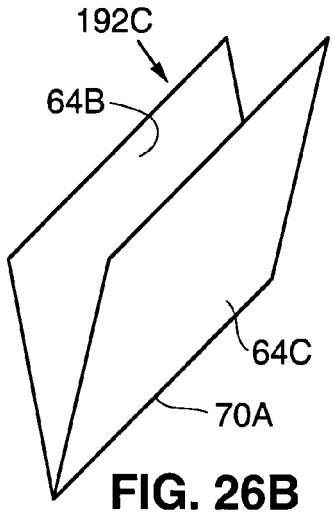
Figure 26C:
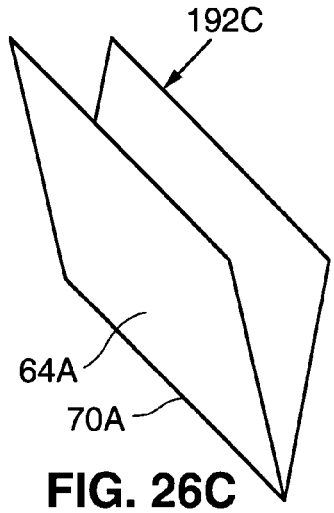
Figure 27A:
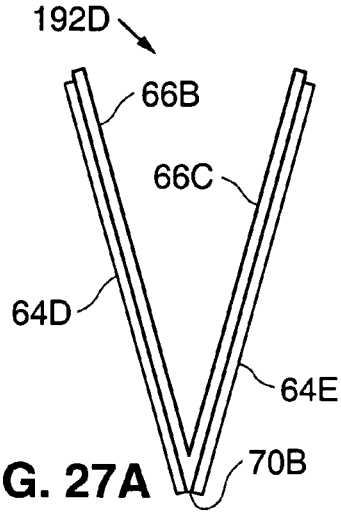
FIGS. 27A, 27B and 27C show on embodiment of a two carrier sheet carrier sheet arrangement having two fastening layers.
Figure 27B:
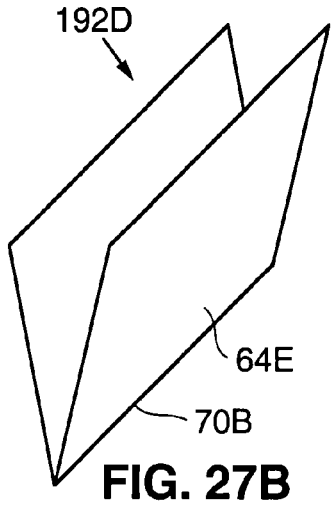
Figure 27C:
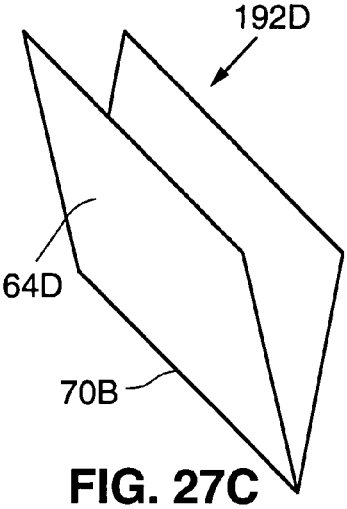
Figure 28A:
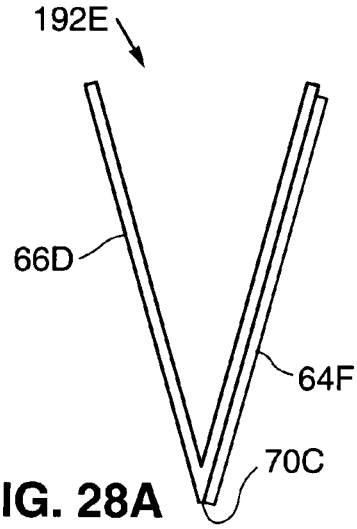
FIGS. 28A, 28B and 28C show on embodiment of a two carrier sheet carrier sheet arrangement having one fastening layer.
Figure 28B:
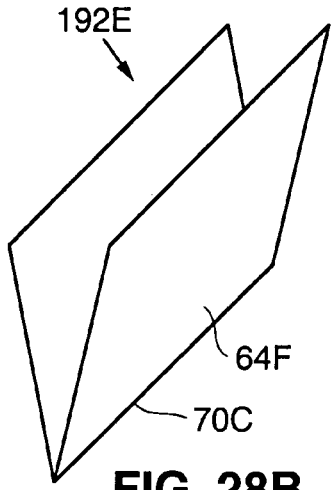
Figure 28C:
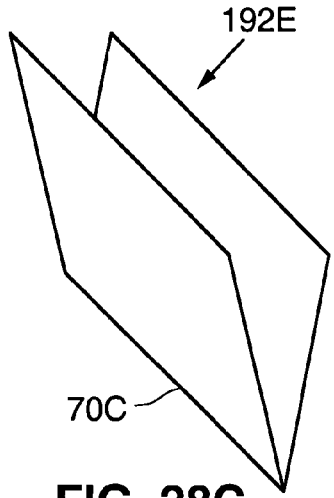
Figure 29A:
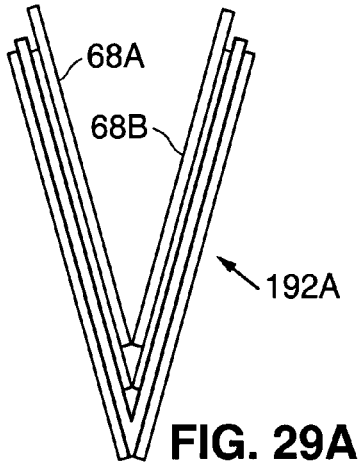
FIGS. 29A, 29B and 29C show the various embodiments of a two carrier sheet carrier sheet arrangement with photographs positioned on the inner fastening layers.
Figure 29B:
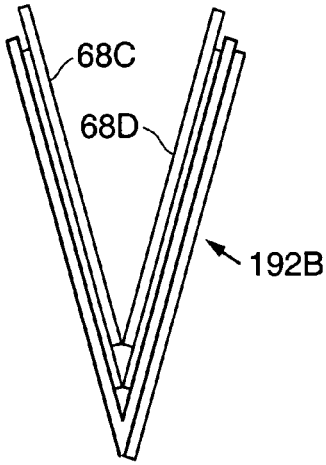
Figure 29C:
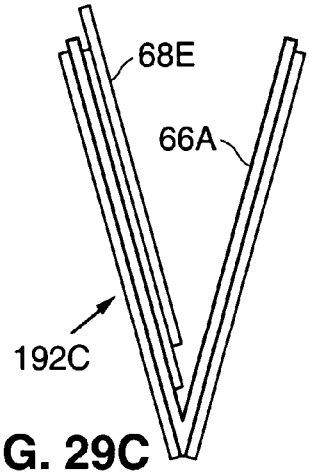
Figure 29D:
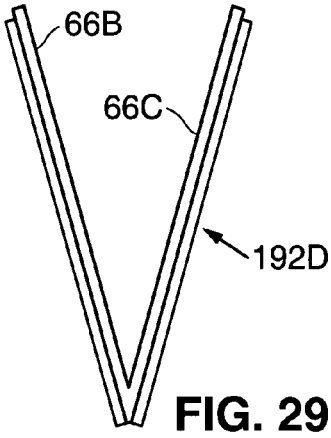
Figure 29E:
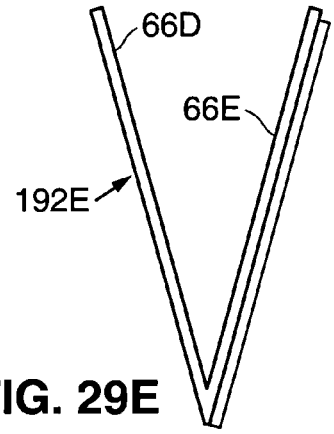

Although a carrier assembly 60 having more than two sheets 66, such as FIG. 5B, has been described, it would be possible to create an album using a collection of one or more carrier assemblies, with each of the assemblies including only two sheets separated by a fold. As will be seen, two sheet carrier assemblies can be implemented in differing manners so that a wide variety of photo-albums can be created. FIGS. 24, 25, 26, 27 and 28 depict five different two sheet carrier assemblies which can be combined to create different photo albums. FIGS. 24A, 24B and 24C show a carrier arrangement 192A having two sheets (not designated) separated by a fold 70D. Carrier sheet arrangement 192A includes fastening layers 64G, 64H, 64I and 64J located on respective sides of both sheets. FIGS. 25A, 25B and 25C show a carrier arrangement 192B having two sheets (not designated) separated by a fold 70E. Carrier sheet arrangement 192B includes fastening layers 64K on the inner side of one sheet and layers 64L and 64M on both sides of the other sheet. Continuing, FIGS. 26A, 26B and 26C show a carrier sheet arrangement 192C having a fastening layer 64A and 64B on both sides of one sheet and a layer 64C on the outer side of another sheet. FIGS. 27A, 27B and 27C show a carrier sheet arrangement 192D having fastening layers 64D and 64E located on the outer side of both sheets. Finally, a carrier sheet arrangement 192E is shown in FIGS. 28A, 28B and 28C where only a single fastening layer 64F is used, with the fastening layer being disposed on the outer side of one of the sheets.

Figure 30:
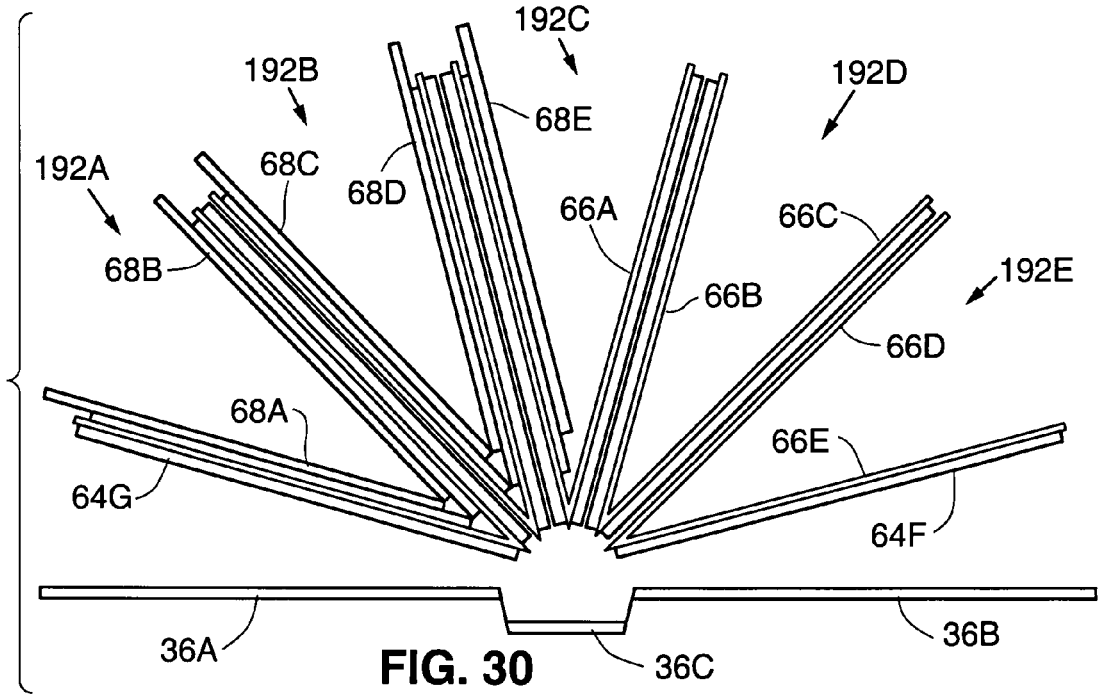
FIG. 30 is an photograph album formed from the various two carrier sheet carrier sheet arrangements of FIGS. 29A, 29B, 29C, 29D and 29E illustrating an exemplary application for the carrier sheet arrangements.

FIGS. 29A, 29B, 29C, 29D and 29E illustrate one example for using the five previously described carrier assemblies 192A/B/C/D/E. Photographs 68A and 68B are shown positioned on the inner fastening layers of assembly 192A, photographs 68C and 68D are shown positioned on the inner fastening layers of assembly 192B, photograph 68E is shown positioned on the one inner fastening layer of assembly 192C, with assemblies 192D and 192E having no photographs. The loaded carrier assemblies of FIGS. 29A-29E are positioned relative to one another as shown. The carrier assembly arrangement is then positioned within a hardcover assembly as shown in FIG. 30, with this assembly having no adhesive on the inner surfaces of the front and back cover sections 36A and 36B. The loaded carrier assembly and hardcover assembly are then positioned in a press and compressed thereby activating the various fastening layers. Thus, layer 64G will secure the assembly to the inner surface of the front cover section 36A and fastening layer 64F will secure the assembly to the inner surface of the back cover section 36B. The fastening layers intermediate the five carrier assemblies 192A-192F function to secure the assemblies together, with the fastening layers located adjacent the photographs functioning to secure the photographs to the carrier assembly. The bound album of FIG. 30 is intended to illustrate one application for the five carrier assemblies, with the particular arrangement shown not being that useful for an actual photo-album. Whatever combination or order is used, it is important that at least one fastening layer be located between adjacent ones of the carrier assemblies to that the adjacent assemblies will be secured together when the layers are activated by application of pressure. Also, it is sometimes preferable to connect adjacent carrier assemblies using only a single fastening layer. For example, sheets 66A and 66B of carrier assemblies 192C and 192D are shown connected together by redundant fastening layers whereas sheets 66C and 66D of assemblies 192D and 192E are connected to by only a single fastening layer. Thus, the page formed by sheets 66C and 66D may, depending upon the manner in which the fastening layers are implemented, provide an thinner and perhaps more attractive page than do sheets 66A and 66B. Carrier assembly 192E, having only one fastening layer, can be used where appropriate to eliminate redundant fastening layers.

Carrier assembly 192A is one of the most useful of the assemblies since one or more can function to display two, four, six or more photographs as desired. When assembly 192C is added, an attractive album having an odd number of photographs can be created and to allow a photograph to be displayed opposite a blank page. One or two assemblies 192C can also be used where it is desired that all photographs be located on album pages rather than being secured directly to the front or rear cover section. For example, assembly 192A is shown in FIG. 30 attaching photograph 68A directly to the inner surface of front cover section 36A. Assembly 192C could be used instead of assembly 192A so that carrier sheet 66A (FIG. 29C), which does not support a photograph, is secured to the front cover section 36A. In that event, assembly 192A or 192B could be used to support additional photographs. Assembly 192C can also being used in connection with the back cover section 36B if a photograph is not to be secured to the inner surface of that section.

Although FIG. 30 shows a hardcover assembly which relies upon the fastening layers 64G and 64G of the carrier assembly for securing the assembly to the hardcover, it would also be possible to utilize a conventional hardcover assembly such as described in connection with FIG. 20 which uses pressure sensitive adhesive layers covered by release liners together with end leaves 176A and 176B. In that event, assembly 192E could be used to replace one or both of these end leaves.

The characteristics of the fastening layers disclosed herein also enable the assembler to produce a proof of the album. The loaded carrier assembly 76 and end sheets if appropriate and hardcover assembly if appropriate, are placed in press 78A/78B, with the press applying a substantially reduced force of only a few pounds per square inch. The components of the loaded carrier assembly are weakly secured together so that the assembly can be fully examined without upsetting the assembly. If adjustments need to be made, the assembly can be adjusted, including repositioning of one or more photographs without damaging the photographs. Once the proof is satisfactory, the assembly can then be returned to the press for a normal compression cycle of typically 50 to 100 pounds per square inch as previously described.

It should also be noted that those fastening layers 64 where the support structure is implemented using part of the underlying carrier sheet 66 are somewhat more restricted in their application as compared to those fastening layers where the support structure is separate from the carrier sheet. By way of example, the FIG. 6A loaded carrier assembly 76 includes a carrier sheet 66B having a fastening layer 64D on one side and another fastening layer 64C located on the other side. If, for example, the fastening layer embodiment 82 of FIGS. 10A, 10B and 10C were utilized in this application, it can be seen that care must be taken in locating the hinged flap members 88 in the common carrier sheet 64 (or 64B of FIG. 6C) so that one group of flap members functions to provide the support structure function for fastening layer 64C and another group of flap members function to provide support structure for fastening layer 64D. Clearly, the same region of the carrier sheet for providing a flap member for layer 64C cannot be used to provide a flap member for layer 64D. In order to avoid this potential problem, it may be preferable to avoid using this embodiment of fastening layer for layer 64D (and 64E) and other similarly situated fastening layers by manufacturing the carrier assembly with the back sides of carrier sheets 66B and 66C adhered together using a conventional adhesive. This manufacturing option was previously described. In that case, fastening layer 64D is not needed so that fastening layer 64C can be implemented using embodiment 82 or embodiments 96 (FIGS. 11A, 11B and 11C) or embodiment 108 (FIGS. 12A, 12B and 12C). This issue is not present for those fastening layer embodiments that utilize a support structure independent of the underlying carrier sheet such as embodiment 118 (FIGS. 13A, 13B, 13C and 13D), embodiment 126 (FIGS. 14A, 14B and 14C) and embodiment 134 (FIGS. 15A, 15B and 15C).

Figure 17A:
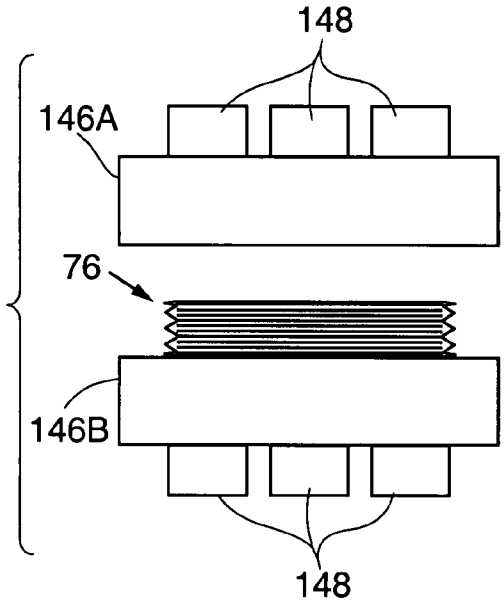
FIG. 17A shows a loaded carrier assembly utilizing a heat activated fastening layer, with the loaded carrier positioned on the bottom plate of a heated press prior to activation.
Figure 17B:
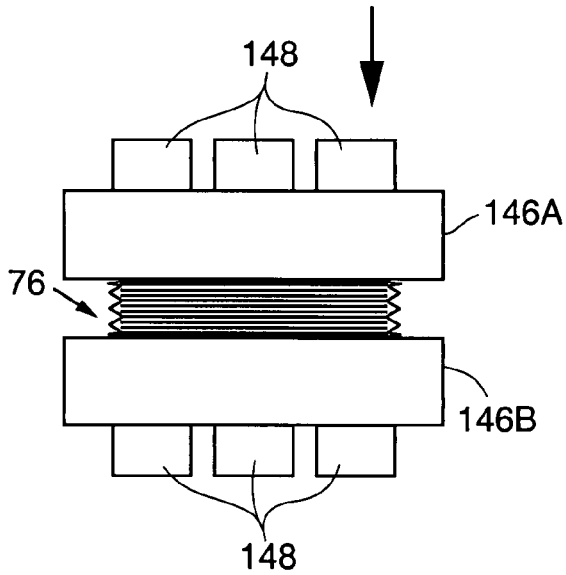
FIG. 17B shows the loaded carrier assembly of FIG. 17A being activated by the heated press as the press applies heat to the assembly along with pressure.

As previously described, the fastening layers 64 (FIG. 5B) could also be implemented using heat activated adhesives rather than being based upon pressure sensitive adhesive. A heat activated adhesive marketed by National Starch and Chemical under the name Cool Bind 1300 has been found satisfactory for this application. The carrier assembly of FIG. 5B is loaded with photographs 68 in the same manner as previously described in connection with FIG. 7. Once the photographs have been loaded, the loaded carrier assembly 76 is positioned in a heated press as shown in FIG. 17A. This is done without the hardcover assembly. The press is closed over the assembly 76 as shown in FIG. 17B, with both the top and bottom plates 146A and 146B being provided with heating elements. The press is closed on the assembly so as to provide both heat and pressure. A pressure of approximately 5 pounds per square inch has been found to be suitable. A temperature sensor could be positioned in the center of the assembly 76 so that it can be determined when the interior of the assembly 76 has reached the desired temperature to ensure that the heat activated adhesive fastening layers have all been activated. The maximum temperature of the heating elements is limited so as to not damage the photographs being bound. A maximum temperature of approximately 200 degrees Fahrenheit has been found suitable for most applications. Pressure continues to be applied once the heating elements have been turned off to ensure a strong and uniform bond is made between all of the photographs and the underlying carrier sheets as the assembly cools. The press is provided with an array of cooling fans 148 located on both the upper and lower plates of the press to shorten the cooling time. Once the assembly has cooled, a hardcover can then be applied in the conventional manner as previously described.

Figure 18:
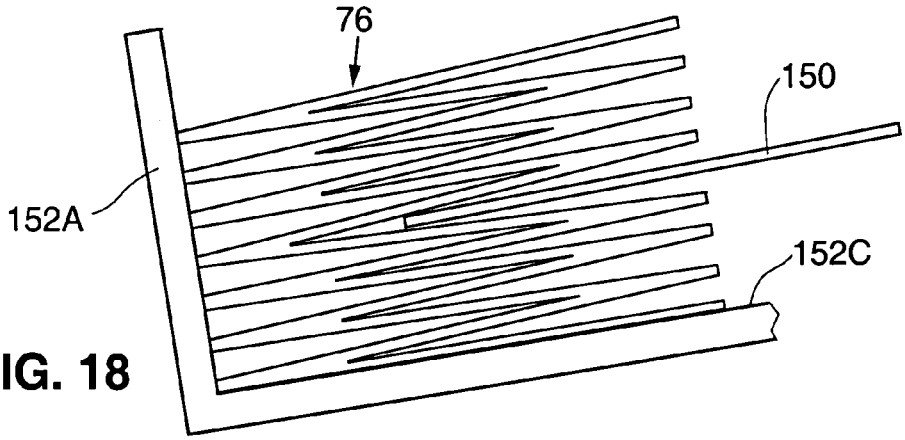
FIG. 18 is a side partial view of a loaded carrier assembly as in FIG. 17A, with the bottom plate of the heated press including sidewalls for supporting the carrier assembly and with a thin electrical heating element disposed in the center of the assembly to provide supplemental heat to the assembly.

It is desirable to heat and cool the loaded carrier assembly quickly to as to shorten the assembly cycle time. As previously noted, cooling is facilitated by way of various cooling fans 148. It is also possible to shorten the heating time by adding one or more thin heating elements 150 as shown in FIGS. 18 and 19 that are inserted in the center (if only one is used) or in equally spaced locations if multiple heating elements are used, of the assembly 76. The thin heating elements 150, which can be implemented using conventional printed circuit board technology, are capable of withstanding the compression forces applied by the heating press. Heating elements utilizing etched foil technology manufactured by Minco have been found suitable for this application. Heating element 150 is preferably implemented to produce about 5.5 watts of power per square inch.

Preferably the bottom plate 146B, represented schematically in FIGS. 17A and 17B, includes an angled support surface 152C upon which the loaded carrier assembly 76 is positioned. Sidewalls 152A and 152B, which are perpendicular to one another, function to locate the assembly 76 on the bottom plate. Support surface 152C is preferably inclined downward with respect to a level plane represented by line 154 towards a sidewall 152B so that the assembly naturally rests against the sidewall. Surface 152C further is also preferably inclined downward so that assembly 76 rests against that sidewall. Line 154 represents a level plane, with the surface 152C being tilted with respect to the level plane 154 by an angle X (FIG. 19B) so that the assembly will tend to rest against sidewall 152A due to gravity. Similarly surface 152C is tilted down by an angle Y (FIG. 19C) with respect to the level plane so that the assembly will also tend to rest against sidewall 152B. Angles X and Y are both at least 5 degrees, with angle X preferably being approximately 20 degrees and angle Y preferably being approximately 30 degrees. Sidewalls 152A and 152B are perpendicular to one another, with angle X being measured along a line normal to sidewall 152A and with angle Y being measured along a line normal to sidewall 152B. Note that the upper plate 146A moves in an angled direction normal to surface 152C, with the compressing surface of the upper plate being parallel to the tilted lower compressing surface 152C. A cutout 156 is formed in sidewall 152B to accommodate the heater contact 150A or contacts if multiple heaters are used. An electrical cable (not depicted) is connected to connector 150A to provide power to the heater.

Figure 19A:
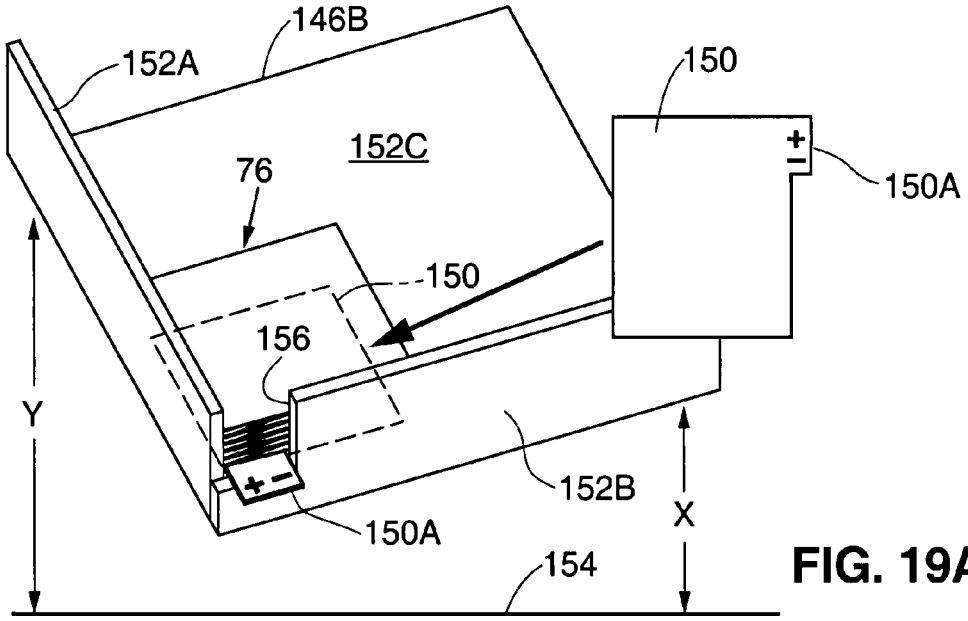
FIG. 19A is a perspective view of the lower press base showing a loaded carrier positioned on the base of the heated press with a contact of the thin heating element extending through a cut-out formed in a sidewall of the base, with FIGS. 19B and 19C schematically illustrating the tilt angle of the lower press base relative to a level plane.
Figure 19B:
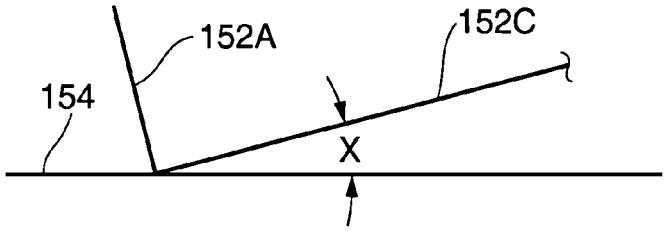
Figure 19C:
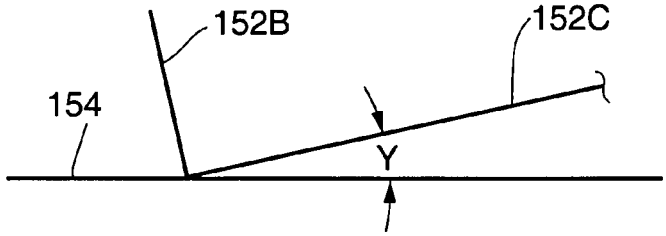

It should be noted that the press for the pressure activated adhesive based fastening layers of FIGS. 8A and 8B could also employ a lower plate utilizing an angled support surface as described in connection with FIGS. 19A, B and C so that the assembly will be registered against sidewalls 152A and 152B by the force of gravity. Again, the upper plate 78A would move in a direction normal to the tilted support surface of the lower plate with the upper plate compressing surface remaining parallel to the tilted lower plate surface. An exemplary embodiment of such a press is depicted in FIGS. 31A-31C.

Figure 31A:
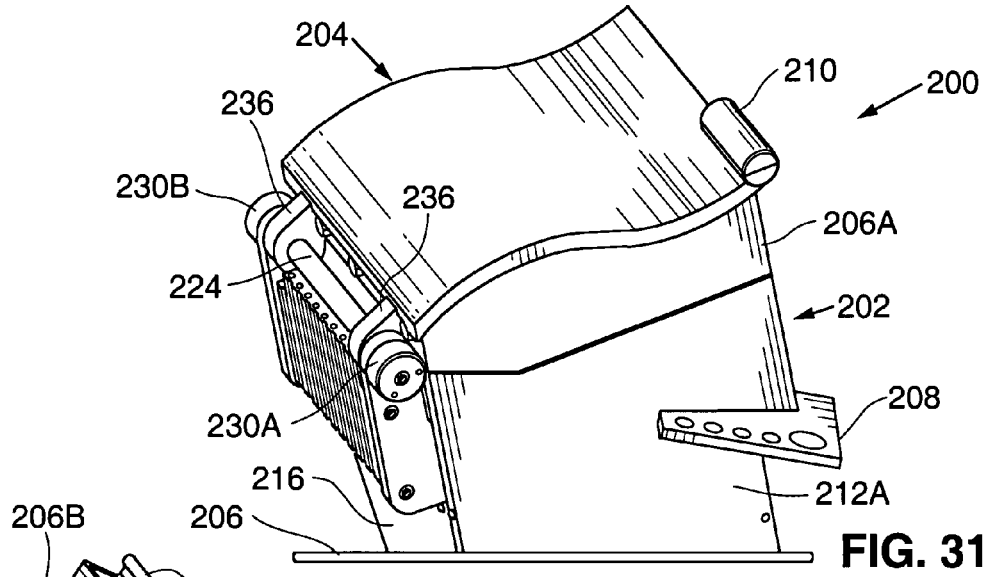
FIG. 31A is a front view of one embodiment of the subject press for carrier assemblies using pressure activated adhesive fastening layers, with the top assembly of the press shown in a closed position.
Figure 31B:
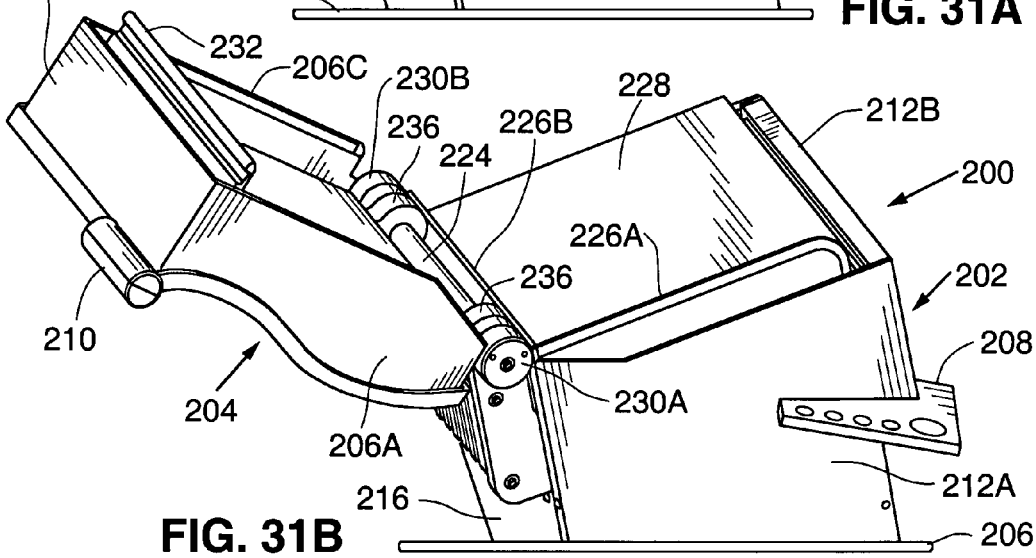
FIG. 31B is another front view of the press of FIG. 31A, with the top assembly shown in an open position.
Figure 31C:
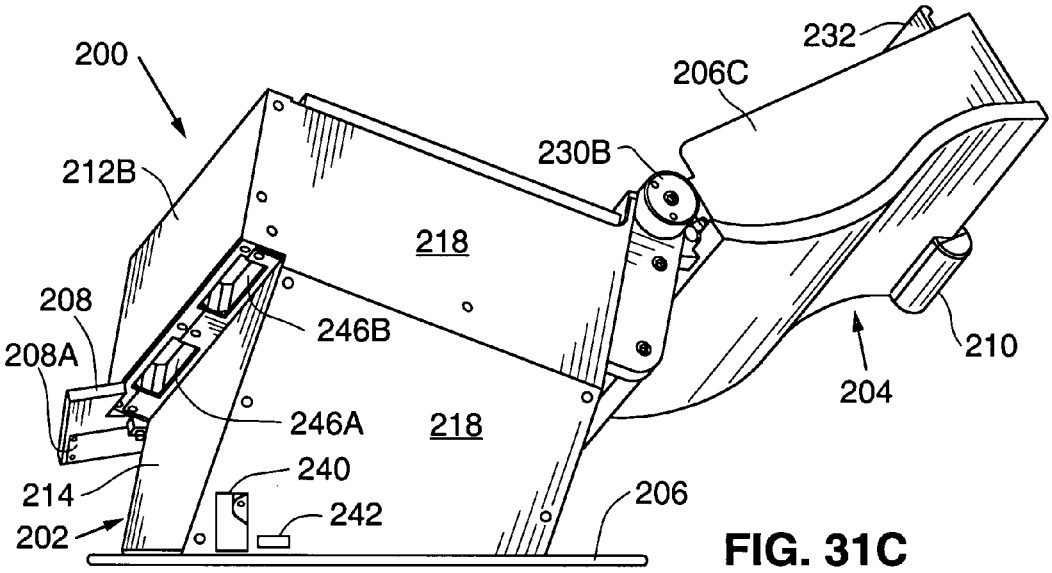
FIG. 31C is a rear view of the subject press of FIGS. 31A and 31B with the top assembly shown in the opened position.
Figure 33:
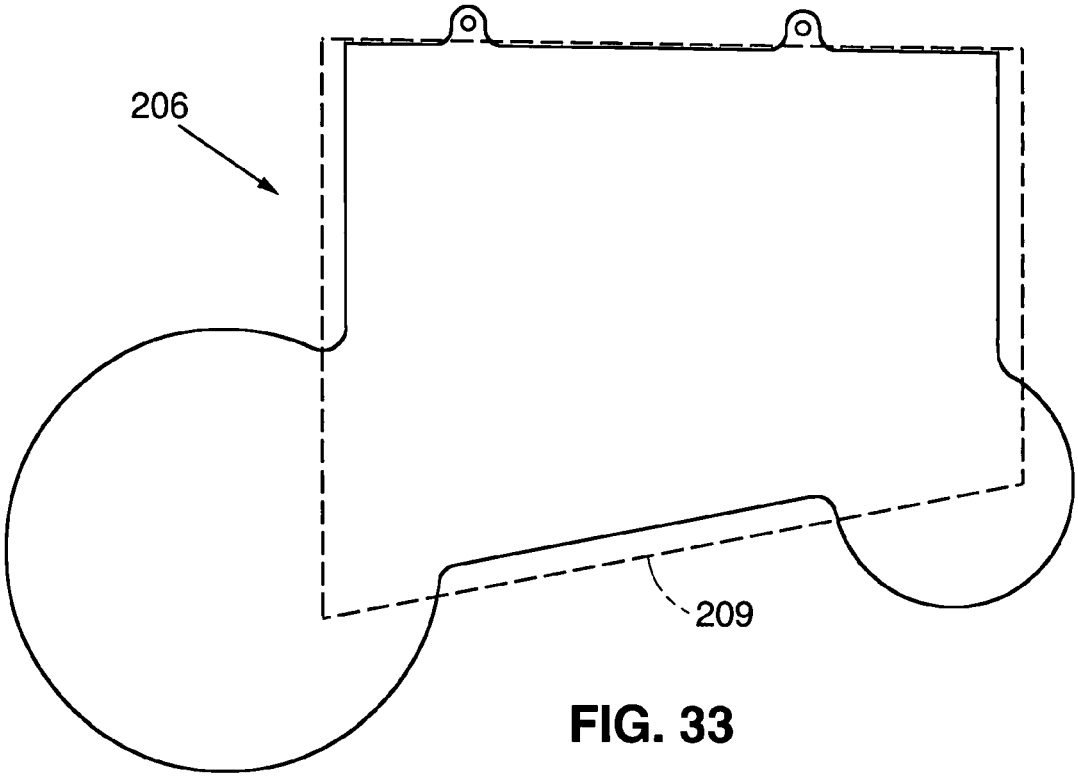
FIG. 33 is a plan view of the base plate of the subject press.

The alternative embodiment press is shown in FIG. 31A in a position as viewed by a user of the press. As can be seen, the press is implemented in an attractive stylized yet highly functional configuration. The appearance of the press is important because it is anticipated that it will be situated in desktop locations where it can be seen by business customers. The entire press is tilted in two directions so that when a loaded carrier assembly is placed in the press, the assembly will gravitate both towards the user and to the user's left in the same manner as previously described in connection with FIGS. 18 and 19A-19C. A relatively large base plate 206, depicted alone in FIG. 33, assists in preventing the tilted press from tipping over. The footprint 209 of the press on the base plate 206 is depicted in the figure. As also shown in FIGS. 31B and 31A, the press includes a base unit 202 and a top assembly 204 mounted to the based unit by a hinge shaft 224 on the based unit which extends through a pair of cover lugs 236 on the top assembly. A handle 210 is provided for moving the top assembly 204 between the open and closed positions. Although not depicted, counter springs are included which encircle hinge shaft 224 to provide a counter force in closing the heavy top assembly 204, which may typically weigh about 45 pounds. This eliminates user fatigue and enhances safety by preventing the top assembly from slamming shut should the user inadvertently prematurely release the handle 210 while lowering the top assembly. Axle caps 230A and 230B are secured at opposite ends of the hinge shaft 224, each of which includes a friction bearing to provide a small amount of friction for smooth closing and opening of the top assembly.

Figure 32:
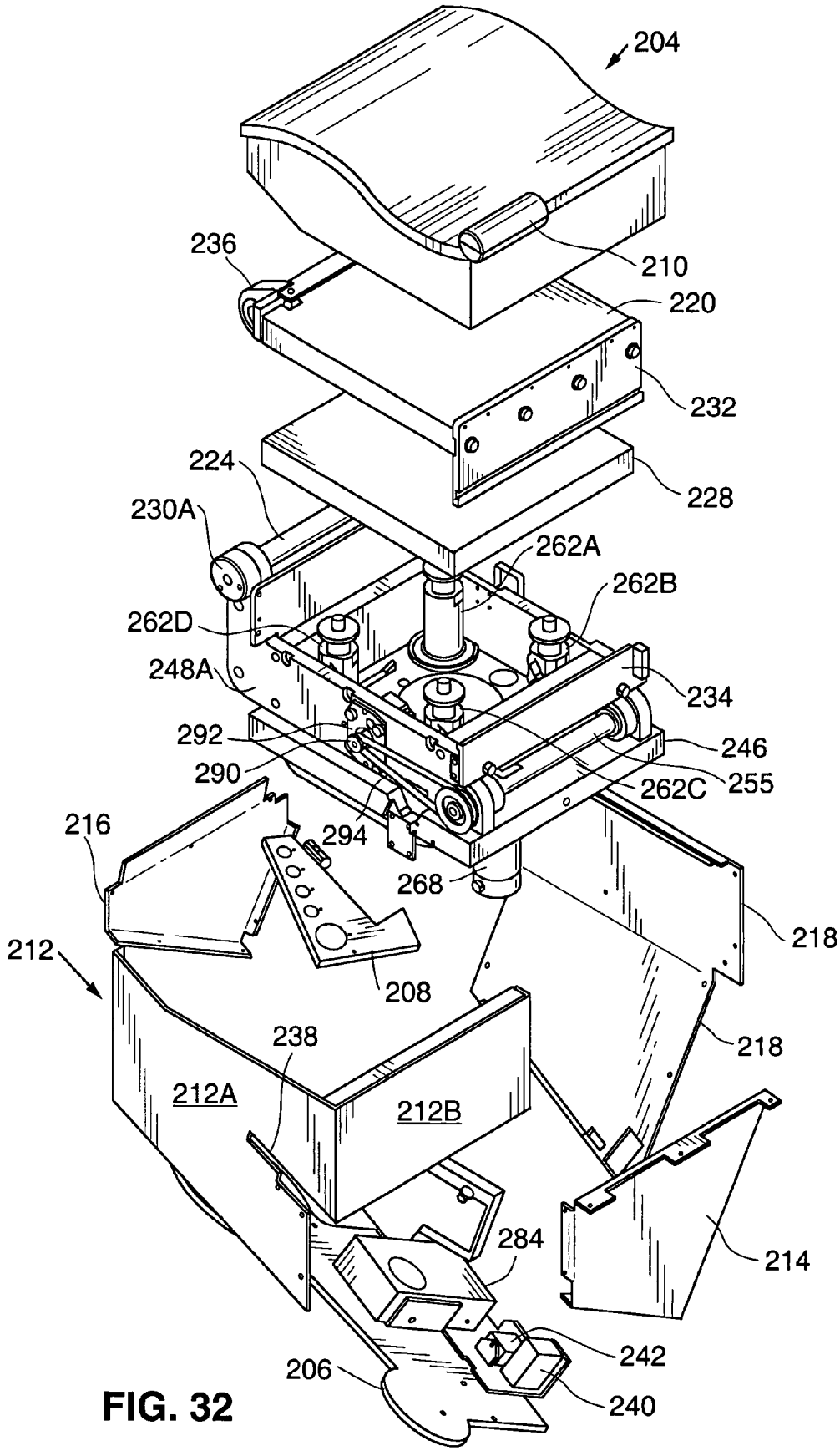
FIG. 32 is an exploded view of the subject press, showing the details of the various press components.

The top 204 assembly is provided with skirts 206A, 206B and 206C to prevent inadvertent placement of a hand or finger inside the press when the top assembly is in a closed position. The skirts also enhance the appearance of the top assembly. As can best be seen in FIGS. 31B and 32, the top assembly includes a heavy top plate 220 which is preferably milled from 6061-T6 aluminum and is typically one and one-half inches thick. Top plate 220 is 13×13 inches to accommodate a loaded carrier assembly for up to a 12×12 inch book, although this may vary if other book sizes are to be accommodated. The two cover lugs 236 (only one can be seen) are secured at an end of the top plate 220, with the lugs having openings to receive the hinge shaft 224. An upper latch 232 is attached to the top plate 220 at an end opposite that of the cover lugs 236 for engaging a lower latch to be described. A stylized control panel 208 having various control buttons is located on the press to provide easy access to the user.

Figure 34:
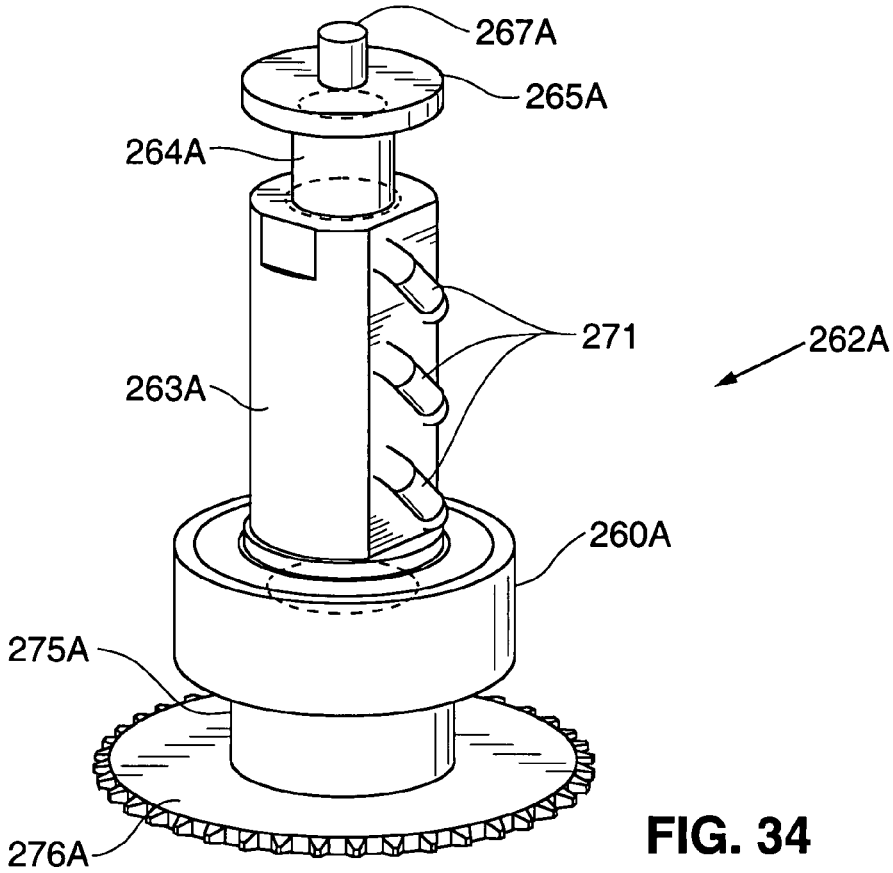
FIG. 34 is a perspective view one of the ball screws used in the subject press and related components.

The base unit 202 includes a heavy piston plate 228 that is driven by four ball screws (FIG. 32) 262A, 262B, 262C and 262D, as will be described below. The ball screws 262 drive the piston plate 228 in a direction towards the top plate 220 when the top assembly 204 is closed so as to compress a loaded carrier assembly and in an opposite direction away from the top plate. FIG. 34 shows some of the details of one of the ball screws 262A. A ball screw manufactured by Rockford Ball Screw and sold under the designation Model R40B has been found satisfactory for this application. As is well known, a ball screw includes a threaded screw shaft, such as shaft 264 (threads not depicted), which extends through a threaded ball nut 263A. Several ball bearings, called load balls, are disposed intermediated the nut and screw shaft to provide reduced rolling friction. One or more closed paths 271 on the ball nut are provided to enable recirculation of the load balls. The ball nut 263A is the rotating component of the ball screw, with the screw shaft being axially displaced by this rotation. The screw shafts of the ball screws of the present application are one inch in diameter, with the shaft traversing ¼ inch per revolution and with the travel being two inches. A thrust bearing 260A is provided for rotatably mounting the ball screw 262A in a bearing plate to be described. A hub 275A secured to the ball nut 263A extends through the opening in the bearing plate and is secured to a chain sprocket 276A located on the opposite side of the plate. A screw cap 265A is secured to an upper end of the non-rotating screw shaft 264A, with the screw cap including a pin 267A which is received by an opening formed in the lower side of the piston plate 228.

Figure 36A:
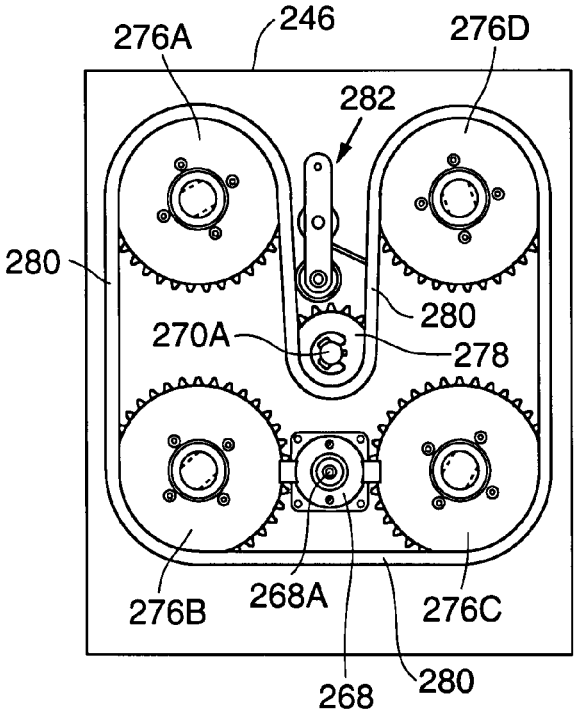
FIG. 36A is a bottom view of the bearing plate showing some of the drive components.
Figure 36B:
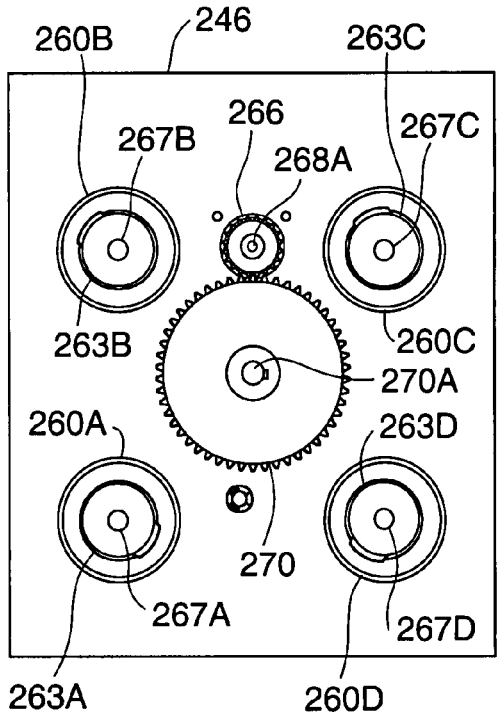
FIG. 36B is a plan view of the bearing plate showing other drive components.
Figure 37:
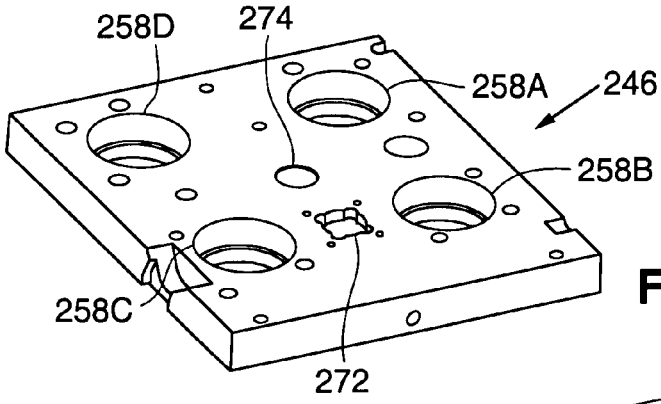
FIG. 37 is a perspective view of the bearing plate without the drive components.
Figure 38:
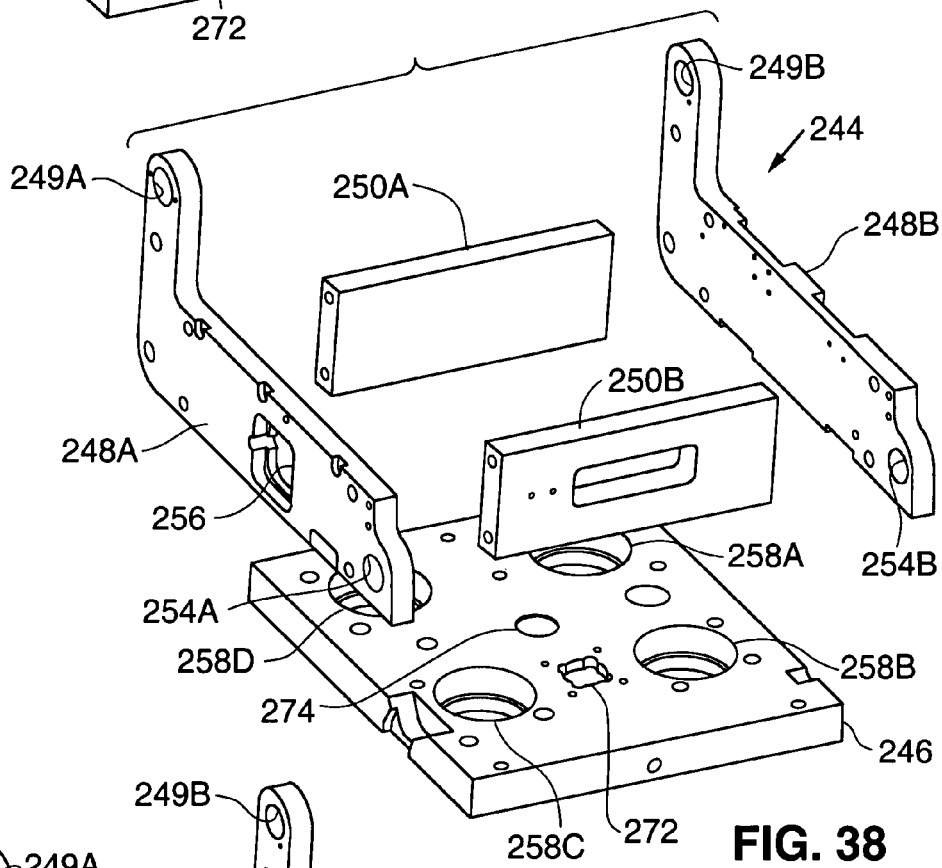
FIG. 38 is an expanded view of the press chassis showing the base plate, the two side members and the two cross members.
Figure 39:
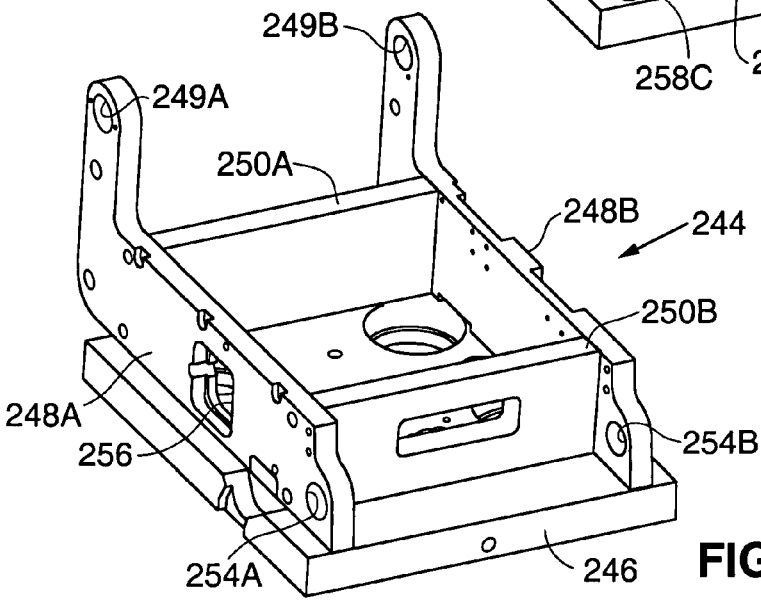
FIG. 39 is a perspective view of the press chassis showing the various chassis components of FIG. 38 arranged in an assembled position.

FIG. 36A depicts a lower side of the bearing plate 246, with FIG. 36B showing the upper side. FIG. 37 shows the bearing plate 246 prior to the installation of the four ball screws 262A, 262B, 262C and 262D and other components. As can be seen in FIGS. 38 and 39, the bearing plate 246 forms part of a heavy duty chassis made up the bearing plate, two side members 248A and 248B and two cross members 250A and 250B. The chassis, including the bearing plate 246 are tilted with respect to the base plate 206 so that the bearing plate 246 is generally parallel with the piston plate 228. All of the chassis components are milled from 6061-T6 aluminum, with the bearing plate 246 being one and one-half inches thick, the side members 248A and 248B being one inch thick and the cross members 250A and 250B being ¾ of an inch thick. Side members 248A and 248B are each provided with a hinge shaft opening 249A and 249B for receiving the hinge shaft 224. Four openings 258A, 258B, 258C and 258D are milled in the bearing plate 246 to accommodate the four thrust bearings 260A, 260B, 260C and 260D. Connecting hubs 275A, 275B, 275C and 275D connect the respective four ball nuts 263 to respective chain sprockets 276A, 276B, 276C and 276D on the opposite side of the bearing plate 246 as shown in FIG. 36A. A chain 280 passes around each of the four sprockets 276 and a drive sprocket 278. A chain tightener 282 is provided for maintaining an appropriate chain tension.

Figure 35:
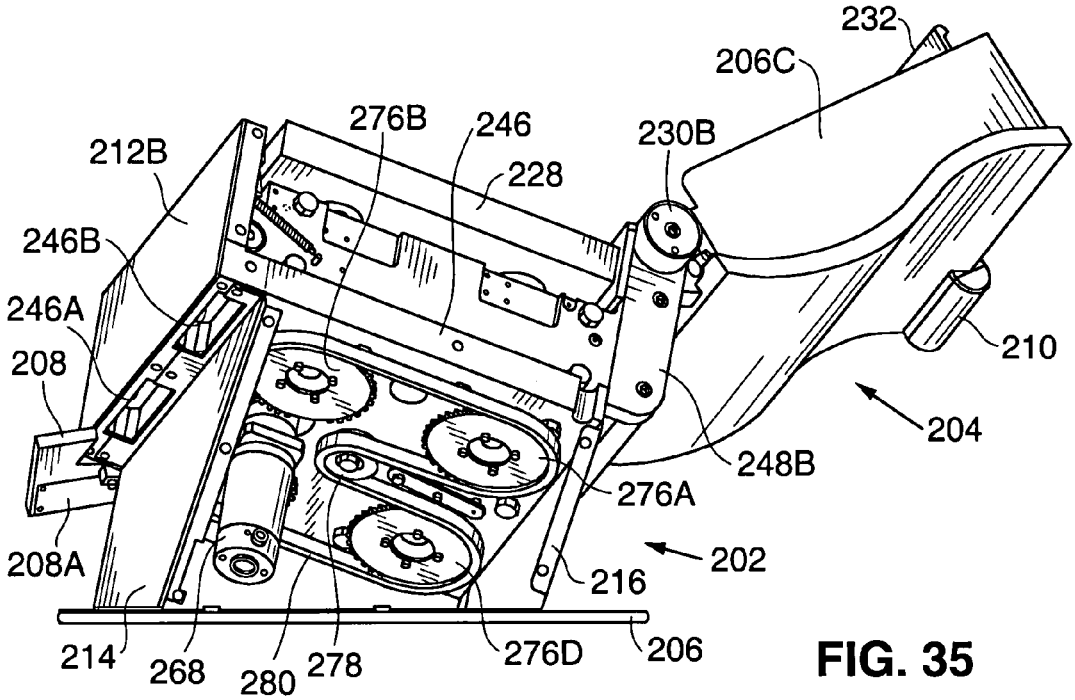
FIG. 35 is a rear view of the subject press, with the rear panel removed to show part of the underside of the bearing plate which supports the drive components.

A main motor 268 is also mounted on the underside of the bearing plate 246 of FIG. 36A in opening 272, with a portion of the motor, including the drive shaft 268A, extending through the opening. Motor 268 is required to deliver continuous stall torque and may be either a brush or a brushless DC motor. A brush DC motor rated 24VDC, approximately 120 W and having a rated output torque of 450 oz-inches has been found satisfactory for the present application. The motor includes an integral two stage planetary gear head having a ratio of 19:1. The gearbox has cut gears to minimize noise. Such a motor is made by Dynetic Systems of Elk River, Minn. USA under the designation MS2225-24. As can be seen in FIG. 35, motor 268 extends a substantial distance down from the bearing plate 246. A drive gear 226 located on the upper side of the bearing plate 246, as shown in FIG. 36B, is driven by motor shaft 268A, with gear 226 driving a larger gear 270 also disposed on the upper side of the plate. A gear shaft 270A is driven by gear 270, with the shaft driving chain sprocket 278 on the upper side of the plate.

Figure 41:
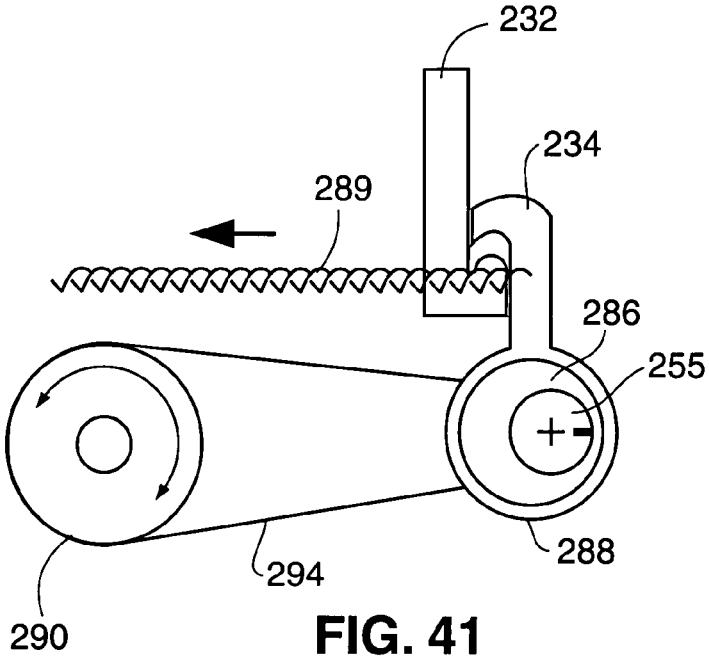
FIG. 41 is a schematic representation of the upper and lower latches together with the latch drive motor.
Figure 42:
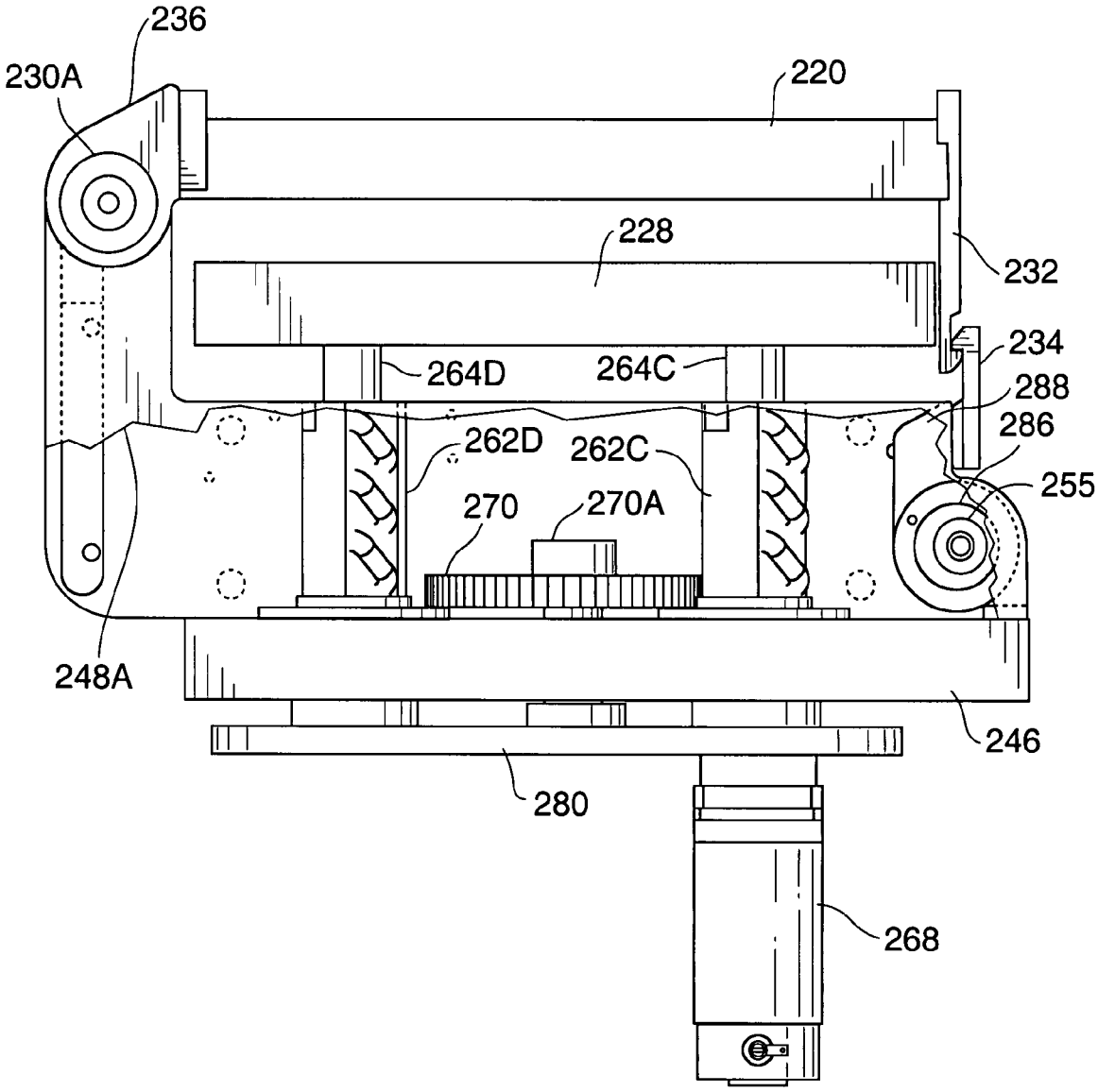
FIG. 42 is a partial cutaway rear view of the subject press with part of the lower latch control mechanism depicted.

As can best be seen in the partial cutaway view of FIG. 42, the piston plate is disposed over and is parallel to the bearing plate 246, although this parallel relationship can be adjusted as will be described. The piston plate 228 is driven towards and away from the top plate 220. As previously noted, one edge of the top plate is pivotally mounted on hinge shaft 224 (FIG. 32), with the opposite edge of the top plate carrying an upper latch 232 which can engage a movable lower latch 234 mounted the lower chassis 244. The lower latch 234 is secured to a rotating latch shaft 255 having respective shaft ends that are positioned in openings 254A and 254B (FIG. 39) of the respective side members 248A and 248B of the chassis. The lower latch 234 is secured to the latch shaft 255 by way of a pair of eccentric bearings mounted in the two openings 254A and 254B. A latch drive stepper motor mounted on side member 248A in an opening 256 drives shaft 255 by way of a drive pulley 290 and drive belt 294 as shown schematically in FIG. 41. A 2-phase stepper motor sold by Oriental Motor U.S.A. Corp. under the designation VEXTA PK266-02A which provides 1.8 degrees per step has been found suitable for the present application. The eccentric bearing 286 rotates with the latch shaft 255, with the outer bearing surface moving with respect to the latch member support structure 288.

Figures 40A, 40B, 40C, 40D:
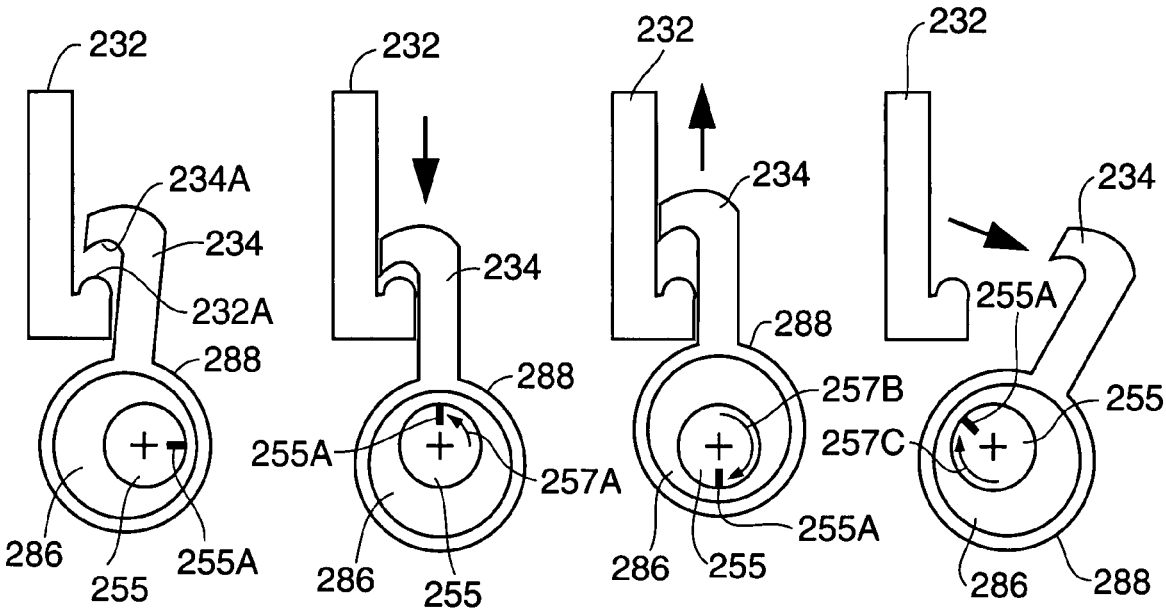
FIGS. 40A-40D depict-a sequence of schematic representations of the upper and lower latches during a binding operation.

During a binding sequence, the latch motor 292 rotates the latch shaft through various angles so as to control the vertical position of the lower latch 234. FIG. 40A shows the latch shaft in a first position as indicated by the rotation indicator mark 255A added for purposes of illustration only. In this first or neutral position, which is also shown in FIG. 41, the shaft is at a 3 o'clock rotational position. This rotational position translates into a given vertical location of the lower latch member 234 relative to chassis 244. Note that the rotational position of shaft 255 also has a small effect on the lateral location of the lower latch 234 as shown in FIG. 40A in a somewhat exaggerated fashion and not shown in FIG. 41. A spring 289 shown in FIG. 41 normally pulls the lower latch towards the upper latch 232 so that upward movement of the upper latch 232 will cause the two latches to engage one another. This upward movement occurs when the piston plate 228 is driven upwards by the ball screws, with upward pressure being applied to the top plate 220, with this upward pressure causing the upper latch 232 carried by the top plate to move up slightly as the top plate pivots slightly about the hinge shaft 224. This upward movement will cause the convex surface 232A of the upper latch to engage the concave surface 234A of the lower latch.

Figure 43A:
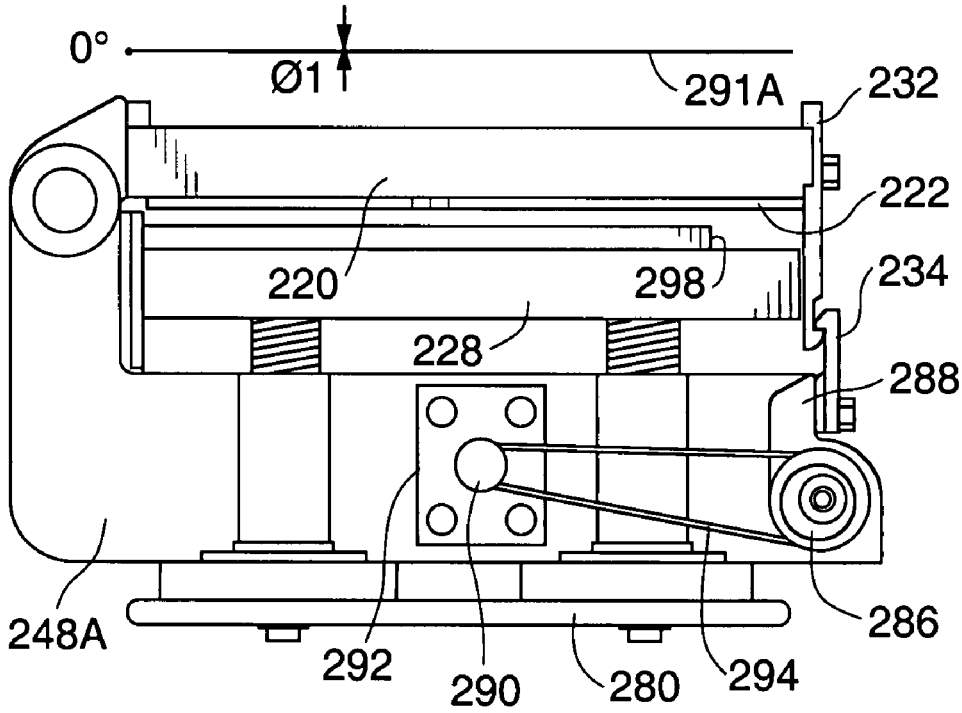
FIGS. 43A-43C show the lower latch mechanism in three states with the piston plate (the lower plate) in a slightly retracted position, with the mechanism in a first state (FIG. 43A) such that the piston plate and the top plate are parallel, in a second state (FIG. 43B) such that the piston plate is at a small negative angle with respect to the lower plate and a third state (FIG. 43C) such that the piston plate is at small positive angle with respect to the lower plate.
Figure 44A:
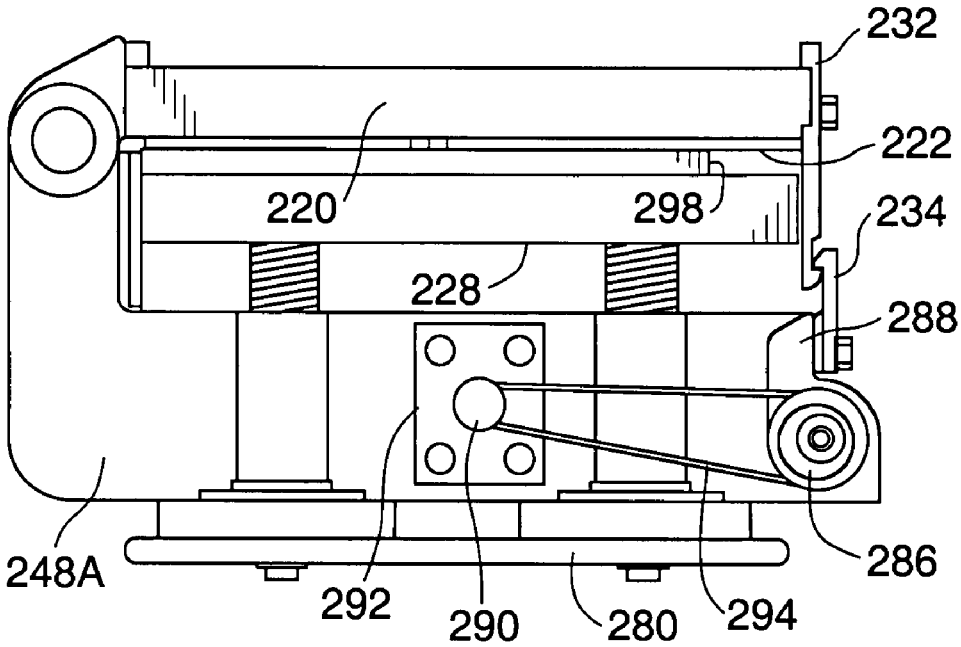
FIGS. 44A-44C show the lower latch mechanism in the same three respective states of FIGS. 43A-43C, with the piston plate in an engaging position so that a compression force is applied to the loaded carrier assembly positioned between the plates.
Figure 43B:
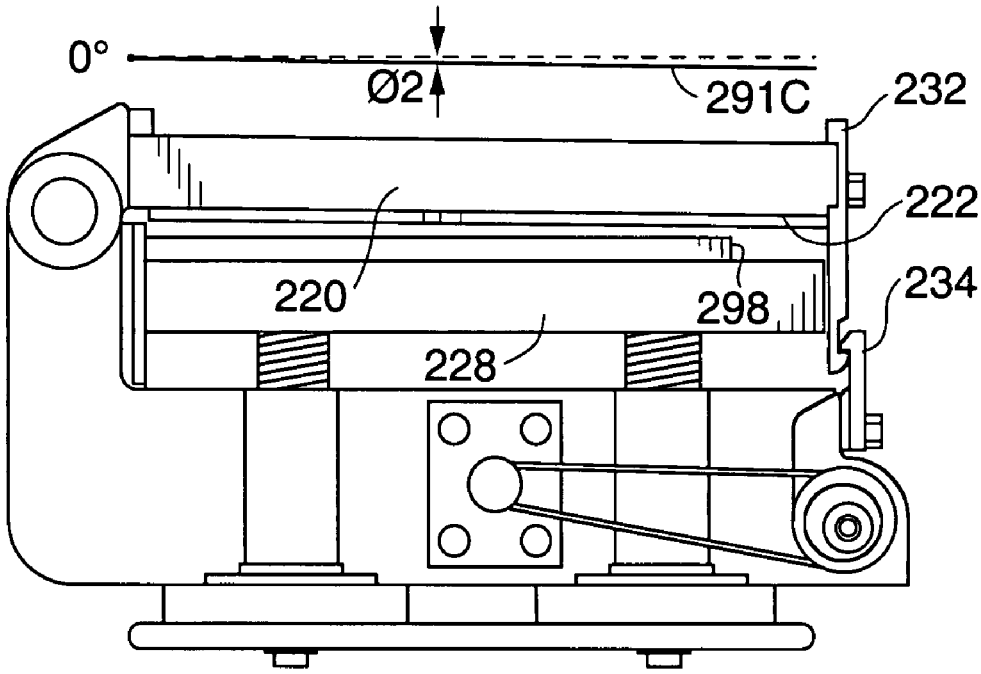
Figure 44B:
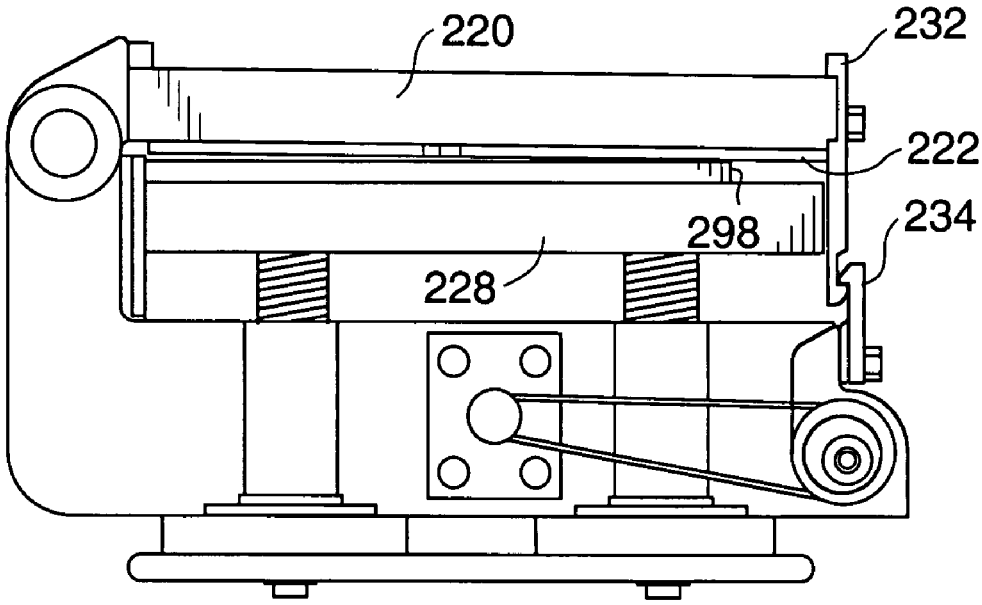
Figure 43C:
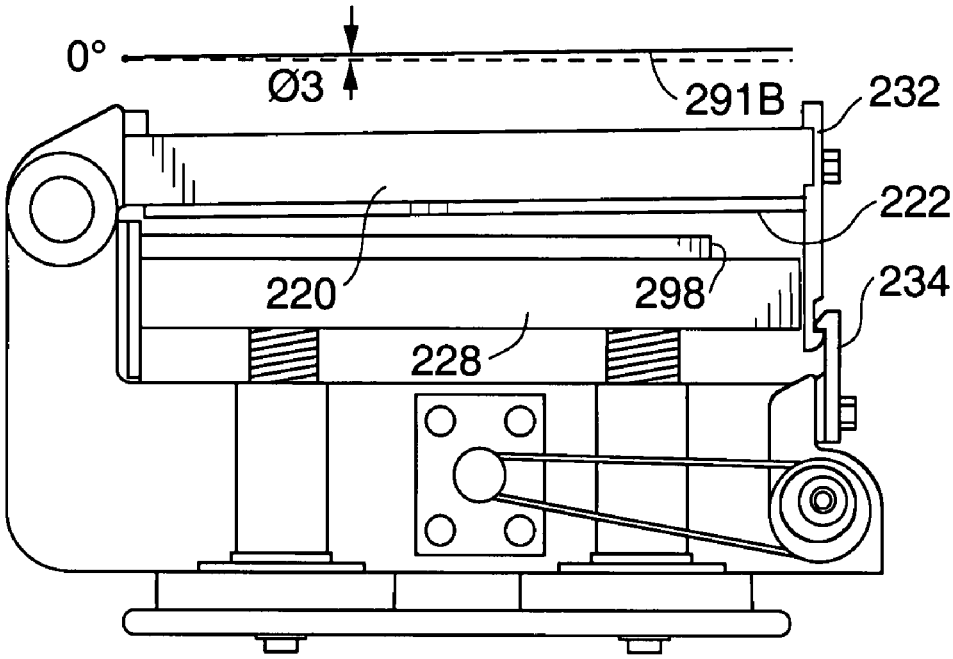
Figure 44C:
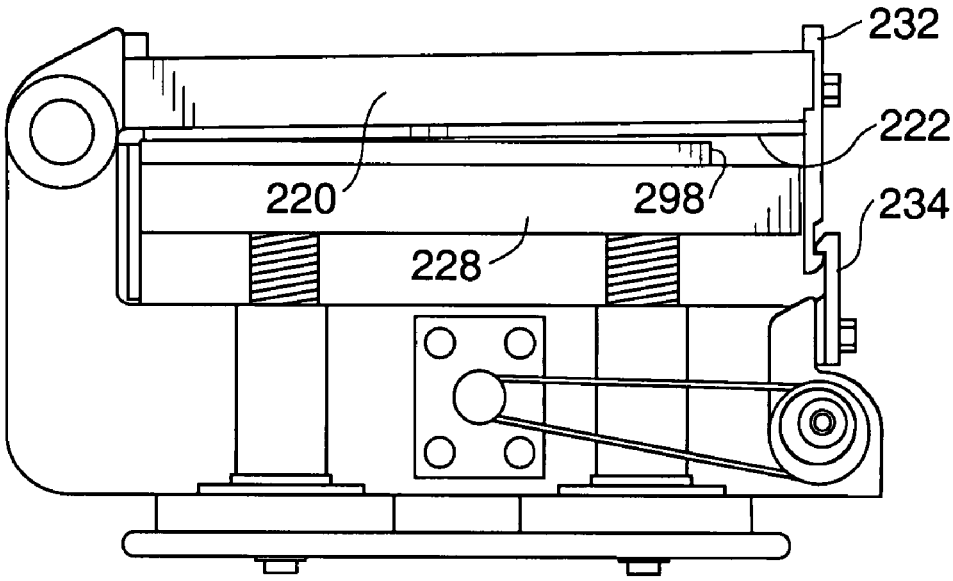

Operation of the latch mechanism will now be described. FIGS. 43A, 43B and 43C show the subject press with the latch mechanism in the first position of FIG. 43A, and in respective second and third positions of FIGS. 43B and 43C. Note that a loaded carrier assembly 298 has been placed on the receiving surface of the piston plate 228 abutting the front and side paper guides 226A and 226B which are not depicted in these figures. The spine region of the carrier assembly is positioned in this manner adjacent the side paper guide thereby locating the spine parallel to the hinge shaft 224 about which the top assembly 204 pivots. No upward movement of the piston plate 228 is shown in these figures. FIGS. 44A, 44B and 44C, which correspond to respective FIGS. 43A, 43B and 43C, also show the latch mechanism in the first, second and third positions, except in these cases the piston plate 228 is driven upwards so as to apply an upward force against the top plate 220 by way of the carrier assembly 298.

Assuming that the latch drive motor 292 has rotated the latch shaft 255 to the first position as shown in FIGS. 40A, 43A and 44A, the indicia 255A is at a zero degree rotational position (3 o'clock) by definition. This action will result in the lower latch being in a neutral position so that when upward pressure is applied to the top plate 220 carrying the upper latch 232, the upper latch will move upwards and engage the lower latch 234 so that concave surface 232A (FIG. 40A) of the upper latch is received in the convex surface 234A of the lower latch 234. At this point, the top plate 220 is substantially parallel to the piston plate 228 as indicated by a zero degree angle $\theta_1$ by angle indicia line 291A, with the unlabeled dashed line representing zero degrees. This angle may not be exactly zero in FIG. 43A since no upward pressure is applied to the top plate 220 which would ensure that upper and lower latches 232 and 234 are fully engaging one another. The parallel relationship between plates 228 and 220 insures that a substantially uniform compression force is applied over the surface of the loaded carrier assembly 298. This position provides the majority of the compression force used to activate the previously described pressure sensitive adhesive fastening layers of the loaded carrier assembly 298. Note that a layer 22 of ⅛ inch thick relatively stiff foam rubber layer 222 is preferably located on the inner surface of either the top plate 220 as depicted in FIGS. 43A, B, and C or the piston plate 228 to assist in evenly distributing the compression force over the entire surface of the carrier assembly 298. An open cell urethane foam having a density of 20 pounds per cubic foot and sold by Rogers Corporation under the designation 4701-50-20125-04 has been found suitable for this application. In order to resist wear, a thin (0.010 inch) layer of Lexan brand polycarbonate film sold by GE Plastics under the designation 8B35 is preferably laminated to the exposed surface of the foam layer.

As shown in FIG. 40B the latch motor then drives the latch shaft 255 counter clock wise 90 degrees to a second position (12 o'clock) as indicated by the vertical position of indicia 255A and movement line 257A. This causes the lower latch 234 to be drawn down slightly. Note that it is critical that the piston plate 228 be retracted prior to any rotation of latch shaft 255 since the latch motor 292 does not have sufficient drive power to overcome the upward force applied by the piston plate. FIG. 43B shows the press with the latch mechanism in this second position with no upward pressure applied by the piston plate 228, with FIG. 44B showing the press with the piston plate 220 again applying a prescribed upward pressure. As shown by the angle indicia 291B associated with FIGS. 43B and 44B, the angle $\theta_2$ is a small negative angle. Thus, when upward pressure is applied by the piston plate 228, the compression force is substantially more concentrated in the regions of the carrier assembly 298 located on the edge opposite the spine. This concentrated force enhances the strength of the assembly in the region of the assembly where the outer edges of the pages of the assembly are located, edges which a user handles when turning pages and which thus have the greatest tendency to separate. The downward movement of the latch mechanism to the second position is typically only about 0.063 inches. Assuming that the latch mechanism edge is located about 15.4 inches from the pivot point at the center of hinge shaft 224, this downward movement translate to an angle $\theta_2$ of 0.234 degrees. Preferably, $\theta_2$ should be at least 0.1 degrees.

The piston plate 228 is then retracted so that latch motor 292 can rotate the latch shaft 255 to the third position of FIG. 40C, that being a clock-wise rotation of 180 degrees as indicated by movement line 257B so that the indicia is at 6 o'clock. This moves the lower latch 234 upwards to a maximum height which is again about 0.063 inches from the position of FIG. 43A. This again translates to an angle $\theta_3$ of 0.234 degrees when upward pressure is applied to the top plate 220 by way of the loaded carrier 298, with this angle preferably being at least 0.1 degrees. As can also be seen in FIGS. 43C and 44C, when upward pressure is applied to the top plate 220, a concentrated compression force is applied near the spine of the assembly 298. This action enhances the strength of the spine region of the assembly 298. Finally, the piston plate 228 is retracted and the latch shaft driven clockwise to a 10:30 o'clock position as can be seen in FIG. 40D. This causes the lower latch 234 to be lifted. In addition, this rotational latch shaft position causes a lever arm (not depicted) to press against the lower latch support 288 so that support member moves way from the upper latch 232, causing spring 290 (FIG. 41) to expand slightly. This action causes lower latch 234 to move away from the upper latch 232 so that the top assembly 204 can be lifted for removal of the bound carrier assembly.

Figure 45:
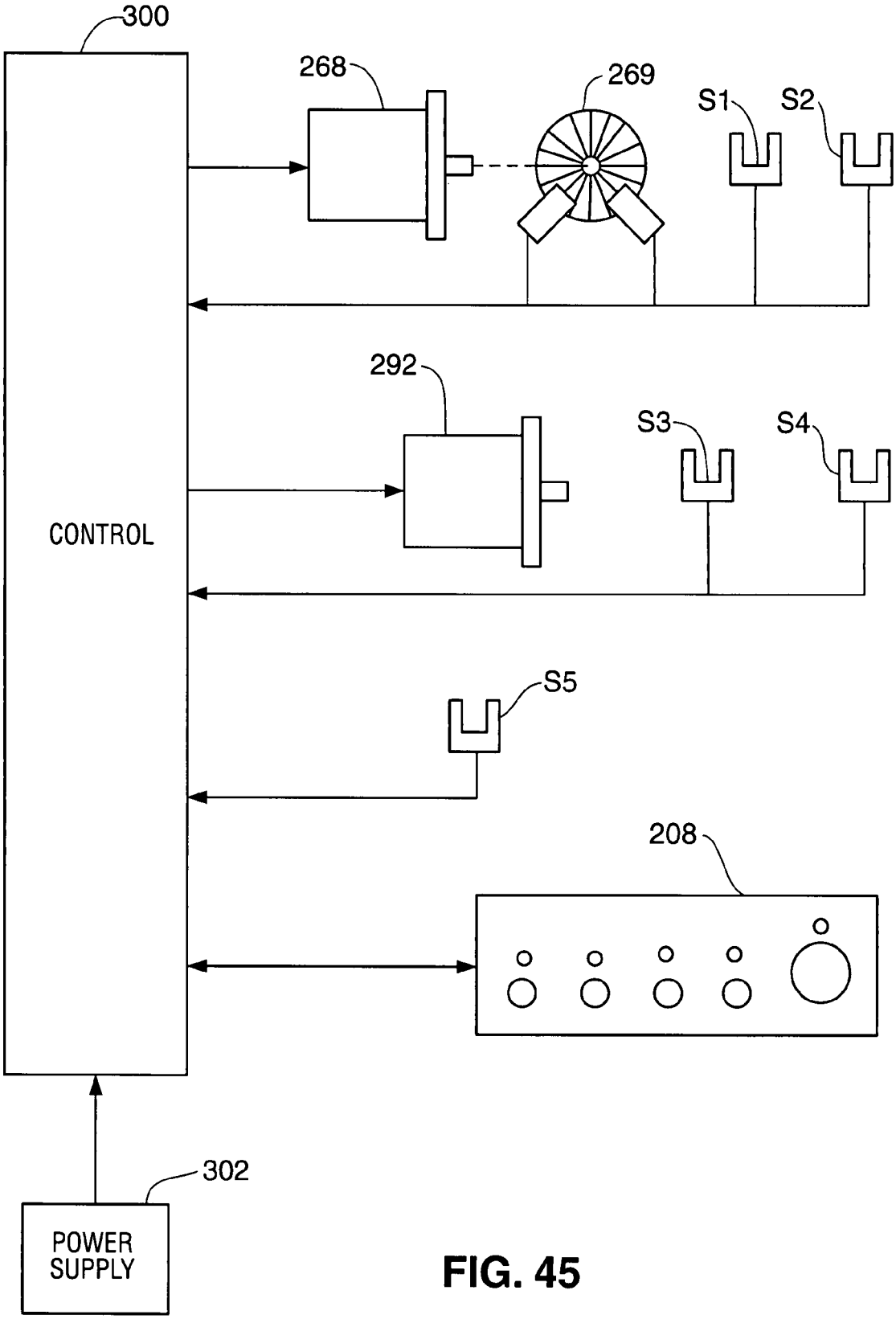
FIG. 45 is a simplified block diagram of the primary electrical and electronic components of the subject press.

FIG. 45 is a simplified block diagram of the electro-mechanical components of the subject press. A control block 300 represents the various components for controlling the press in the manner previously described. The control block includes a short program to automatically carry out a binding sequence based upon various inputs provided by user by way of control panel 208 as will be further described. The stepper motor 292 is controlled by a dual full bridge MOSFET driver such a sold by Allegro Microsystems Inc under the designation A3985 which utilizes external power MOSFETs. The main motor 268 is controlled by a three phase MOSFET controller also sold by Allegro Microsystems Inc under the designation A3932 which also utilizes external power MOSFETs. Both driver/controller circuits are controlled by a flash microcontroller with embedded flash memory such as the model AT91SAM7X256 controller sold by Atmel Corporation. The construction and operation of the control block 300 is conventional and, based upon the present disclosure, can be readily implemented by one having ordinary skill in the art using conventional motor control circuitry. Thus, additional details of such implementation will not be provided so as to avoid obscuring the true nature of the present invention in unnecessary detail. The various voltages needed for the press are provided by a power supply 302, with the control panel 208 enabling a user to easily input the needed information for binding carrier assemblies for books of varying sizes, so that roughly the same pressure in terms of pounds per square inch is used for books of all sizes. Thus for example, for a small carrier assembly for a small book, less force need be applied by the piston plate 228 in terms of pounds as compared to a larger book. Other functions of the control panel 208 will be described.

The electro-mechanical components further include sensors S1-S5 that are position sensors and can be implemented using either micro-switches or slotted optical switches. Sensor S1 functions as a position sensor for the piston plate 228, with sensor S2 functioning to sense when the piston plate is at a reference position at the center of piston plate travel. An optical encoder 269 associated with motor 268 is used in combination with sensors S1 and S2 to determine the exact location of the piston plate 228 at any time.

Sensor 3 is used as a home reference position for the lower latch 234 position. Since the latch motor 292 is a stepper motor, this reference position can be used when to control the number of steps from this position to rotate the latch shaft 255 either clock-wise or counter-clock wide to arrive at the previously described shaft positions shown in FIGS. 40A-40D. Sensor S4 is used to confirm that latches 232 and 234 are latched together and sensor S5 is used to confirm that the top assembly 204 is in a closed position.

Figure 46:
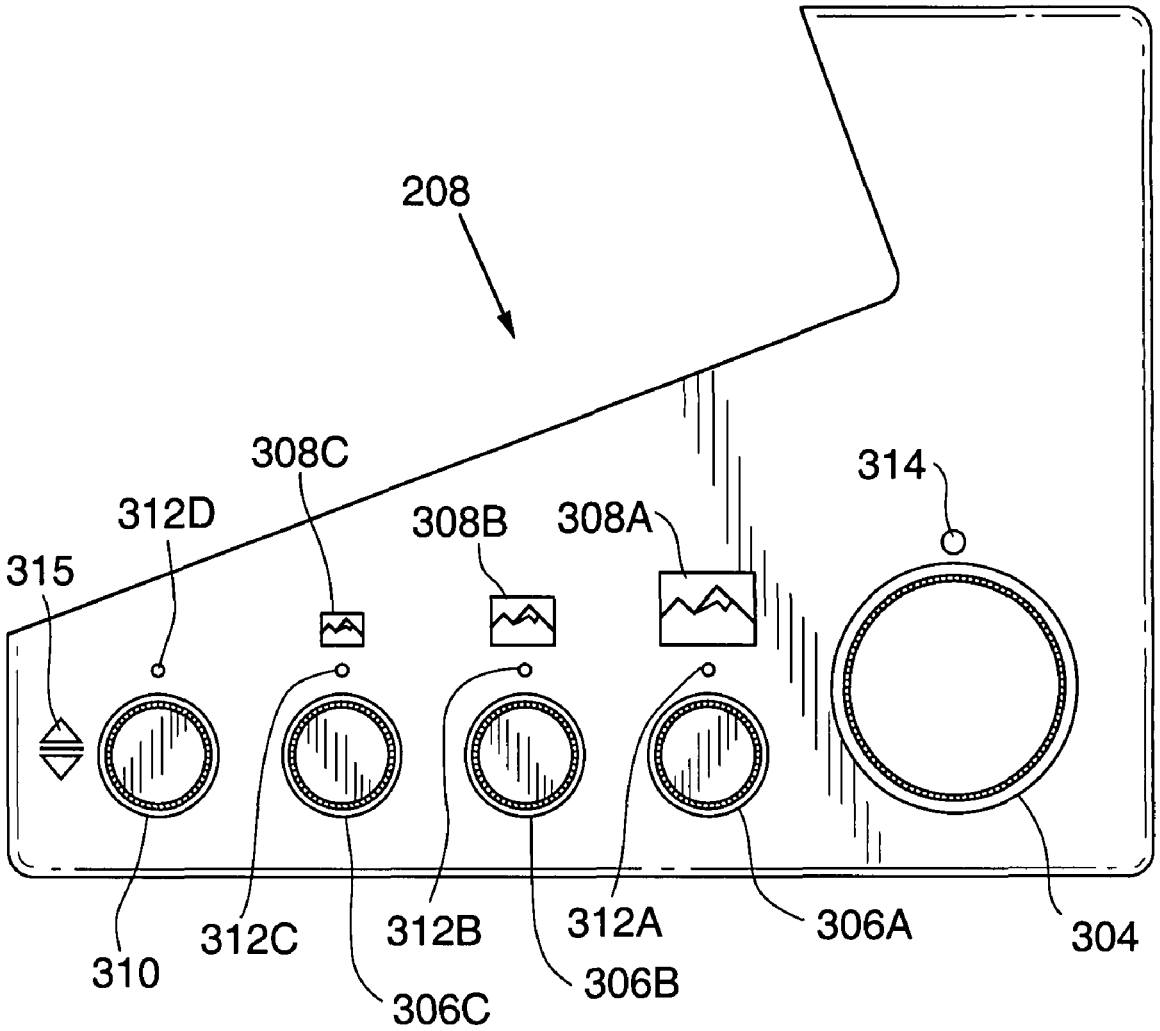
FIG. 46 shows details regarding the control panel for the subject embodiment press.
Figure 47:
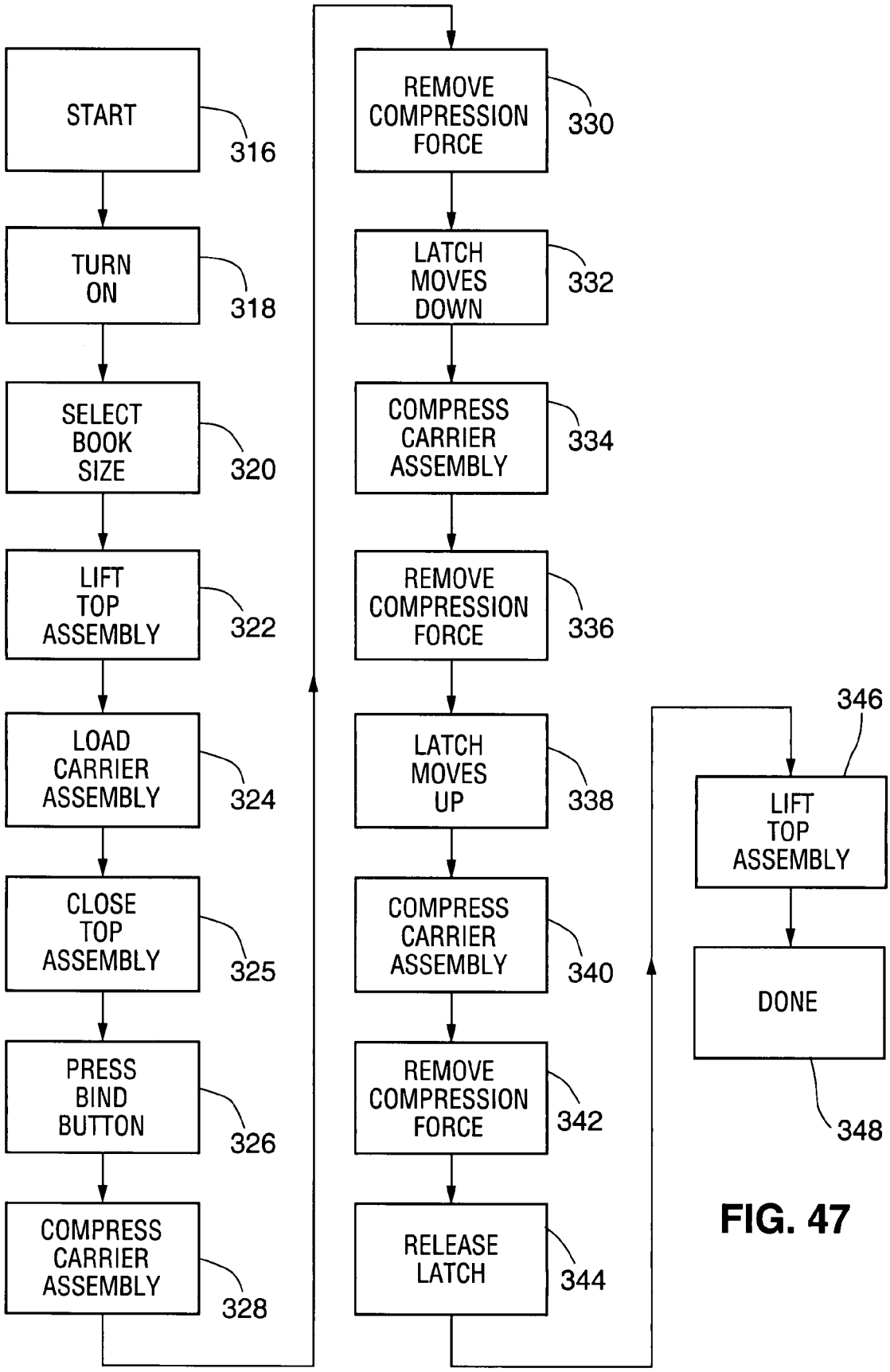
FIG. 47 is a flow chart showing an exemplary binding sequence carried out by the subject press.

FIG. 46 shows further detail regarding control panel 208. The functions carried out by the control panel will be described in connection with the flow chart of FIG. 47. The flow chart describes one binding sequence for a loaded carrier assembly 298. At the start of the sequence represented by block 316, the binder is in a latched position, with that position being attained prior to the press being shut off at the end of a previous binding sequence. The machine is turned on as indicated by block 318 by way of rear switch 240. Once the press in on, a green LED 314 (FIG. 46) is maintained on steadily. Main motor 268 drives the piston plate 228 down to a default depth by way of a drive train that includes gear 266

(FIG. 36B), gear 270 and chain 280 (FIG. 36A) which simultaneously drives the four ball screws 262A, 262B, 262C and 262D by way of respective sprockets 276A, 276B, 276C and 276D connected to the respective ball nuts of the screws. Simultaneous rotation of the ball nuts causes the associated screw shafts to be translated so that the piston plate 228 moves down to the desired default depth.

At this point, actuation of any button on the control panel 208 will cause the latches to unlock by rotating the latch shaft 255 to the FIG. 40D position. At this point, the appropriate book size is selected by actuating one of the three book size buttons as follows: button 306A for a large book (10×10 inch and 12×12 inch), button 306B for a medium size book (8×8 inch and 8½×11 inch) and button 306C for a small size book (4×6 inch and 5×7 inch). The three associated book size indicia 308A, 308B and 308C identify the function of book size buttons. Once a book size is selected, the appropriate one of the associated amber LEDs 312A, 312B, 312C and 312D is illuminated. Note that book size can also be selected later in the sequence if some button other than a book size button is actuated at this point.

With the machine unlatched, the user can then lift the top assembly 204 and place the loaded carrier assembly 298 on the piston plate 228 receiving surface as indicated by blocks 322 and 324 of the flow chart. The assembly 298 is positioned so that the spine of the assembly is abutting the left guide 226B and an adjacent edge of the assembly is abutting the front guide 226A. Given the tilt of the piston plate 228, gravity will cause the assembly to move to this position. The loose components which make up the assembly, including the photographs, will tend to be correctly aligned with one another due to this plate tilt. The top assembly 204 is then closed as indicated by block 325. If desired, the user can actuate a "down/unlock" button 310 on the control panel, which is identified by indicia 315. Control 300 will cause the piston plate 228 to drop below the default lowed position to accommodate a particularly thick carrier assembly 298.

The user then presses the bind button 304 on the control panel 208 as indicated by block 326, with this action causing the latch motor 292 to rotate the latch shaft 255 from the open position of FIG. 40D to the first position of FIGS. 40A and 41. In addition, green LED 314 starts to blink. Rotation of shaft 255 causes the latch mechanism to become latched, as confirmed by sensor S5 and enables the lower latch 234 to be moved to the neutral position of FIGS. 43A and 44A so that when pressure is applied to the top plate 220, the top and piston plates are substantially parallel. Once the latch mechanism is locked, control 300 causes motor 266 to automatically commence driving the piston plate 228 up so as to apply a compression force to the carrier assembly as indicated by block 328. As previously noted, the force can be controlled based upon which of size buttons 306 was previously actuated to that the applied pressure is somewhat constant. The target pressure will depend upon the manner in which the pressure sensitive adhesive based fastening layers 64 are actually implemented. For one exemplary implementation, the force applied for a large book designated by actuation of button 306A is selected to be about 10,000 pounds. For a medium size book designated by actuation of button 306B, the force is selected to be about the same—10,000 pounds. For a small book designated by actuation of button 306C, the force is reduced to 8,500 pounds. These force values could change depending upon the fastening layer implementations but preferably the force is at least 500 pounds. Typically, the force is applied for a total of about 60 seconds, again depending upon the implementation of the fastening layers 64 being used. The magnitude of the force being applied is related to the peak current drawn by motor 268. A current sensor (not depicted) senses the motor current and feeds back a current signal to the A3932 controller, with the controller including internal PWM current-control circuitry to regulate the maximum load current to the desired level. Once the target peak current has been reached, thereby indicating that the target applied force is being applied, the controller reduces the current slightly since a smaller current is sufficient to maintain the desired force. For a large book, the duration of the force is about 20 seconds. As will be described, for a large book there will be two further applications of force of 20 seconds each so as to provide a total duration of 60 seconds. For medium and small books it has been found that a single application of the requisite force of about 60 second duration is sufficient. The sequence can be aborted at any time by pressing any control panel button.

Once the appropriate force has been applied for a predetermined duration, control 300 causes the piston plate 228 to withdraw as indicated by block 330. For a small or medium size book, this single application of force is adequate to activate the fastening layers in all regions of the book. However, assuming that a large book is being created, control 300 then causes the latch shaft 255 to rotate from the 3 o'clock position of FIG. 40A to the 12 o'clock position of FIG. 40B thereby causing the lower latch 234 to move down slightly as previously described and as indicated by block 332. Control 300 then causes the piston plate 228 to be driven upwards as shown in FIG. 44B thereby applying an increased pressure to the end of the carrier assembly 298 opposite the spine as indicated by block 334. As previously noted, the typical duration is 20 seconds.

Again, once the appropriate force has been applied to edge of the assembly for appropriate amount of time, control 300 causes the piston plate to withdraw as indicated by block 336. Once the plate is withdrawn, control 300 causes the latch motor 292 to rotate the latch shaft from the position of FIG. 40B to the 6 o'clock position of FIG. 40C. This causes the lower latch 234 to move up as indicated by block 338. Control 300 then causes the piston plate to be driven upwards, as indicated by block 340 so as to again compress the carrier assembly 298, with the pressure being concentrated in spine region of the assembly as shown in FIG. 44C. After the appropriate duration of about 20 seconds, the compression force is removed, with the piston plate moving to the default location as indicated by block 342. Control 300 then causes the latch shaft 255 to rotate to the open position of FIG. 40D at 10:30 o'clock, with this rotation also causing a lever to push the lower latch 234 away from the upper latch 232, as indicated by block 344 so that the top assembly 204 can be lifted and the bound carrier assembly 298 removed as indicated by block 346. This completes the sequence as shown by block 348. For small and medium sized books, the sequence ends after the first 60 second single application of force, at which time the piston plate is withdrawn and the latch shaft is rotated to the open position of FIG. 40D. The fastening layers 64 of the loaded carrier assembly 298 are now completely activated. It is preferable that the compressing force be adjusted based upon the size of the book entered by the user using the control panel 208. However, it would be possible to vary the duration of the force based upon the book size, with the duration increasing for larger books. Again, the particular duration would depend upon the implementation of the fastening layers, with some implementations requiring a longer duration for activation of the layers. It would also be possible to adjust both the compressing force magnitude and duration based upon the book size entered by the user.

The carrier assembly 298 can now be incorporated in a hardcover assembly as desired. Alternatively, the loaded carrier assembly 298 and the hardcover assembly can both be compressed during the same sequence as previously described in connection with FIG. 9.

Although various embodiments of the present invention have been described in some detail, it is to be understood that various changes could be made by those skilled in the art without departing from the spirit and scope of the present invention as recited in the appended claims.

The invention claimed is:

1. A press for applying a force to an object, with the object having first and second separate edges, said press including:

a lower press plate which includes a receiving surface upon which the object is to be positioned and first and second guide members, with the receiving surface being tilted with respect to a level plane such that when the object is positioned on the receiving surface the object tends to move on the receiving surface by force of gravity such that the first edge of the object contacts the first guide member and such that the second edge of the object contacts the second guide member;

an upper press plate, with the lower and upper press plates being moveable with respect to one another, with the upper press plate including a compressing surface which is substantially parallel with respect to the receiving surface when the press is in a first operating mode; and a drive mechanism for driving at least one of the lower and upper press plates towards one another so as to apply a compressing force to an object on the receiving surface when the press is in a compressing state and for driving at least one of the lower and upper press plates away from one another and wherein, when the press is in the compressing state, the compressing surface and the receiving surface are tilted with respect to one another in one direction in a second operating mode such that a first plane parallel to the compressing surface and a second plane parallel to the receiving surface are displaced at a first angle of at least 0.1 degrees.

2. The press of claim 1 wherein the first and second guide members are configured to accommodate objects having orthogonal first and second edges.

3. The press of claim 1 wherein the drive mechanism causes the compressing force to be at least 500 pounds of force.

4. The press of claim 2 wherein the first guide member includes a first elongated surface for contacting the first edge of the object and said second guide member includes a second elongated surface for contacting the second edge of the object, with the first and second elongated surfaces being orthogonal surfaces.

5. The press of claim 1 further including a latch mechanism operable in a first latching state so that a first edge of the lower press plate and a first edge of the upper press plate are secured at a first distance from one another when the press is in the compressing state in the first operating mode and in a second latching state so that the first and second edges are secured a second distance, different from the first distance, from one another when the press is in the compressing state in the second operating mode.

6. The press of claim 5 wherein the press is further operable in an open state where the first edge of the upper press plate is moved away from the first edge of the lower press plate so that the object can be placed on the receiving surface, with the latch mechanism being operable in a release state to allow the first edges to move away from one another.

7. The press of claim 6 further including a controller for controlling the drive mechanism and the latch mechanism, with the controller causing the latch mechanism to move among the release state, the first latching state and the second latching state.

8. The press of claim 7 wherein the controller adjusts a magnitude of the compressing force based upon a size of the object.

9. The press of claim 8 further including a user interface which permits size data to be entered by a user, with the size data being received by the controller for adjusting the magnitude of the compressing force.

10. The press of claim 7 wherein the controller causes the press to move between the first and second operating modes without intervention by a user.

11. The press of claim 10 further including a base unit for supporting the press on a level surface and wherein the latch mechanism includes a lower latch member secured relative to the base unit and an upper latch member secured relative to the first edge of the upper press place, with the lower latch member including a movable latch extension that moves to a first extension position in the first latch state and to a second extension position in the second latch state.

12. The press of claim 11 wherein the lower latch member includes a latch motor for moving the latch extension, with the controller controlling operation of the latch motor to move the latch extension between the first and second extension positions.

13. The press of claim 12 wherein the controller prevents the latch motor from moving the latch extension between the first and second extension positions when the press is in the compressing state.

14. The press of claim 1 the drive mechanism includes a main motor connected to the lower press by a drive chain, with a majority of components of the drive chain being mounted on drive chain plate which is generally parallel to the lower press plate.

15. The press of claim 1 wherein, when the press is in the compressing state, the compressing surface and the receiving surface are tilted with respect to one another in a direction opposite the one direction in a third operating mode such that the first and second planes are displaced at a second angle of at least 0.1 degrees.

16. The press of claim 15 further including a latch mechanism operable in a first latching state so as to secure a first edge of the lower press plate and a first edge of the upper press plate a first distance from one another when the press is in the compressing state in the first operating mode, a second latching state for securing the first edges a second distance from one another, greater than the first distance, when the press is in the compressing state in the second operating mode and a third latching state for securing the first edges a third distance, greater than the second distance, when the press is in the compressing state in the third operating mode.

17. The press of claim 16 wherein the press is further operable in an open state where the first edge of the upper press plate is moved away from the first edge of the lower press plate so that the object can be placed on the receiving surface, with the latch mechanism being operable in a release state to allow the first edges to move away from one another.

18. The press of claim 17 further including a controller for controlling the drive mechanism and the latch mechanism, with the controller causing the latch mechanism to move among the release state and the first, second and third latching states.

19. The press of claim 18 wherein the controller adjusts a magnitude of the compressing force based upon a size of the object.

20. The press of claim 19 further including a user interface which permits size data to be entered by a user, with the size data being received by the controller for adjusting the magnitude of the compressing force.

21. The press of claim 20 wherein the controller causes the press to move among the first, second and third operating modes without intervention by a user.

22. The press of claim 21 further including a base unit for supporting the press on a level surface and wherein the latch mechanism includes a lower latch member secured relative to the base unit and an upper latch member secured relative to the first edge of the upper press place, with the lower latch member including a movable latch extension that moves to a first extension position in the first latch state, to a second extension position in the second latch state and to a third extension position in the third latch state.

23. The press of claim 22 wherein the lower latch member includes a latch motor for moving the latch extension, with the controller controlling operation of the latch motor to move the latch extension among the first, second and third extension positions.

24. The press of claim 23 wherein the controller prevents the latch motor from moving the latch extension among the first, second and third extension positions when the press is in the compressing state.

25. A press for applying force to an object comprising:

a lower press plate which includes a receiving surface upon which the object is to be positioned;

an upper press plate which includes a compressing surface;

a drive mechanism for driving at least one of the lower and upper press plates together in a compressing mode so as to compress the object and for withdrawing at least one of the lower and upper press plates away from one another;

a tilt control mechanism having a first state where the receiving and compressing surfaces are substantially parallel with one another when in the compressing mode and a second state where the receiving and compressing surfaces are tilted with respect to one another in a first direction by at least 0.1 degrees when in the compressing mode;

a controller for controlling the tilt control mechanism so that the tilt control mechanism switches from one of the first and second states to another one of the first and second states without intervention by a user and for controlling the drive mechanism to apply a compressing force, without intervention by a user after the tilt control mechanism switches one state to another state.

26. The press of claim 25 wherein the tile control mechanism further includes a third state where the receiving and compressing surfaces are tilted with respect to one another in a second direction, opposite the first direction, by at least 0.1 degrees when in the compressing mode, and wherein the controller controls the tilt mechanism so that the tilt mechanism switches among the first, second and third states without intervention by a user.

27. The press of claim 26 wherein the controller causes the drive mechanism to drive the upper and lower press plates to apply a compressing force when the tilt mechanism is in one of the first, second and third states, to then apply a compressing force when the tilt mechanism is in a different one of the first, second and third states and to then apply a compressing force when the tilt mechanism is in a still different one of the first, second and third states.

28. The press of claim 27 wherein the controller causes the drive mechanism to refrain from applying a compressing force when the tilt mechanism is changing states.

* * * * *